US006536181B1

(12) United States Patent
Hong

(10) Patent No.: US 6,536,181 B1
(45) Date of Patent: Mar. 25, 2003

(54) COMPOSITE RETAINING WALL AND CONSTRUCTION METHOD FOR UNDERGROUND STRUCTURE

(76) Inventor: Won Kee Hong, Songnam-si Bundang-gu 43-5 Jungja-dong, Gyeonggi-do 463-010 (KR)

( * ) Notice: Subject to any disclaimer, the term of this patent is extended or adjusted under 35 U.S.C. 154(b) by 0 days.

(21) Appl. No.: 09/646,225

(22) PCT Filed: Jan. 13, 2000

(86) PCT No.: PCT/KR00/00017

§ 371 (c)(1),
(2), (4) Date: Sep. 12, 2000

(87) PCT Pub. No.: WO00/42263

PCT Pub. Date: Jul. 20, 2000

(30) Foreign Application Priority Data

| | | |
|---|---|---|
| Jan. 13, 1999 | (KR) | 99-00639 |
| Oct. 30, 1999 | (KR) | 99-47786 |
| Oct. 30, 1999 | (KR) | 99-47788 |
| Oct. 30, 1999 | (KR) | 99-47839 |

(51) Int. Cl.[7] ..... E04B 1/00

(52) U.S. Cl. ..... 52/741.11; 52/741.12; 52/741.13; 52/741.15; 52/745.1; 52/745.13

(58) Field of Search ..... 52/741.11, 741.13, 52/741.15, 745.05, 741.12, 741.14, 745.1, 745.13, 236.3, 236.6, 236.7, 407.3

(56) References Cited

U.S. PATENT DOCUMENTS

| | | | | |
|---|---|---|---|---|
| 2,871,544 A | * | 2/1959 | Youtz | 52/741.14 |
| 3,457,690 A | * | 7/1969 | Clercq | 52/745.1 |
| 4,005,582 A | * | 2/1977 | Tamaro | 61/35 |
| 4,875,807 A | * | 10/1989 | Liu | 405/229 |
| 5,471,811 A | * | 12/1995 | House et al. | 52/745.1 |
| 6,332,303 B1 | * | 12/2001 | Saito | 52/741.14 |

FOREIGN PATENT DOCUMENTS

| | | |
|---|---|---|
| JP | 63-312439 | 12/1988 |
| JP | 6-272267 | 9/1994 |
| KR | 95-16755 | 7/1995 |
| KR | 96-31718 | 9/1996 |
| KR | 96-34595 | 10/1996 |

* cited by examiner

*Primary Examiner*—Lanna Mai
*Assistant Examiner*—Dennis L. Dorsey
(74) *Attorney, Agent, or Firm*—Thomas R. Vigil; Welsh & Katz, Ltd.

(57) ABSTRACT

The method for building an underground structure capable of utilizing a part of a permanent structure as a strut for earth construction, comprises the steps of: driving in an H-section steel pile on a boundary line at which a building is installed; driving a center pile on a position where the pillar of the building is installed; carrying out a primary excavating work; coupling the H-section steel pile with a concrete retaining wall by means of a fixing shear connecting means, thereby constructing an underground composite retaining wall; installing a girder to be used as a part of a permanent structure on the composite retaining wall by means of an embedded plate an assembling and disposing the girder to the center pile; and carrying out a secondary excavating work and repeating the steps after the primary excavating work until the earth is excavated up to the lowermost part of the building.

6 Claims, 52 Drawing Sheets

Fig. 25
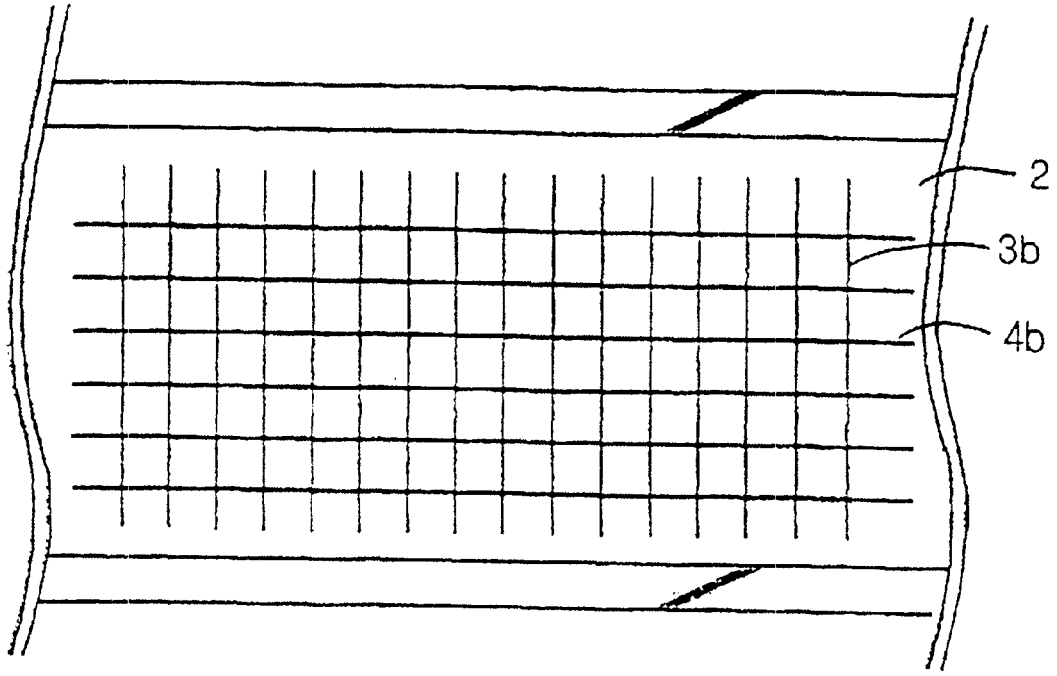
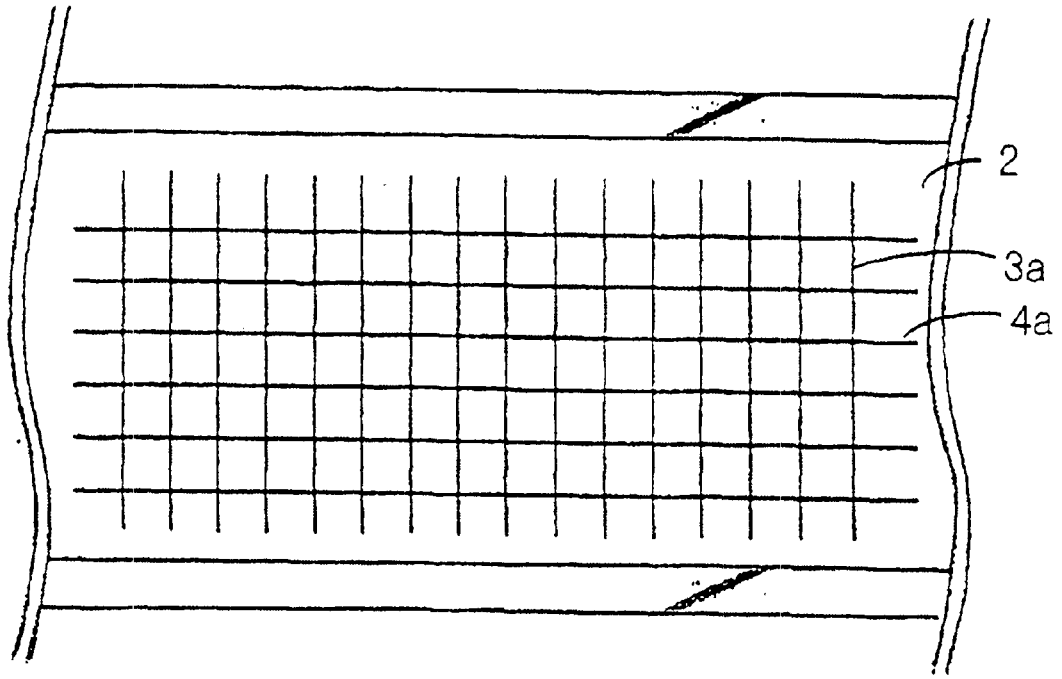

COMPOSITE RETAINING WALL AND CONSTRUCTION METHOD FOR UNDERGROUND STRUCTURE

FIELD OF THE INVENTION

The present invention relates to a method for building an underground structure of a building, and more particularly, to a method for building an underground structure which is capable of utilizing a retaining wall installed temporarily as a part of a permanent structure of a building, thereby economically constructing a retaining wall of the underground structure, and also utilizing structure members used in a main construction, without any installation of temporary struts for earth construction.

BACKGROUND OF THE INVENTION

So as to utilize a limited land effectively, generally, the depth of excavating into the underground in the downtown areas becomes deeper. Upon the underground excavating, an retaining wall is necessarily installed to protect existing facilities such as adjacent buildings, roads, etc. Even though a high construction cost is consumed for the installation of the retaining wall, it has been designed and constructed, while being considered as temporary construction facilities. The retaining wall exhibits a function of enduring an earth pressure, water pressure, upper member load and the like, until the building structure is completed. Then, if the building structure has been completed, the retaining wall is buried or in some cases of certain construction sites, disassembled and removed, thereby being treated as a separate structure from an underground retaining wall structure of the building. Even though the retaining wall has the same function as the underground retaining wall of the building, the retaining wall and the underground retaining wall are individually designed and constructed, which causes the unnecessary consumption of the construction cost. In addition, since it is necessary to design and construct the retaining wall at the minimum cost, there may occur a problem that a safety is relatively reduced, such that the retaining wall may be broken against an unexpected load.

There are several kinds of temporary retaining walls which are used for building a site for the structure under the ground. For example, a method for driving in an H-section steel pile into the ground and inserting an earth plate between the H-section steel piles, a soil cement wall (SCW) construction method, a cast-in-place concrete pile (CIP) construction method and a soil nailing wall construction method are commonly used. These methods generally form a wall body in the underground to bear against an external force such as an earth pressure, a water pressure and the like, and support the wall body by means of a strut installed in the interior of the wall body, pull the wall body by means of an earth anchor, or punch the original ground to reinforce the wall body with a soil nail. According to the axial force of the strut or earth anchor it will generate a fatigue of the material, which may cause a structural defect. As a result, the strut or earth anchor is considered as temporary structure. On the other hand, though the H-section steel pile, SCW, CIP and soil nailing wall which are driven in into the ground can be assembled with the outside retaining wall of the building to be thereby recycled as a part of the permanent structure, they are buried in the ground.

When the retaining wall is installed as the temporary facilities, an retaining wall line should move back towards the outside to occupy the working space required, since the working space for building the underground retaining wall is further needed. Therefore, an excavated amount increases as much as the movement of the retaining wall line, with a consequence that an amount of earth for filling the excavated site increases accordingly. In case of the soil nailing, the earth around the soil nailing processed portion theoretically exhibits an improved shear strength and is substantially independent. However, there is a problem that despite that the earth pressure around the soil nailing processed portion is not applied on the structure, the retaining wall is still designed with the assumption that the earth pressure is applied on the structure.

The present inventor has made various studies to solve the above problems encountered in the conventional temporary retaining construction method and as a result, proposes a novel underground retaining wall building method for permanently utilizing the temporary retaining wall which is disassembled or buried after a predetermined time elapses in the previous art, as a part of the retaining wall of the underground structure.

For the purpose of installing a structure in the ground, a general building method which comprise installing the temporary retaining wall, supporting the wall against the load by means of struts, and building the structure in order from the base in the ground to the upper portion thereof has been adopted. At this time, as the struts are temporary facilities, they only work as obstacles to the structure construction. In more detail, due to the struts, it is very inconvenient to unload construction materials or cast the concrete, or there is an inconvenience that the struts should be removed or reinstalled at another place during the construction. If it is possible to utilize a steel strut as a part of the permanent structure, the work for disassembling and removing the steel strut is not required, which makes the working processes of the structure more simple.

The present inventor has also studied a method of using a beam or girder installed in a permanent structure as a strut for a temporary construction.

PURPOSE OF THE INVENTION

Accordingly, an object of the present invention is to provide a method for building an underground structure which is capable of utilizing an retaining wall installed temporarily for excavating a site for the underground structure of a building as a part of a permanent structure. Another object of the present invention is to provide a method for designing a structure which is capable of utilizing an retaining wall installed temporarily for excavating a site for an underground structure of a building as a part of a permanent structure.

Yet another object of the present invention is to provide a method for building an underground structure which is capable of preventing the underground structure from floating.

Still another object of the present invention is to provide a method for building an underground structure which is capable of utilizing a strut installed temporarily for excavating a site for the underground structure of a building as a part of a permanent structure.

SUMMARY OF THE INVENTION

According to the first aspect of the present invention, there is provided a method for building an underground composite retaining wall, which includes the steps of: determining a position where a temporary retaining wall is installed in the consideration of the outside line of the underground of a building, forming holes by means of a construction equipment such as an auger drill to drive in an H-section steel pile into each of the holes, and installing an earth plate between the H-section steel piles, thereby completing the installation of the temporary retaining wall; excavating a site in the interior of the temporary retaining wall; if the excavation of the construction site is completed, installing a anchored shear connecting means on the H-section steel pile; arranging reinforcing bars on an underground retaining wall; and installing form in the inside of the underground retaining wall, casting concrete in the form and curing the concrete, thereby completing the formation of the underground retaining wall.

According to the second aspect of the present invention, there is provided a method for building an underground structure by utilizing a part of a permanent structure as a strut for earth work, which includes the steps of: driving in an H-section steel on a boundary line at which a building is constructed; driving in a center pile on a position where the pillar of the building is installed; carrying out a primary earth excavating work; coupling the H-section steel pile with a concrete retaining wall by means of a anchored shear connecting means, thereby constructing an underground composite retaining wall; installing a girder to be used as a part of a permanent structure on the composite retaining wall by means of an embedded plate and assembling and disposing the girder to the center pile; and carrying out a secondary earth excavating work and repeating the steps after the primary earth excavating work until the earth is excavated up to the lowermost portion of the building.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description and serve to explain the principles of the drawings. In the drawings:

FIGS. 1*a* to 28 are exemplary views illustrating a method for integrating a temporary retaining wall with an underground retaining wall to thereby utilize the temporary retaining wall as a permanent structure, wherein FIGS. 1*a* and 1*b* are plan sectional view and elevated view illustrating a conventional underground retaining wall building method, FIGS. 2*a* and 2*b* are plan and sectional views illustrating an underground retaining wall building method according to the present invention, FIGS. 3*a* to 3*c* are exemplary views illustrating the examples of a anchored shear connecting means used for integrating a temporary retaining wall with an underground retaining wall in the present invention, FIG. 4 is a detailed exemplary view illustrating an example where a temporary retaining wall having an H-section steel as a thumb pile and an earth plate inserted into the H-section steels is utilized as a permanent structure, FIG. 5 is an exemplary view illustrating the arrangement of the reinforcing bars of the present invention, FIG. 6 is an exemplary view illustrating the arrangement of the reinforcing bars in an effective width section in FIG. 5, FIGS. 7*a* to 7*c* are detailed exemplary views illustrating examples where in case of installing a soil cement wall (SCW) as the temporary retaining wall, the soil cement wall is utilized as a permanent structure, FIGS. 8*a* to 8*c* are detailed exemplary views illustrating examples where a cast-in-place concrete pile (CIP) temporary retaining wall is utilized as a permanent structure, FIGS. 9*a* to 9*c* are detailed exemplary views illustrating examples where a cast-in-place concrete pile (CIP) temporary retaining wall to which the H-section steel is reinforced is utilized as a permanent structure, FIGS. 10*a* and 10*b* are exemplary views illustrating examples where the earth excavating depth in FIG. 6 increases, FIG. 11 is an exemplary view illustrating the variation of FIGS. 10*a* and 10*b*, FIGS. 12*a* to 12*c* are plan sectional views of FIGS. 10*a* and 10*b* or FIG. 11, FIG. 13 is a schematic view illustrating the arrangement of reinforcing steel bars which are resistant to the diagonal tension failure generated from the retaining wall, FIGS. 14*a* and 14*b* are exemplary view illustrating a steel pile installation method in FIGS. 10*a* and 10*b* or FIG. 11, FIG. 15 is a detailed exemplary view illustrating the example where the anchored shear connecting means is not provided in the present invention, FIGS. 16*a* and 16*b* are schematic views illustrating the reinforcing bar arrangement in the case where the H-section steels are installed at different intervals in accordance with the status of ground and the type of an retaining wall, FIGS. 17*a* and 17*b* are exemplary views illustrating the connection of the top of the H-section steel with the slab of an uppermost story of the underground stories, FIGS. 18*a* and 18*b* are exemplary views illustrating the connection of the bottom of the H-section steel with a base mat in the ground, FIG. 19 is an exemplary view illustrating the situation before the retaining wall construction and after the soil nailing wall construction, FIG. 20 is an exemplary view illustrating the example where the soil nailing wall and the retaining wall are assembled as a combined structure, FIGS. 21 to 24 each shows the structural concept of assembling the soil nailing wall and the retaining wall as a combined structure, FIG. 25 is an elevated view illustrating the arrangement of the reinforcing bars in the case where the soil nailing wall and the retaining wall are assembled as a combined structure, FIG. 26 is an exemplary view illustrating the concept of computing the buoyancy applied on a conventional building, FIG. 27 is a detailed exemplary view illustrating a method for preventing the building from floating according to the present invention, FIG. 28 is a detailed plan sectional view of the reinforcing wall in FIG. 27.

FIGS. 29 to 44 are detailed exemplary views illustrating a method for utilizing a steel structure used in a main construction as a strut for earth construction, wherein FIGS. 29 to 38 are exemplary views by steps illustrating the method for utilizing the steel structure used in the main construction as the strut for earth work, FIG. 39 is a plan view illustrating the state where a steel girder used in the main construction is utilized as a temporary strut, FIG. 40 is an enlarged view illustrating a part of FIG. 39, FIGS. 41*a* and 41*b* are detailed exemplary views illustrating a method for installing an underground outside retaining wall, FIG. 42 is an exemplary view illustrating the load state against the underground retaining wall in the present invention, in the state where retaining and earth excavating are carried out by installing the steel girder used in the main construction on the underground outside retaining wall, FIG. 43 is an exemplary view illustrating a usage method for a jack which is installed on the girder in the present invention, and FIG. 44 is an exemplary view illustrating the variation of FIG. 39.

FIGS. 45*a* to 51*b* are detailed exemplary views illustrating a method for utilizing the steel structure used in the main construction as a constructing strut, wherein FIGS. 45*a* and 45*b* are sectional views illustrating the construction of the preferred embodiment in FIGS. 45*a* to 51*b*, FIGS. 46*a* and 46*b* are vertical and horizontal sectional views illustrating the example of a rail for connecting the retaining wall and the girder in the present invention, FIGS. 47*a* and 47*b* are vertical and horizontal sectional views illustrating another example of FIGS. 46*a* and 46*b*, FIGS. 48*a* to 48*d* show the variations of another example of FIGS. 46*a* and 46*b*, FIGS. 49*a* to 49*c* show the variations of another example of FIGS. 46*a* and 46*b*, FIGS. 50*a* to 50*d* show the variations of another example of FIGS. 46*a* and 46*b*, and FIGS. 51*a* and 51*b* show the variations of another example of FIGS. 46*a* and 46*b*.

FIGS. 52*a* to 52*f* are exemplary views illustrating the processes for installing the center pile.

FIGS. 53 to 57 are detailed exemplary views illustrating a method for utilizing the steel concrete beam of a permanent building as a strut for a temporary construction, wherein FIGS. 53 to 55 show the construction sequence for utilizing the steel concrete beam as the strut for the temporary construction, FIGS. 56*a* and 56*b* show the structure of form of a cast-in-place concrete beam, and FIG. 57 shows the construction type of the steel concrete beam used in the present invention.

FIG. 58 is skipped

FIGS. 59*a* to 62*c* are detailed exemplary views illustrating a zoning construction method for constructing a large-scale building utilizing the detailed examples of the present invention, wherein FIGS. 59*a* and 59*b* are plan and sectional views of the detailed example of the zoning construction method, FIG. 59*c* shows the variation of FIG. 59*a*, FIGS. 60*a* to 60*c* show the variation of FIGS. 59*a* to 59*c*, FIGS. 61*a* to 61*c* show another variation of FIGS. 59*a* to 59*c*, and FIGS. 62*a* to 62*c* are another detailed exemplary views of FIGS. 59*a* to 59*c*, in which FIG. 62*a* is a plan view and FIGS. 62*b* and 62*c* are sectional views illustrating the construction processes.

DETAILED DESCRIPTION OF PREFERRED EMBODIMENT

Reference will now be made in detail to the preferred embodiments of the present invention, examples of which are illustrated in the accompanying drawings.

FIGS. 1*a* to 28 are exemplary views illustrating a method for integrating a temporary retaining wall with an underground retaining wall to thereby utilize the temporary retaining wall as a permanent structure.

FIGS. 1*a* and 1*b* are plan sectional and elevated views illustrating a conventional underground retaining wall building method.

A temporary retaining wall (which is omitted in the drawing) is installed in order to excavate the construction site for the underground of a building and after excavating, an underground retaining wall(2) of the building is then installed. Thereafter, the temporary retaining wall on the outside of the underground retaining wall is removed or buried in the ground, and then, the existing ground(1) is hardened, thereby completing the construction of the underground retaining wall(2).

In case of designing and constructing the underground retaining wall(2) in a conventional practice, it should be buried or removed after the site excavating, since the temporary retaining wall is used only for excavating the site for the underground. However, the removal cost is really expensive, or upon removal, the surrounding ground sinks, thereby giving a serious affect to the adjacent buildings. Otherwise, in the case where the removal work is difficult, the retaining wall may be buried in the ground, which results in the unnecessary consumption of resources.

Since load(5) is directly applied on the underground retaining wall(2) after the hardening of the existing ground (1), the underground retaining wall(2) should be configured as holding against the load(5). Therefore, the reinforcing bars(3*a*, 3*b*, 4*a* and 4*b*) are conventionally arranged in accordance with the size of the load.

FIGS. 2*a* and 2*b* are plan and sectional views illustrating an underground retaining wall building method according to the present invention.

In the preferred embodiment of the present invention, the temporary retaining wall(20) and the underground retaining wall(2) are assembled as a unitary body by means of a anchored shear connecting means(11), thereby making the stiffness of the underground retaining wall substantially high (The temporary retaining wall(20) is shown with an H-section steel, for the convenience of illustration, in the drawing). As a principal concept of the present invention, the temporary retaining wall which has been removed or buried in the conventional method is integrated with the underground retaining wall(2) and thus utilized as a permanent wall. Hereinafter, the underground retaining wall which is built on the above concept of the present invention is referred to simply as a CRS retaining wall.

FIGS. 3*a* to 3*c* show the examples of a anchored shear connecting means(11) used for integrating the temporary retaining wall with the underground retaining wall.

The shear connecting means(11) serves to resist the shear flowing occurring on the section of a member and the cracking due to a diagonal tension generated in the process of an earth pressure loading. As shown, examples of the shear connecting means(11) can be a stud bolt, a U-steel and a screw bar. The shear connecting means is not limited in the above defined shapes. In other words, various means for integrating the temporary retaining wall with the underground retaining wall such as an adhesive material, a sand blasting formed of a rough surface to reinforce the coupling force, a shear key and the like can be utilized as the anchored shear connecting means.

FIG. 4 is a detailed exemplary view illustrating an example where a temporary retaining wall having an H-section steel(21) as a thumb pile and an earth plate inserted between the H-section steels are utilized as a permanent structure.

The anchored shear connecting means(11) is secured at predetermined intervals on the H-section steel(21) and the underground retaining wall(2) is formed in the inside of the H-section steel(21), thereby integrating the underground retaining wall(2) and the H-section steel(21). In this case, the portion where the H-section steel(21) exists form the underground retaining wall(2) in the conventional method and is explained as a unit beam having a section of B×h1, whereas if integrated by means of the anchored shear connecting means, it is explained as a unit beam having a section of B×h. Therefore, a sectional secondary moment increases by $[h/hl]^3$, i.e., $[1+h2/hl]^3$, thereby improving the resistance against the load.

On the other hand, since the portion where the H-section steel(21) exists exhibits an improved moment by the earth pressure and the water pressure and an excellent shear resistance, vertical reinforcing bars(3*a*) are inserted between the portions (i.e., the portion between stories) supported by a slab on the portion where the H-section steel(21) exists, thereby working as a beam. The underground retaining wall(2) placed between the portion where the H-section steel(21) exists and the portion where another H-section steel(21) exists is exposed to the load, thereby functioning to deliver the load to the portion where the H-section steel(21) exists. In this case, the load applied to the underground retaining wall flows to the portion where the H-section steel(21) exists (see the arrow in the drawing), such that the section of the portion where the H-section steel(21) exists is resistant against the load. Therefore, as shown in FIG. 5, main reinforcing bars, as disposed between the portions (i.e., the portions between stories) supported by the slab on the portion where the H-section steel(21) exists, are the inside vertical reinforcing bars(3*a*). Main reinforcing bars of the underground retaining wall, as disposed between the portion where the H-section steel(21) exists and the portion where another H-section steel(21) exists, are the inside horizontal reinforcing bars(4*a*). Since the vertical reinforcing bars of the underground retaining wall(2) disposed between the portions where each H-section steel(21) exists are not further required, minimum reinforcing bars should be arranged. Additionally, the vertical reinforcing bars on the poportion supported by the slab in the inside of the retaining wall are not further required.

FIG. 6 is a sectional view from the line B—B in FIG. 5, which shows the arrangement of the reinforcing bars on the section of the portion where the H-section steel(21) exists.

The temporary retaining wall (which is shown as the H-section steel and the earth plate in the drawing) is integrated with the underground retaining wall(2), which becomes a continuous beam supported by the slab of the underground structure. A negative moment to the H-section steel occurs at a supporting point 6, which is applied to the H-section steel. A positive moment occurs at the intermediate portion between the supporting points 6 and for the purpose of enduring the positive moment, the vertical reinforcing bars(3*a*) are arranged. If the vertical reinforcing bar(3*a*) endures the positive moment, it does not need to be necessarily continuous. Therefore, if the vertical reinforcing bar of a predetermined size which is manufactured by other external manufacturers is assembled, the reduction of the construction period and the improvement of the construction quality can be expected. Even though the shear stress intensity is not shown in the drawing, the shear stress intensity has a maximum value around the supporting point 6 and has a minimum value at the intermediate portion between the supporting points 6. Therefore, the anchored shear connecting means(11) are arranged closely at the support pointing 6 and thinly at the intermediate portion between the supporting points 6. However, since the H-section steel generally works for the shear stress, the arrangement for the shear stress is not commonly required.

Since the H-section steel(21) as integrated with the underground retaining wall by means of the anchored shear connecting means(11) is installed in place of the vertical reinforcing bars(3*b*) as main bars in the conventional underground retaining wall in FIGS. 1*a* and 1*b*, the vertical reinforcing bars(3*b*) are not required. By the same reason, the horizontal reinforcing bars are not required. Therefore, in the present invention only the horizontal reinforcing bars(4*a*) are required for the arrangement of reinforcing bars at the earth pressure side, which needs a minimum bar arrangement. On the other hand, it is convenient to use a ready-made product such as a welding wire net. That is, the prefabrication of the reinforcing bars can be possible.

FIGS. 7*a* to 7*c* show the example where a soil cement wall (SCW) is used as the temporary retaining wall. The soil cement wall is made by mixing cement to earth and disposing the mixture in a column array arrangement, thereby installing the retaining wall. In order to increase the stiffness of the retaining wall, the H-section steels are inserted at predetermined intervals.

The operation and construction of the soil cement wall as a temporary retaining wall are similar to those of the retaining wall composed of the H-section steel and the earth plate in FIG. 4.

The above method according to the present invention can be applied in any type of one row of soil cement wall (FIG. 7*a*), two rows of soil cement walls where one row of the soil cement wall is added at the back of the one row of soil cement wall (FIG. 7*b*), and three rows of soil cement walls where two rows of the soil cement walls are added at the back of the one row of soil cement wall (FIG. 7*c*).

FIGS. 8*a* to 8*c* are detailed exemplary views illustrating examples where a cast-in-place concrete pile (CIP) temporary retaining wall is utilized as a permanent structure. The cast-in-place concrete pile is formed by punching a hole at a predetermined position thereof and then inserting the reinforcing bar(27) into the hole. The piles are formed in a column array arrangement, thereby forming a CIP retaining wall(23). The reinforcing bar(27) is integrated with the underground retaining wall(2) by means of the anchored shear connecting means. On the back of the CIP an LW(labiles wasser) water shielding wall(26) into which labiles wasser glass is injected may be provided for shielding the water.

The above method of the present invention can be applied in any of one row of CIP retaining wall (FIG. 8*a*), two rows of CIP retaining walls where one row of CIP retaining wall to which no bar is inserted or a reinforcing bar is inserted is added at the back of the one row of CIP retaining wall (FIG. 8*b*), and three rows of CIP retaining walls where two rows of the CIP retaining walls to which no bar is inserted or a reinforcing bar is inserted are added at the back of the one row of CIP retaining wall (FIG. 8*c*).

FIGS. 9*a* to 9*c* are detailed exemplary views illustrating examples where an H-section steel reinforced CIP retaining wall is formed by inserting a reinforcing bar(27) and an H-section steel at predetermined intervals into the CIP.

The above method of the present invention can be applied in any of one row of H-section steel reinforced CIP retaining wall (FIG. 9*a*), two rows of CIP retaining walls where one row of the CIP retaining wall to which no bar is inserted or a reinforcing bar is inserted is added at the back of the one row of H-section steel reinforced CIP retaining wall (FIG. 9*b*), and three rows of CIP retaining wall line where two rows of the CIP retaining walls to which no bar is inserted or a reinforcing bar is inserted are added at the back of the one row of H-section steel reinforced CIP retaining wall (FIG. 9*c*).

Referring to FIG. 4, an explanation of the construction method of the preferred embodiment of FIGS. 9*a* to 9*c* will be discussed.

First, a position where a temporary retaining wall is installed is determined in consideration of the outside line of the underground of a building, and holes are formed by means of a construction equipment such as an auger drill, through which the H-section steel(21) is inserted. Then, the earth plate is inserted between the H-section steels, thereby installing the temporary retaining wall, and a site for the underground structure in the interior of the temporary retaining wall is excavated. If the site excavating is completed, the anchored shear connecting means is installed at predetermined intervals on the H-section steel and the reinforcing bars are arranged on the underground retaining wall. In other words, the main vertical reinforcing bars(3*a*) are arranged around the H-section steel(21) in the underground retaining wall(2), and the horizontal reinforcing bars(4*a*) are arranged on the portion between the H-section steels(21) in the underground retaining wall(2). Next, a form is installed in the interior of the underground retaining wall and concrete is cast and cured in the form.

Since in the conventional method the temporary retaining wall is installed and then, the underground retaining wall is separately installed, the working space for the underground retaining wall is further needed. As a result, the position of the temporary retaining wall should be moved toward the outside. Therefore, the size of site to be excavated increases and an amount of earth to be filled in the corresponding space increases, such that the construction cost has to be considerably high.

Referring to FIG. 7*a*, an explanation of the construction method of another embodiment of the present invention will be discussed.

First, a position where a temporary retaining wall is installed is determined in consideration of the outside line of the underground of a building, and holes are formed by means of a construction equipment such as an auger drill, through which the H-section steel is inserted. Then, the soil cement wall(22) is formed as the temporary retaining wall, and a site for the underground structure in the interior of the temporary retaining wall is excavated. If the site excavating is completed, the portion around the H-section steel of the soil cement wall(22) is exposed, on which the anchored shear connecting(11) is installed at predetermined intervals, and the reinforcing bars are arranged on the underground retaining wall. In other words, the main vertical reinforcing bars(3*a*) are arranged around the H-section steel in the underground retaining wall(2), and the horizontal reinforcing bars(4*a*) are arranged on the portion between the H-section steels in the underground retaining wall(2).

Next, a form is installed in the interior of the underground retaining wall(2) and concrete is cast and cured in the form. If required, a hole is driven on the portion between the H-section steels in the underground retaining wall(2), through which a dowel bar is inserted, such that the portion between the H-section steels in the underground retaining wall(2) can be integrated with the soil cement wall(22), thereby improving the structural performance.

Referring to FIG. 8*a*, an explanation of the construction method of another embodiment of the present invention will be discussed.

First, a position where a temporary retaining wall is installed is determined in consideration of the outside line of the underground of a building, and holes are formed by means of a construction equipment such as an auger drill, through which the reinforcing bar(27) is inserted, thereby forming the CIP retaining wall(23), and a site for the underground structure in the interior of the CIP retaining wall is excavated. If the site excavating is completed, the portion around the reinforcing bar of the CIP retaining wall(23) is exposed, on which the anchored shear connecting means(11) is installed at predetermined intervals, and the vertical and horizontal reinforcing bars(3*a* and 4*a*) are arranged on the underground retaining wall.

Next, a form is installed in the interior of the underground retaining wall(2) and concrete is cast and cured in the form. If required, a hole is driven on the CIP retaining wall(23), through which a dowel bar is inserted, such that the CIP retaining wall(23) can be integrated with the underground retaining wall(2).

Referring to FIG. 9*a*, an explanation of the construction method of still another embodiment of the present invention will be discussed.

First, a position where a temporary retaining wall is installed is determined in consideration of the outside line of the underground of a building, and holes are formed by means of a construction equipment such as an auger drill, through which the H-section steel is inserted at predetermined intervals, thereby forming the H-section steel reinforced CIP retaining wall(24), and a site for the underground structure in the interior of the CIP retaining wall is excavated. If the site excavating is completed, the portion around the H-section steel of the H-section steel reinforced CIP retaining wall(24) is exposed, on which the anchored shear connecting means(11) is installed at predetermined intervals, and the vertical and horizontal reinforcing bars(3*a* and 4*a*) are arranged on the underground retaining wall(2).

Next, a form is installed in the interior of the underground retaining wall(2) and concrete is cast and cured in the form. If required, a hole is driven on the H-section steel reinforced CIP retaining wall(23), through which a dowel bar is inserted, such that the H-section steel reinforced CIP retaining wall(24) can be integrated with the underground retaining wall(2).

In addition to the above methods, in case of using a steel sheet pile (which is omitted in the drawing) as the temporary retaining wall, the steel sheet pile can be utilized as a part of the permanent structure. Upon construction, a position where a temporary retaining wall is installed is first determined in consideration of the outside line of the underground of a building, and the steel sheet pile is driven in, thereby forming the temporary sheet pile retaining wall, and a site for the underground structure in the interior of the temporary sheet pile retaining wall is excavated. If the site excavating is completed, the anchored shear connecting means(11) is installed on the temporary sheet pile retaining wall and the vertical and horizontal reinforcing bars(3*a* and 4*a*) are arranged on the underground retaining wall. Next, a form is installed in the interior of the underground retaining wall(2) and concrete is cast and cured in the form.

FIGS. 10*a* and 10*b* are exemplary views illustrating examples where the site excavating depth in FIG. 6 increases to cause the earth pressure and the water pressure to be drastically large.

Referring to FIG. 10*a*, in case where the site excavating depth increases, there is a possibility that the H-section steel which is assembled with the retaining wall by means of the anchored shear connecting means exhibits a poor yield strength. In case of the underground structure of fourth and fifth stories, it can be under a structural computation found that the assembly of the H-section steel used in the temporary facilities and the underground retaining wall has low yield strength. Therefore, a steel reinforcing means(11*a*) is welded on the H-section steel, such that the retaining wall of the underground structure of fourth and fifth stories or less can be resistant against the earth pressure and the water pressure which increase depending upon the depth of the underground structure. At this time, since the steel reinforcing means(11*a*) is constructed in the interior of the retaining wall, no anchored shear connecting means may be required. However, for the purpose of achieving a complete connection, the anchored shear connecting means(11) is fixed on the steel reinforcing means(11*a*), as shown in FIGS. 10*a* to 11. The steel reinforcing means is constructed in a welding or bolting manner on the H-section steel in the interior of the retaining wall. Examples of the steel reinforcing means are an angle, a T-section steel, an H-section steel and the like, which are cut in a predetermined size in correspondence with the stress intensity (the portion where the moment is large). If the anchored shear connecting means such as a stud is installed on the retaining wall of the steel reinforcing means(11*a*), the connection between the H-section steel and the retaining wall can be rigidly formed.

As shown in FIG. 10*b*, upon construction of the H-section steel, the inclination of the H-section steel may be occurred due to the construction error, the status of ground and the like. Even in this case, the design of the combined structure and the construction method thereof are not varied at all. In case where the H-section steel is inclined, the thickness of the retaining wall increases, thereby having a safe combined structure. If the H-section steel is inclined toward the inside, the reconstruction is needed, which does not cause the performance of the combined structure to be deteriorated.

FIG. 11 is an exemplary view illustrating the variation of FIGS. 10*a* and 10*b*.

The steel reinforcing means resistant to the moment are disposed at only the positions required in FIGS. 10*a*, but may be continuously disposed under a predetermined depth on the H-section steel(21) in FIG. 11, for the convenience of the processing and construction of the steel reinforcing means. The size and length required of the continuous steel reinforcing means(11*b*) are determined in correspondence with the size of the stress intensity.

FIGS. 12*a* to 12*c* are plan sectional views of FIGS. 10*a* and 10*b* or FIG. 11.

Referring to FIG. 12*a*, the theoretical explanation on the reduction of the thickness of the retaining wall is the same as in FIG. 4. In other words, the H-section steel and the retaining wall are reinforced with the steel reinforcing means(11*a* and 11*b*), thereby functioning as a combined beam. The section secondary moment increases by the H-section steel and the steel reinforcing means, thereby improving the resistance to the load.

Since the portion where the H-section steel(21) exists exhibits an excellent resistance, the vertical reinforcing bar(3*a*) are inserted between the portions (i.e., the portion between stories) supported by the slab on the indoor side on the portion where the H-section steel(21) exists, thereby functioning as a beam. The underground retaining wall(2) placed between the portion where the H-section steel(21) exists and the portion where another H-section steel(21) exists is exposed to the load, thereby delivering the load to the portion where the H-section steel(21) exists.

The vertical reinforcing bar for reinforcing the retaining wall is double arranged or substantially large in size, in the case where the stress intensity applied to the retaining wall is high. In this case, in place of the arrangement of the reinforcing bars, steel structures (for example, channel, angle, H-section steel, etc.) are formed, as shown in FIGS. 12*a* and 12*b*. In other words, the reinforcing bar can be replaced with the steel structure having an effective structural section. Upon the replacement of the high performance of the steel structure, the conventional problem that the concrete is not completely filled due to the arrangement of a large number of reinforcing bars can be solved.

The anchored shear connecting means(11) can be further installed on the steel reinforcing means(11*a* and 11*b*), under a structural analysis. The position of the anchored shear connecting means(11) is determined on the front of the steel reinforcing means(11*a* and 11*b*), as shown in FIG. 12*a* or on the front and side of the steel reinforcing means(11*a* and 11*b*), as shown in FIGS. 12*b* and 12*c*.

The arrangement method of the retaining wall is formed under a structural analysis in such a manner that the vertical reinforcing bars(3*a* and 3*b*) are firstly arranged and the minimum reinforcing bars are then arranged, as shown in FIGS. 12*a* and 12*b*, or otherwise, the minimum reinforcing bars are firstly arranged and then, further arranged in a space needed, as shown in FIG. 12*c*. The minimum reinforcing bars may be arranged uniformly to thereby prevent the contraction due to the contraction because of the dry, as shown in FIG. 12*c*.

FIG. 13 is a schematic view illustrating the arrangement of reinforcing bars for being resistant against the diagonal tension failure generated from the reinforcing wall.

In case where the depth of the underground increases, as shown in FIGS. 10*a* to 11, the steel having a high structural performance may be used as the reinforced. At this time, the diagonal tension failure may occur due to the tension of the earth pressure. To resist the diagonal tension failure due to the tension stress of the concrete, a diagonal tension reinforcing bar(4*c*) is disposed in the vicinity of the steel reinforcing means(11*a* and 11*b*).

FIGS. 14*a* and 14*b* are exemplary view illustrating a method for installing the steel reinforcing means(11*a* and 11*b*) in FIGS. 10*a* and 10*b* or FIG. 11 on the H-section steel.

Firstly, a anchored guide steel material such as an angle or a band steel plate is welded to the H-section steel(21) and the steel reinforcing means(11*a* or 11*b*) is formed between the anchored guide steel materials in a bolt jointing manner (FIG. 14*a*) or directly welded to the H-section steel(21) (FIG. 14*b*).

FIG. 15 is a detailed exemplary view illustrating the example where the anchored shear connecting means is not provided in the present invention. A part of the H-section steel of the temporary retaining wall is disposed in the interior of the concrete retaining wall and is then combined with the retaining wall. In this case, if the structural yield strength is relatively high, the anchored shear connecting means is not necessarily required. In this case, when the retaining wall is installed, an earth plate installing guide steel material into which the earth plate is inserted is firstly disposed on the H-section steel and thus, the retaining wall is formed to be integrated with the part of the H-section steel. At this time, one of the flanges of the H-section steel is inserted into the retaining wall, thereby integrating the H-section steel with the retaining wall. The arrangement design and method of the retaining wall are similar to those in another embodiment of the present invention.

FIGS. 16*a* and 16*b* are schematic views illustrating the reinforcing bar arrangement in the case where the H-section steel is installed at different intervals in accordance with the status of ground and the type of retaining wall.

In case of the arrangement of the H-section steels at relatively large intervals (for example, at the intervals of 1.8 m in FIG. 16*a*), as shown in FIGS. 4, 5, 7*a* to 7*c*, 8*a* to 8*c*, 9*a* to 9*c*, 12*a* to 12*c*, 13 and 15, there exists an extinct arrangement difference between a combined beam section and an earth plate section. However, in case of the arrangement of the H-section steels at relatively small intervals, as shown in FIG. 16*b*, the earth plate section is reduced or the combined beam parts are adjacent to each other. Accordingly, even if the H-section steel structure is designed by using the structural performance of the temporary retaining wall, there will be a possibility that it is difficult to distinguish the retaining wall of the present invention from the retaining wall designed by a general retaining wall design method. However, whether the method according to the present invention is used or not can be understood by the careful check of the thickness of the retaining wall, the arrangement amount of the reinforcing bars and the like.

FIGS. 17*a* and 17*b* are exemplary views illustrating the connection of the top of the H-section steel with the slab of an uppermost story of the underground stories. FIGS. 18*a* and 18*b* are exemplary views illustrating the connection of the bottom of the H-section steel with a base mat.

The top and bottom of the H-section steel should be assembled as a unitary body with the building structure, thereby functioning as a combined structure. The top and bottom of the H-section steel are assembled by means of a stud bolt (FIGS. 17*a* and 18*a*) or top and bottom coupling means(12) such as steel structures (FIGS. 17*b* and 18*b*). When the H-section steel is inserted in the ground, the perpendicularity of 1/200 is typically kept. The connection of the top and bottom of the H-section steel is based upon a permanent structure utilization standard, and when the steel reinforcing means is welded to the H-section steel, a welding quality is checked by a PT test. It is of course apparent that the detailed embodiments in FIGS. 10*a* to 11 can be applied in various kinds of temporary retaining walls, for example, the soil cement wall and the CIP column wall, as shown in FIGS. 7*a* to 9*c*.

Next, an explanation of the composite retaining wall designing process will be discussed, using a structural performance of the retaining wall used in the method for driving in the H-section steel pile and inserting the earth plate between the H-section steel piles, the SCW construction method and the CIP construction method.

First, the size of load applied to the retaining wall in the ground is calculated. In other words, the nature of the ground, i.e., the adhesive force and friction angle of the ground is checked to thereby calculate the size of the earth pressure. The water level in the ground is predicted to thereby calculate the water pressure, and the upper member load applied on the ground and all load components applied to the retaining wall are calculated. Also, the load generated from the building structure is calculated. In more detail, all of the loads applied to the retaining wall, for example, a fixed load by the building structure, a carrying load on the building, a wind load, an earthquake load, etc. are calculated.

The load applied to the retaining wall from the ground and the load applied to the retaining wall from the building structure are calculated to thereby obtain the load which the retaining wall endures. The design contents of the pre-installed temporary retaining wall, that is, the kind of the temporary retaining wall, the interval and size of the H-section steel and the like are then checked.

The load which the combined structure of the temporary retaining wall and the retaining wall endures is calculated, and as a result, it is determined whether they are designed by using only the anchored shear connecting means (i.e., the stud bolt) or by using the steel reinforcing means in addition to the anchored shear connecting means.

First, in case where it is determined that they are designed by using only the stud bolt, the design order thereof is as follows:

So as to design the portion supported by the slab, a center axis between the H-section steel and the retaining wall connected to each other by the stud bolt is calculated and a maximum tensile stress generated on the H-section steel in the combined structure, a maximum compression stress generated on the concrete of the retaining wall in the combined structure, and a horizontal shearing force are calculated, thereby determining the kind of the anchored shear connecting means and the number of the anchored shear connecting means installed.

So as to design the space (the portion between stories) between the portions supported by the slab, a center axis between the H-section steel and the retaining wall connected to each other by the stud bolt is calculated and a maximum compression stress generated on the H-section steel in the combined structure is obtained. At this time, since tensile stress is generated on the concrete of the retaining wall in the combined structure, a vertical reinforcing bar quantity for resisting a predetermined moment is calculated.

Then, the reinforcing bar for preventing the failure of the anchored shear connecting means and diagonal tension caused due to the tension generated during the ground load delivery is designed.

The vertical reinforcing bar quantity at the portion between the stories of the building side on the retaining wall section is calculated. Therefore, on the portion between the stories, the compressive stress is applied to the H-section steel and the tension is applied to the reinforcing bar, unlike a conventional combined beam theory.

Next, the main reinforcing bar quantity working as the earth plate is calculated.

On the portion where the amount of the reinforcing bar used decreases by the computation of the stress, a minimum amount of reinforcing bar is designed and also, even on the portion where the reinforcing bar is not required by the computation of the stress, the minimum amount of reinforcing bar is designed.

On the other hand, in case where it is determined that they are designed by using the steel reinforcing means partially in order to reinforce the structural yield strength, since the combined structure of the retaining wall and the H-section steel connected by the stud bolt lacks the stress as the depth of the underground increases, the design order thereof is as follows:

A center axis of the combined structure of the H-section steel reinforced by the steel reinforcing means and the underground retaining wall is calculated.

So as to design the portion supported by the slab, a maximum tensile stress generated on the H-section steel reinforced by the steel reinforcing means in the combined structure, a maximum compression stress generated on the concrete of the retaining wall in the combined structure, and a horizontal shearing force are all calculated, thereby determining the kind of the anchored shear connecting means and the number of the anchored shear connecting means installed.

So as to design the space (the portion between stories) between the portions supported by the slab, a center axis of the combined structure of the H-section steel reinforced by the steel reinforcing means and the retaining wall is calculated and a maximum compressive stress generated on the H-section steel reinforced by the steel reinforcing means is obtained. At this time, since tensile stress is generated on the concrete of the retaining wall in the combined structure, a vertical reinforcing bar quantity for resisting a predetermined moment is calculated. In other words, the vertical reinforcing bar at the portion between the stories of the building side on the retaining wall section is calculated. Therefore, on the portion between the stories, the compressive stress is applied to the H-section steel and the tension is applied to the reinforcing bar, unlike a conventional combined beam theory.

Then, the reinforcing bar for preventing the failure of the anchored shear connecting means and diagonal tension caused due to the tension generated during the ground load delivery is designed. On the portion where the amount of the reinforcing bar used decreases by the computation of the stress, a minimum amount of reinforcing bar is designed and also, even on the portion where the reinforcing bar is not required by the computation of the stress, the minimum amount of reinforcing bar is designed.

To prevent the diagonal tension failure on the portion where the steel reinforcing means is installed, the size of the diagonal tension is calculated and the diagonal tension reinforcing bar corresponding with the calculated size is designed. Finally, the design for the connection (welding or bolt-jointing method) of the steel reinforcing means with the H-section steel is made.

The above design method is described based upon the temporary retaining wall predesigned and installed, but if it is applied to the building at a design stage, a more effective result can be expected.

FIG. 19 is an exemplary view illustrating the situation before the retaining wall construction and after the soil nailing wall construction. The soil nailing construction method begins in 1972, France and is widely popular in Europe. The technology of the construction method is greatly developed in U.S.A. and recently introduced to Japan and Korea. First, to minimize the amount of an initial displacement and the amount of an local breakdown generated by the action of gravity in accordance with the escape from the stress upon excavation, a shot-crete for protecting the excavation surface is installed and then, to minimize the travelling destruction and the generation of creep in accordance with the lapse of time, soil nails are reinforced on the original ground, thereby improving the shear strength of the original ground. In other words, the reinforcing material called the soil nail is inserted at small intervals to increase the whole shear strength, thereby reinforcing the original ground, such that the ground can be independently processed.

Despite that the ground is reinforced by the soil nail and the reinforcing soil nail has a remaining structural yield strength, the conventional method for building the underground retaining wall is embodied, under the assumption that all of loads such as the earth pressure and the water pressure are applied to the retaining wall, which is of course undesirable.

The present invention is directed to the method for designing and building the retaining wall by using the remaining structural yield strength of the soil nail, in case of adopting the soil nailing construction method. Upon construction, the ground(1) is excavated primarily and a primary shot-crete is installed on the perpendicularly excavated surface. Then, the shot-crete surface is punched, through which the soil nail(51) is inserted, on which a wire mesh reinforcing material is installed. And, a fixing plate (52) is inserted into the soil nail and a secondary shot-crete is installed on the wire mesh surface. Then, the ground(1) is excavated secondarily and it is returned to the first cycle.

FIG. 20 is an exemplary view illustrating the example where the soil nail and the retaining wall are assembled as a combined structure. On the end of the extension line of the soil nail(51) fixed on the shot(53) by means of the fixing plate(52), a fixing plate(52*a*) is additionally inserted, such that the soil nail can be synthesized with the retaining wall of the building. According to the computational result based on the synthesized structure, the vertical reinforcing bars(3*a* and 3*b*) and the horizontal reinforcing bars(4*a* and 4*b*) are arranged. By using the yield strength of the soil nail, the thickness of the retaining wall is substantially reduced, when compared with the conventional thickness thereof.

FIGS. 21 to 24 each show the structural concept for assembling the soil nail and the retaining wall as a combined structure. Referring to FIGS. 21 to 24, in case of adopting the soil nailing construction method, the method for designing the building retaining wall is as follows:

First, the support point of the soil nail supported on the retaining wall(2) by means of the fixing plate(51*a*) is determined.

If the support point of the soil nail is determined, the rigidity of the support point is replaced with an elastic support point and the modelling for the replaced elastic support point is carried out to extract two and three-dimensionally structural analyses (FIGS. 23 and 24). Based upon the structural analyses, an economical thickness of the retaining wall is determined and the arrangement of the reinforcing bars is designed in accordance with the positions where the positive and negative moments are generated and the sizes thereof.

FIG. 25 is an elevated view illustrating the arrangement of reinforcing bars in the case where the soil nail and the retaining wall are assembled as a combined structure. In the drawing, the inside and outside vertical reinforcing bars(3*a* and 3*b*) and the inside and outside horizontal reinforcing bars(4*a* and 4*b*) are designed like a conventional retaining wall, but the amount of reinforcing bar used is drastically reduced and the thickness of the retaining wall is substantially reduced. And, the synthesis of the retaining wall and the soil nailing wall is achieved by the shear stress of the soil nail.

FIGS. 26 to 28 are exemplary views illustrating a method for preventing the building from floating by using the combined structure of the temporary retaining wall and the retaining wall.

In case where the building is installed in the ground, an appropriate step for preventing the floating of the building from the ground caused due to the buoyance of underground water or other fluids should be taken. In a conventional practice, the weight of the building and the buoyance by the underground water level are calculated and if the buoyance is greater than the weight, the thickness of the underground base increases or a rock anchor is driven and pulls on the base, thereby removing the force corresponding to the difference between the buoyance and the weight. However, the above methods arise the problems that the installation cost is expensive and a long time of construction period is required.

The conventional calculation of the buoyance of the building disregards the fact that since the underground of the building is buried in earth, the friction force by earth is generated between the earth and the structure and functions as a reverse force to the buoyance. As a result, in the state where the space between the earth and the structure is considered as a skidding support point(71), as shown in FIG. 26, the design for the buoyance is made. If a means for reinforcing the friction force between the earth and the structure is provided, there will be no need to increase the thickness of the base mat or install the rock anchor. To this end, the present inventor has studied the method for reinforcing the friction force between the earth and the structure.

FIG. 27 shows the method for preventing the building from floating.

The floating preventing means used in the present invention is comprised of a friction means(73) and a fixing means(74) which is attached on the end of the building of the friction means(73). The friction means(73) is passed through the temporary retaining wall and is fixed on the ground(1) and the fixing means(74) is buried on the intermediate portion of the retaining wall(2) of the structure. The friction means(73) is used with a shape steel piece, a circle steel piece, a steel piece and so on and the fixing means(74) is used with a nut or steel plate screw-coupled or welding-coupled to the end of the friction means(73).

As the friction means, a stud bolt(72) can be installed on the H-section steel(21), for the purpose of exerting the friction force to the ground(1). The construction work for driven in the H-section steel on which the stud bolt is installed in the ground is difficult, but it can be applied in the environment where the floating force is relatively small or the construction obstacles do not almost exist.

A method for preventing the floating of the structure with the elevation of the friction force is as follows:

If the weight of the building is larger than the floating force by the water pressure, as a conventional buoyancy design method, there is no need to reinforce the friction force. However, if the weight of the building is smaller than the buoyancy, the length of the friction means for strengthening the friction force between the H-section steel and the side of the underground retaining wall and the number of the friction means required are determined under a shear friction design method. Also, the friction force between the side of the underground retaining wall and the ground to the earth pressure is calculated to obtain the friction force resistant to the water pressure, which is utilized as the friction force ensured by a shear friction means designed under the shear friction design method and at the same time the friction force resistant to the water pressure. The number of the shear friction means is determined by dividing the size of the friction force required into the size of the friction force per a single shear friction means. Next, the length of the shear friction means to be fixed on the retaining wall and the fixing plate are designed.

Referring to FIG. 28, a method for installing the friction means on the underground retaining wall will be discussed.

To install the friction means calculated and determined in the above design, a predetermined hole is punched on the temporary retaining wall (the earth plate, SCW, CIP, etc.), through which a predetermined length of the friction means is inserted, and the fixing plate is installed on the end of the friction means toward the retaining wall. For the purpose of ensuring the friction force, if necessary, grouting is carried out, thereby removing the porosity between the friction means and the ground. Next, the reinforcing bars are arranged on the retaining wall and a form is disposed to thereby install the concrete of the retaining wall.

If the resistance to the buoyance of the building is heightened by using such the friction force, therefore, there is no need to install the rock anchor additionally, such that the construction cost can be reduced and the difficulty of the water-proof process caused due to the construction of the rock anchor can be removed. In addition, there is no need to make the base mat essentially thick, such that the material and personnel expenses can be reduced and the construction period can be shortened.

The method for installing the friction means on the underground retaining wall is applied in the combined structure of the temporary retaining wall and the retaining wall, but can be easily applied in the conventional structure. In more detail, when the sheeting of the retaining wall is disposed, a sleeve where the friction means is to be installed is first installed and after the concrete is inserted and cured, the form is removed. Then, the friction means is passed protrudedly through the sleeve toward the temporary retaining wall, and the porosity between the sleeve and the friction means is grouted with an epoxy resin, thereby integrating the friction means with the structure. Next, only if the back side of the retaining wall is re-filled, the friction means is buried in the ground, thereby serving as the resisting means to the buoyance. On the other hand, in the case where the friction means is pre-installed and the re-filling work is thus difficult, the re-filling is firstly completed and the friction means is then installed.

FIGS. 29 to 38 are exemplary views by steps illustrating the method for utilizing the steel structure used in the real construction as a strut for the earth construction.

Figure 1:
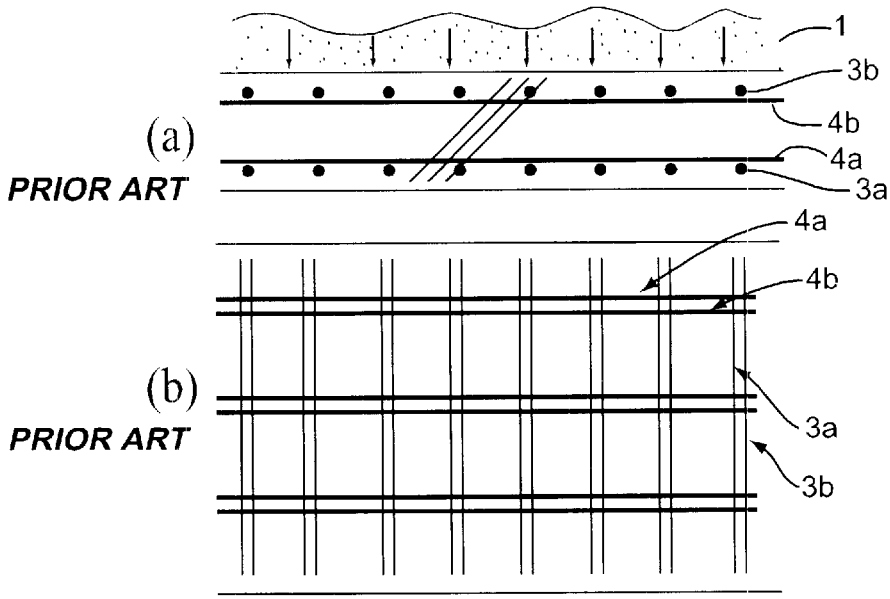
Figure 2:
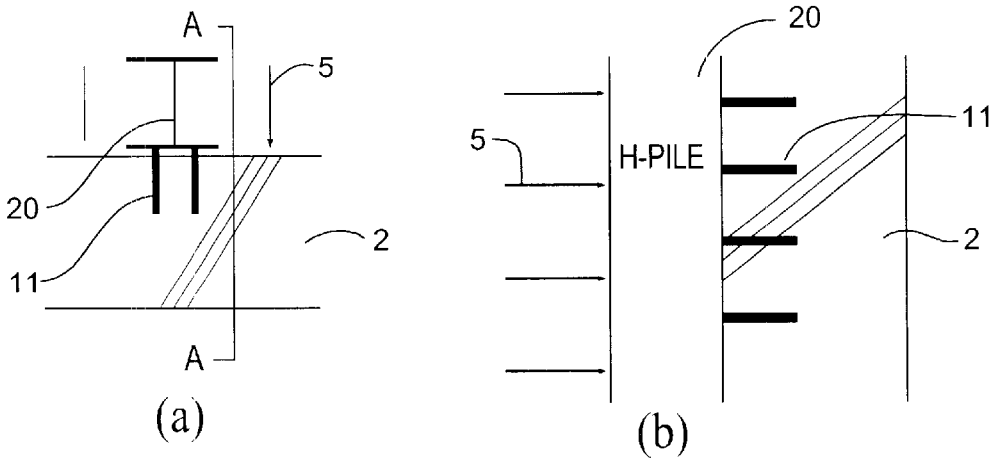
Figure 3:
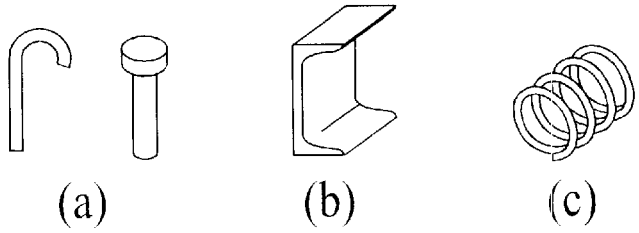
Figure 4:
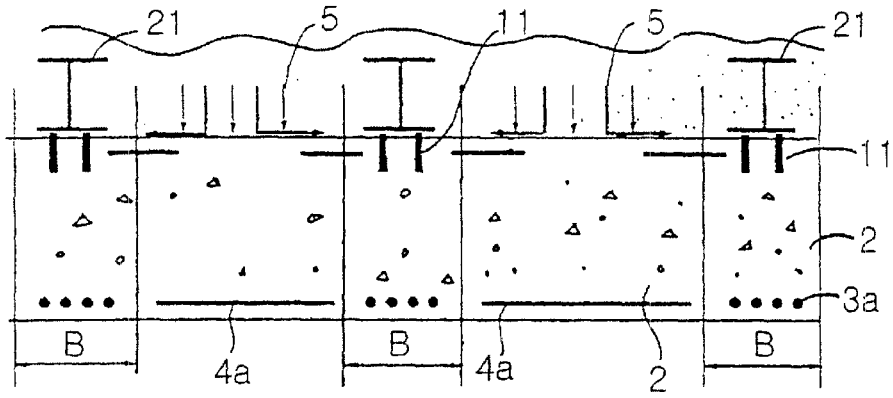
Figure 5:
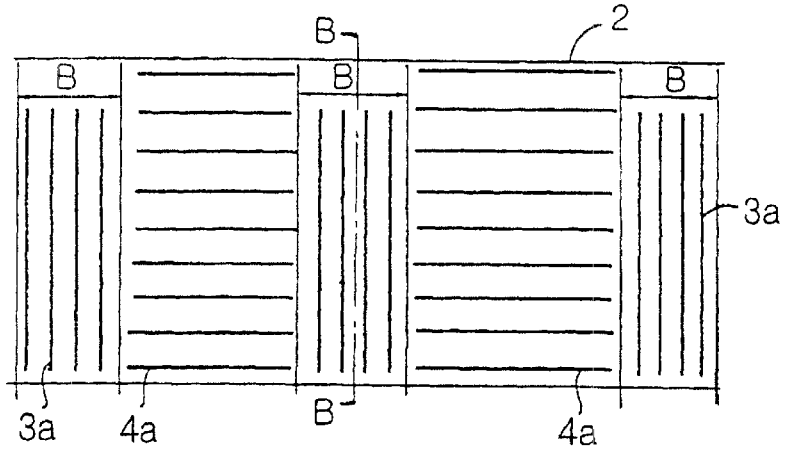
Figure 6:
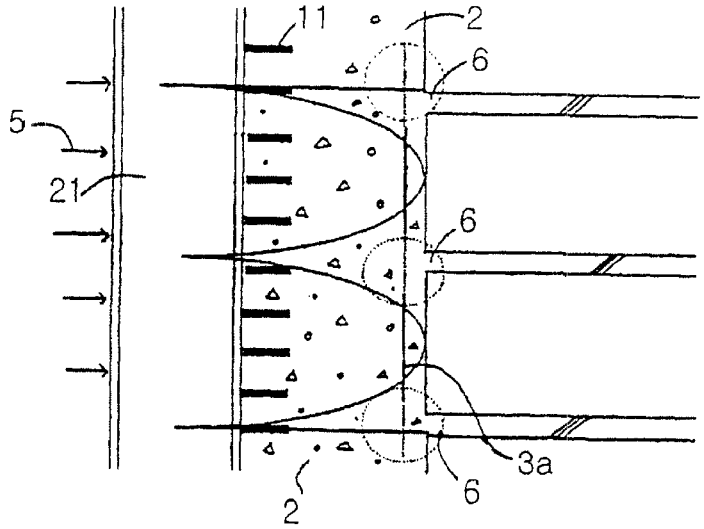
Figure 7A:
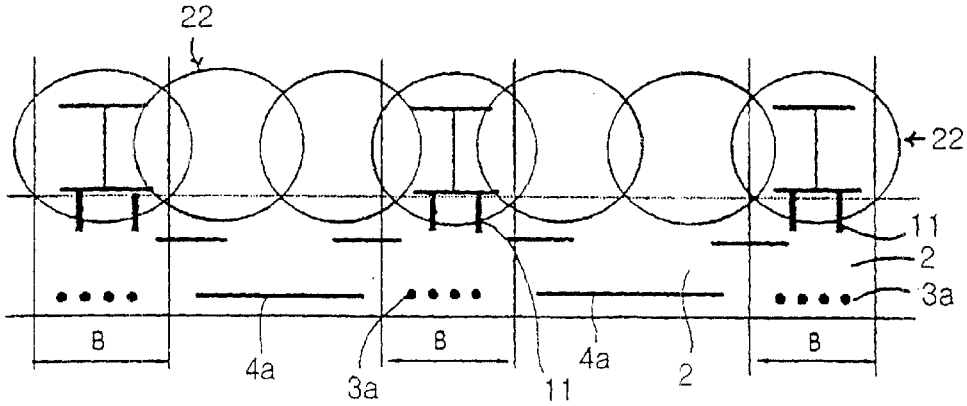
Figure 7B:
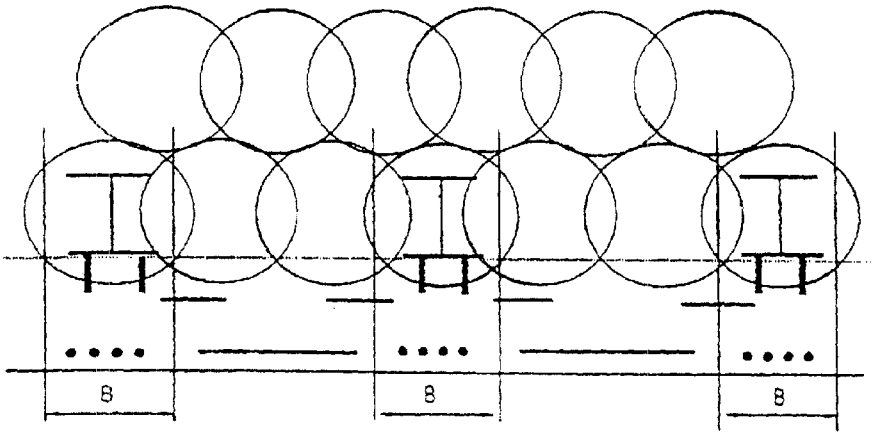
Figure 7C:
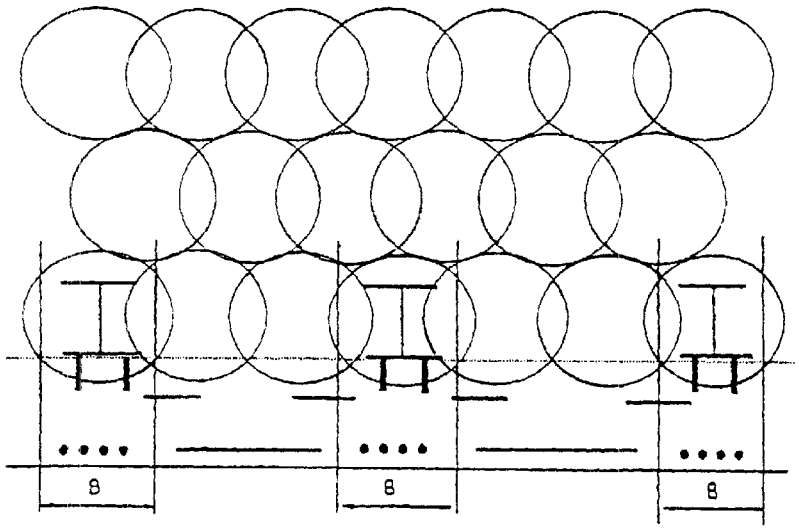
Figure 8A:
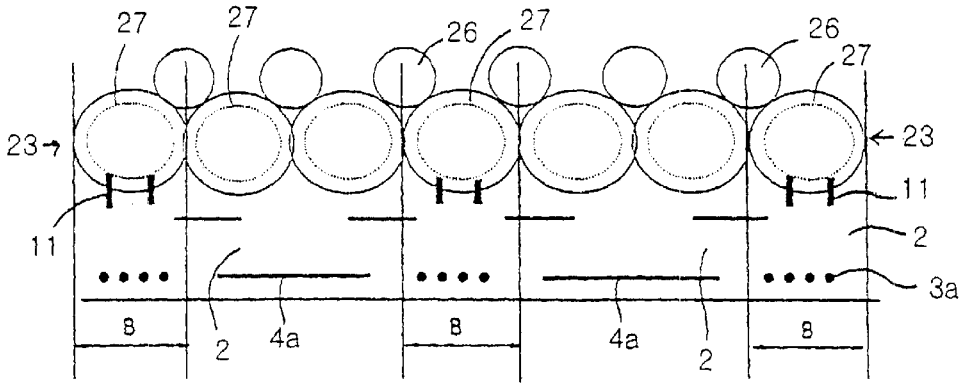
Figure 8B:
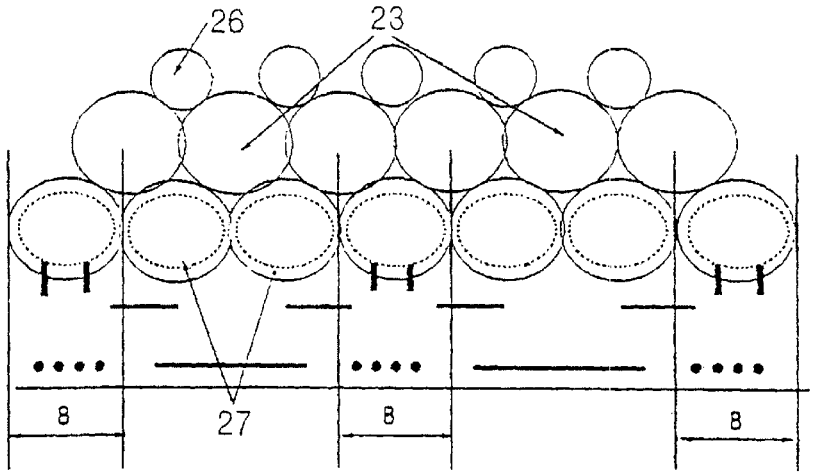
Figure 8C:
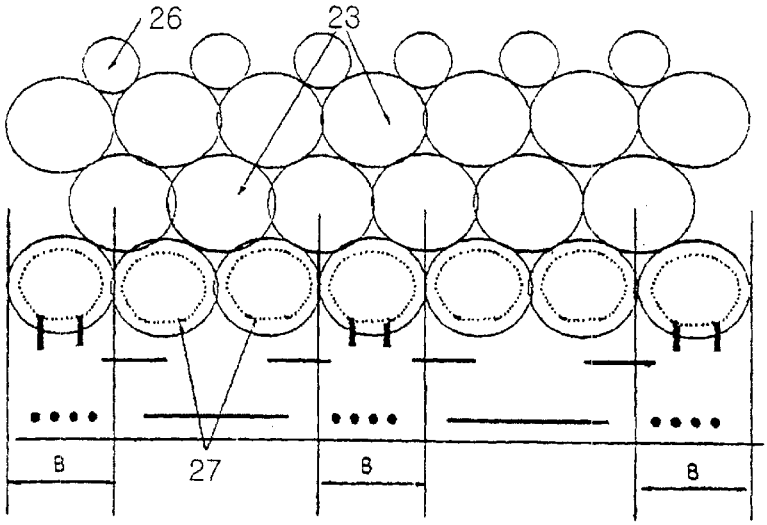
Figure 9A:
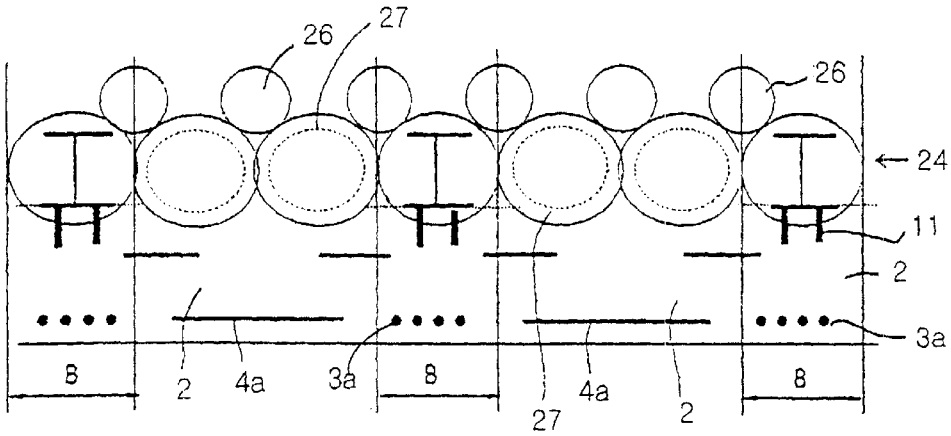
Figure 9B:
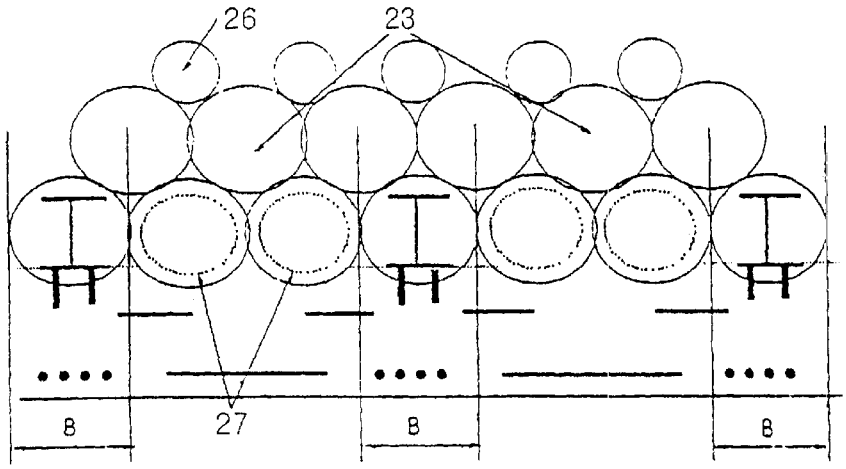
Figure 9C:
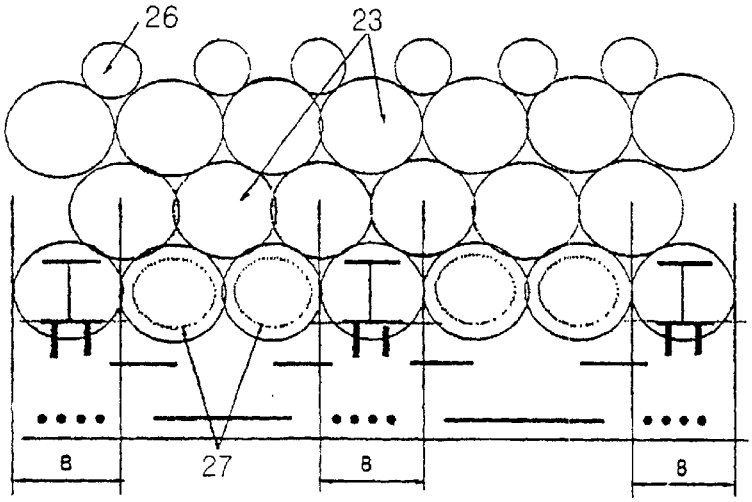
Figure 10A:
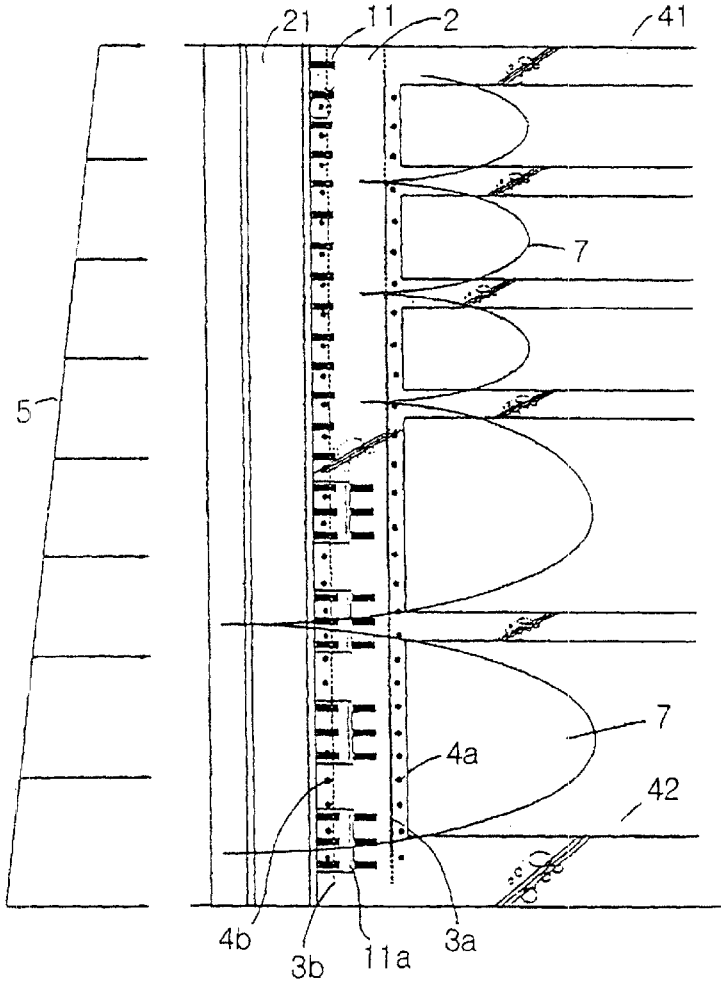
Figure 10B:
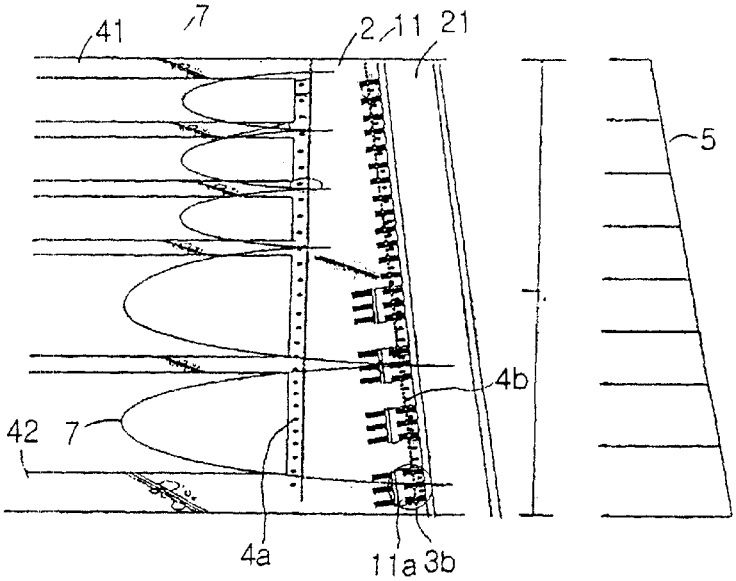
Figure 11:
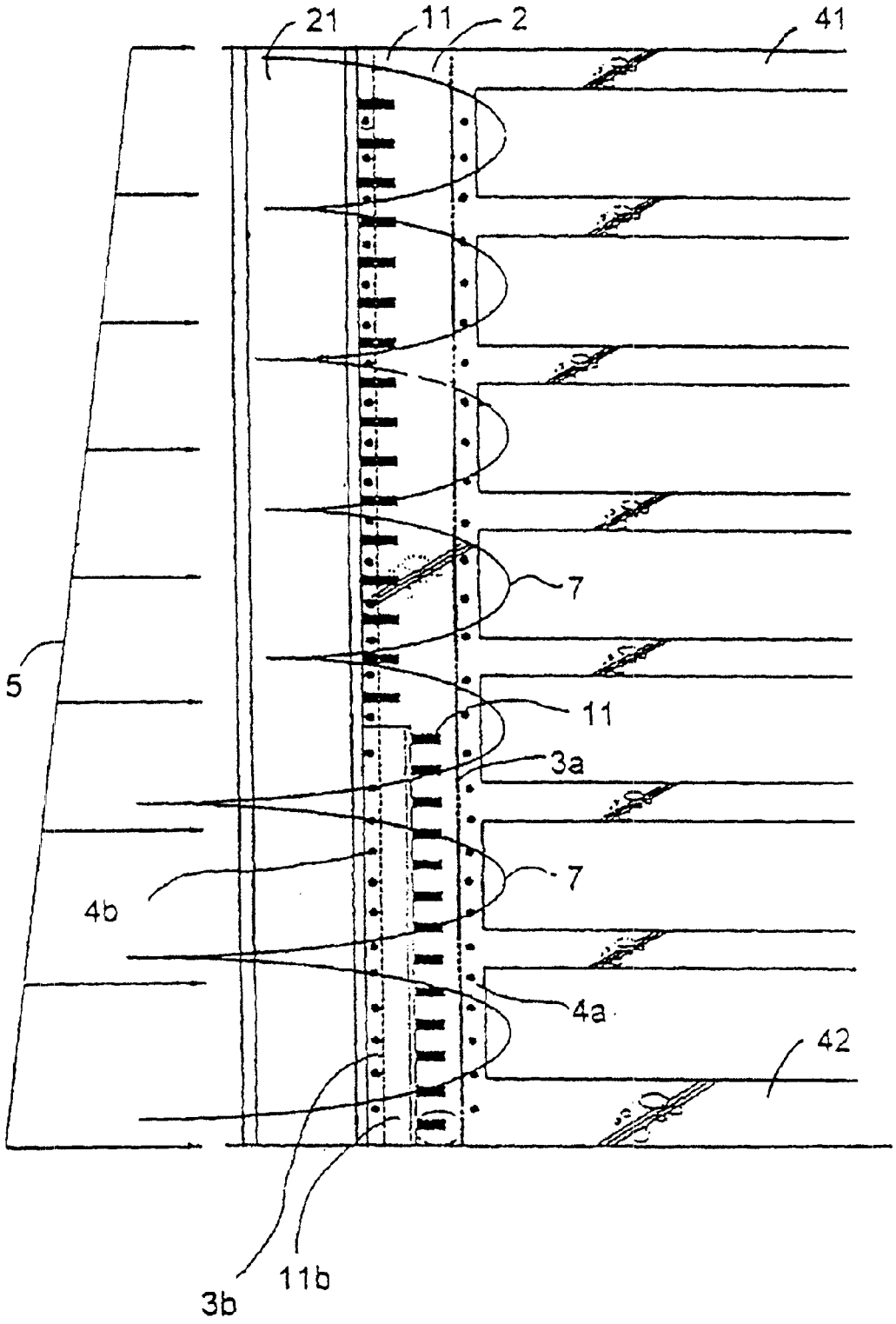
Figure 12A:
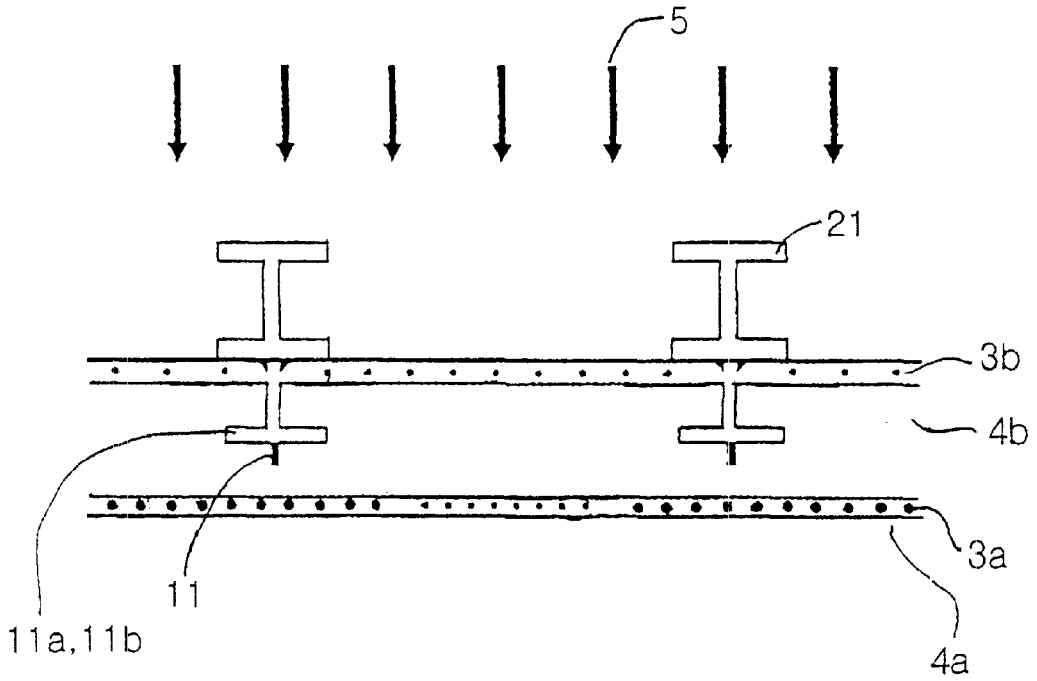
Figure 12B:
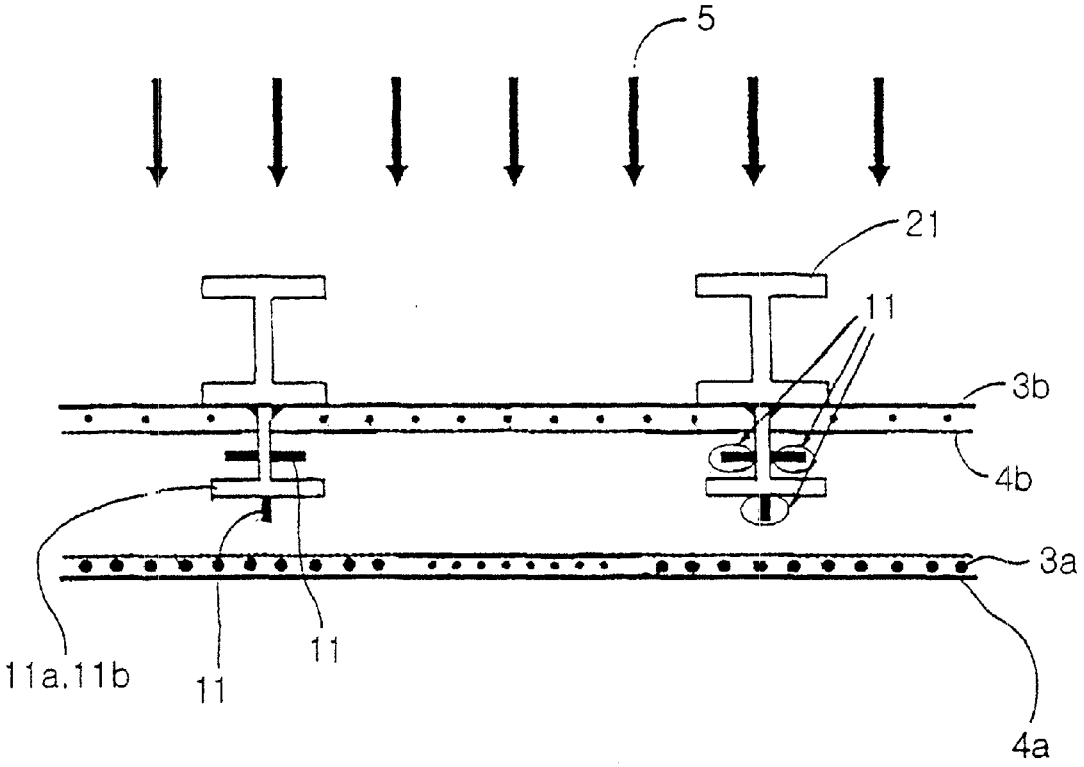
Figure 12C:
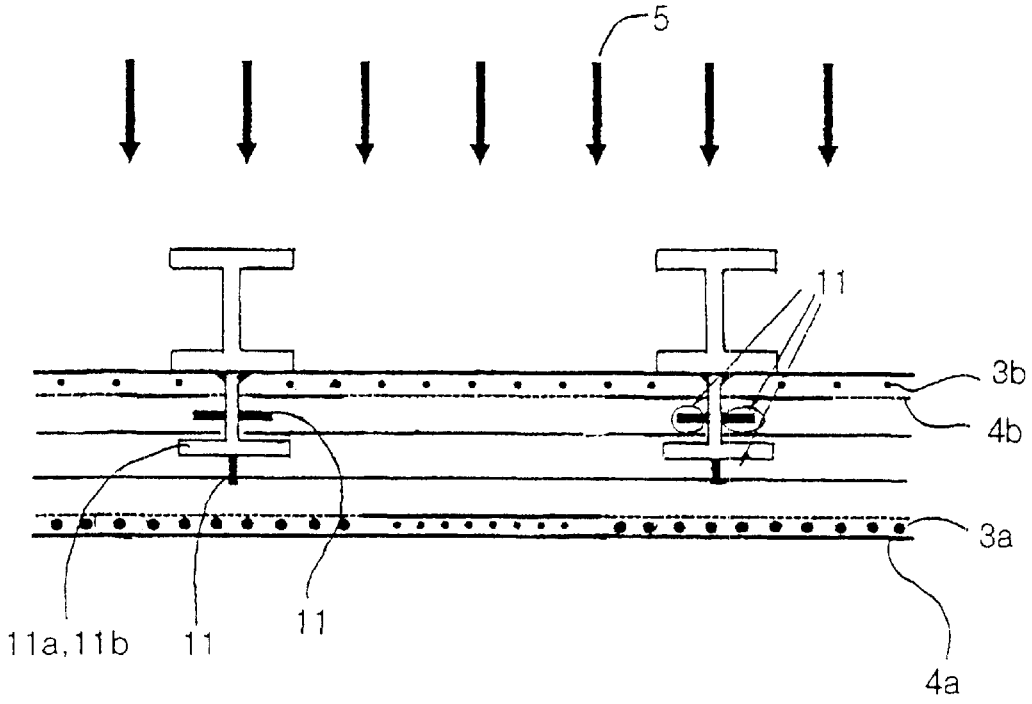
Figure 13:
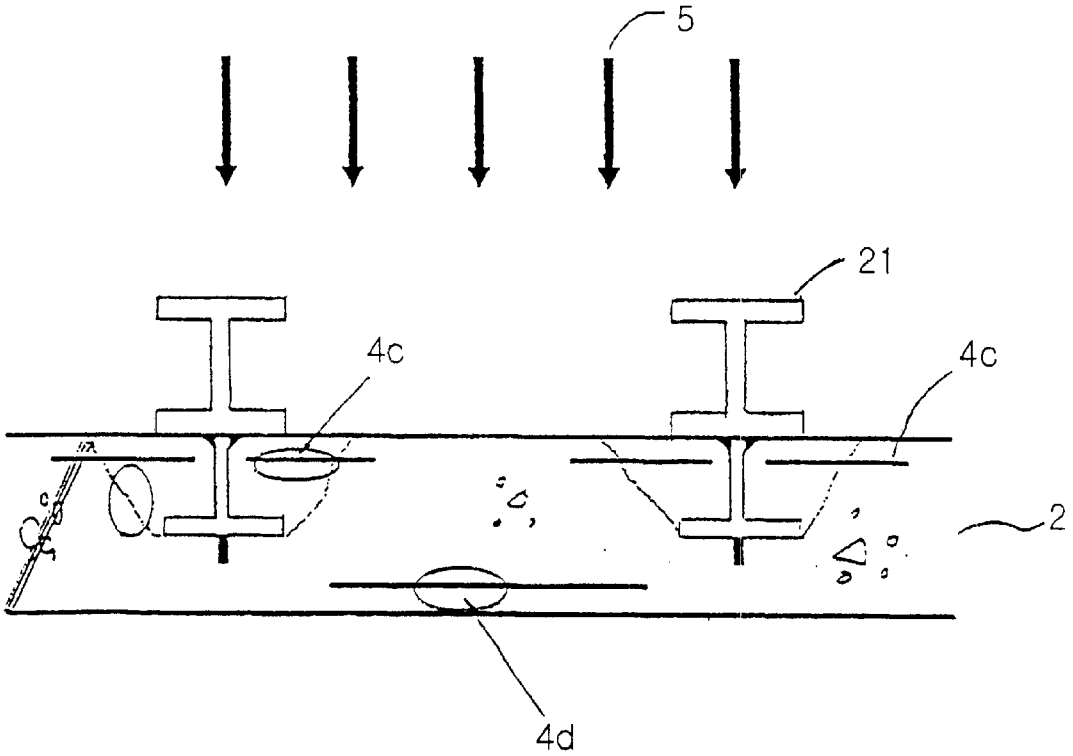
Figure 14:
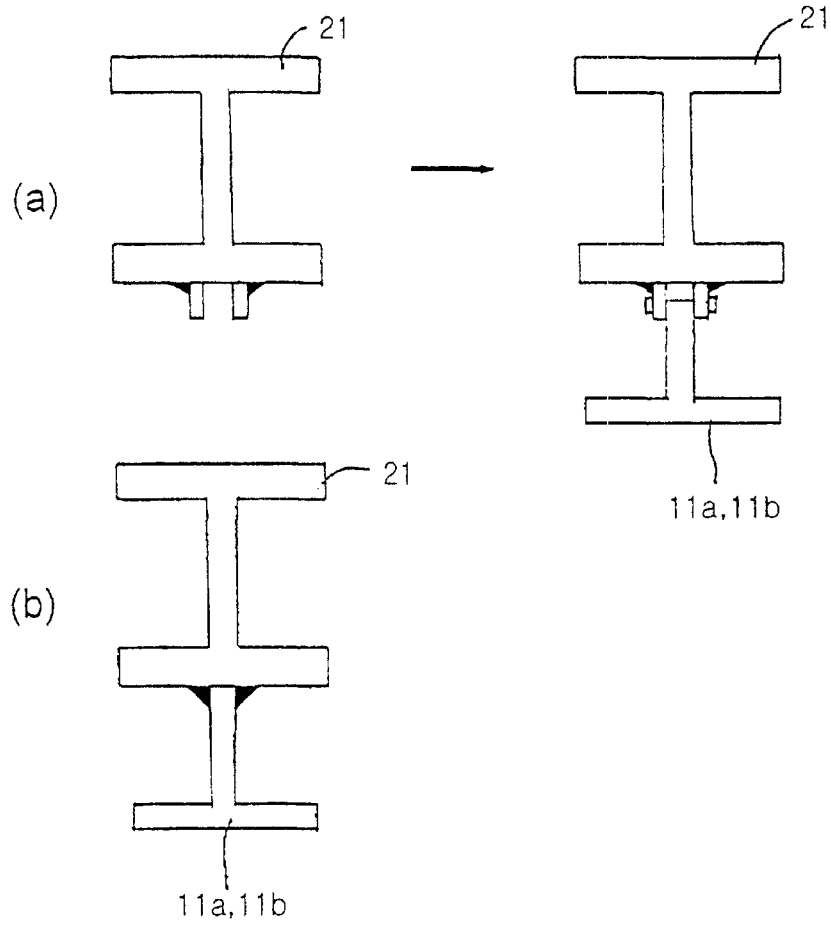
Figure 15:
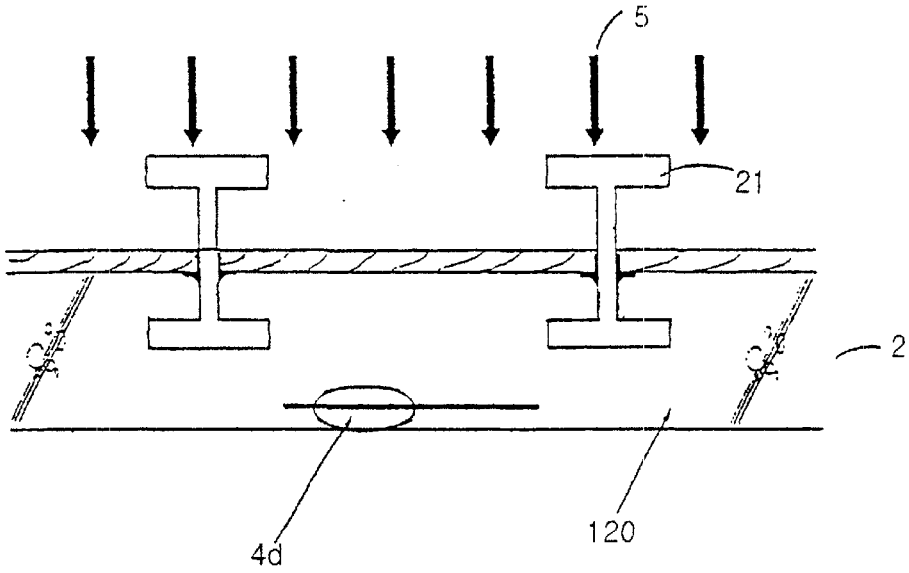
Figure 16:
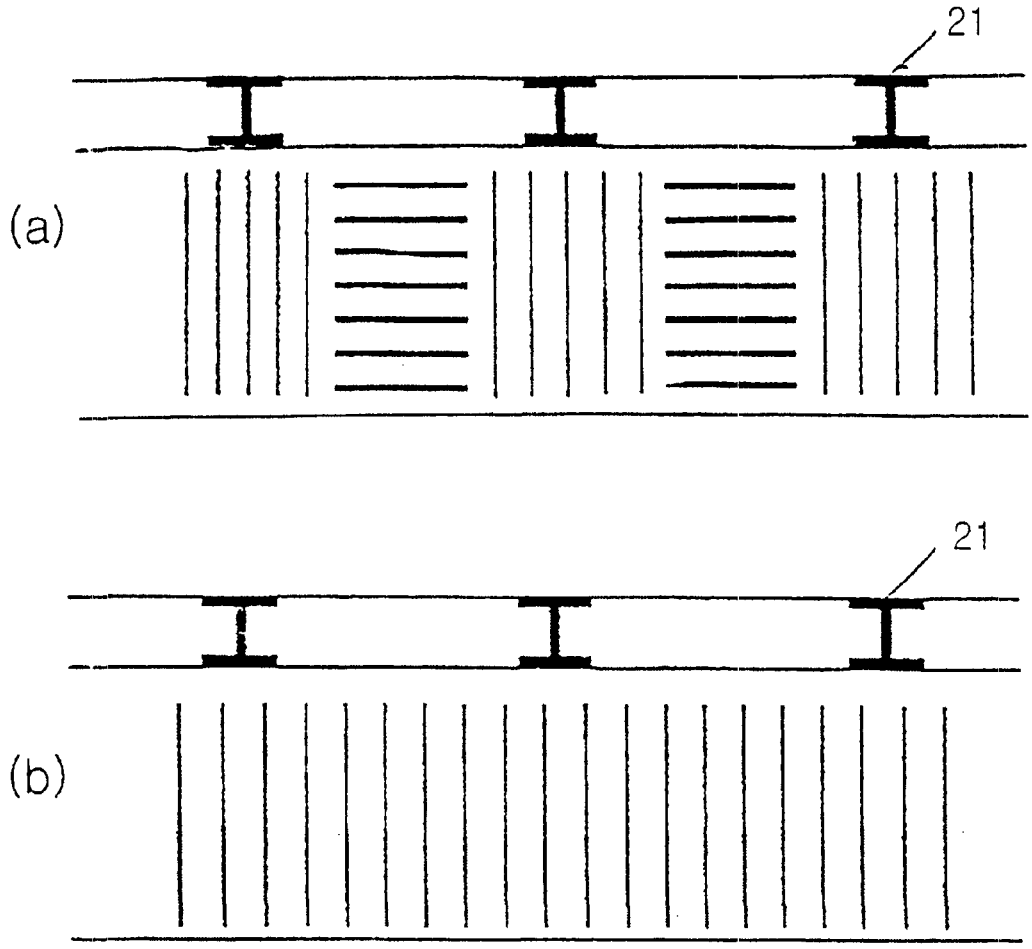
Figure 17:
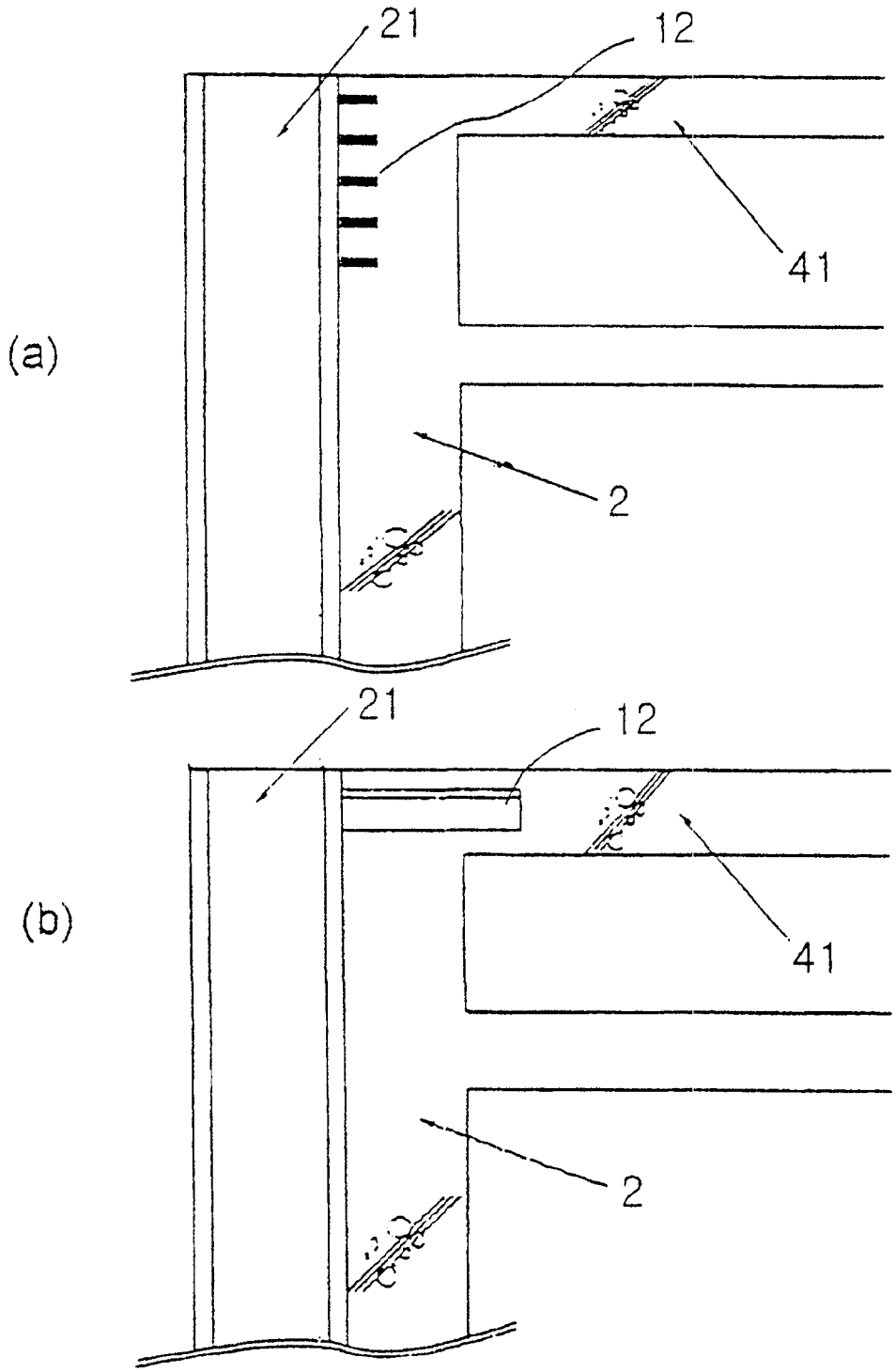
Figure 18:
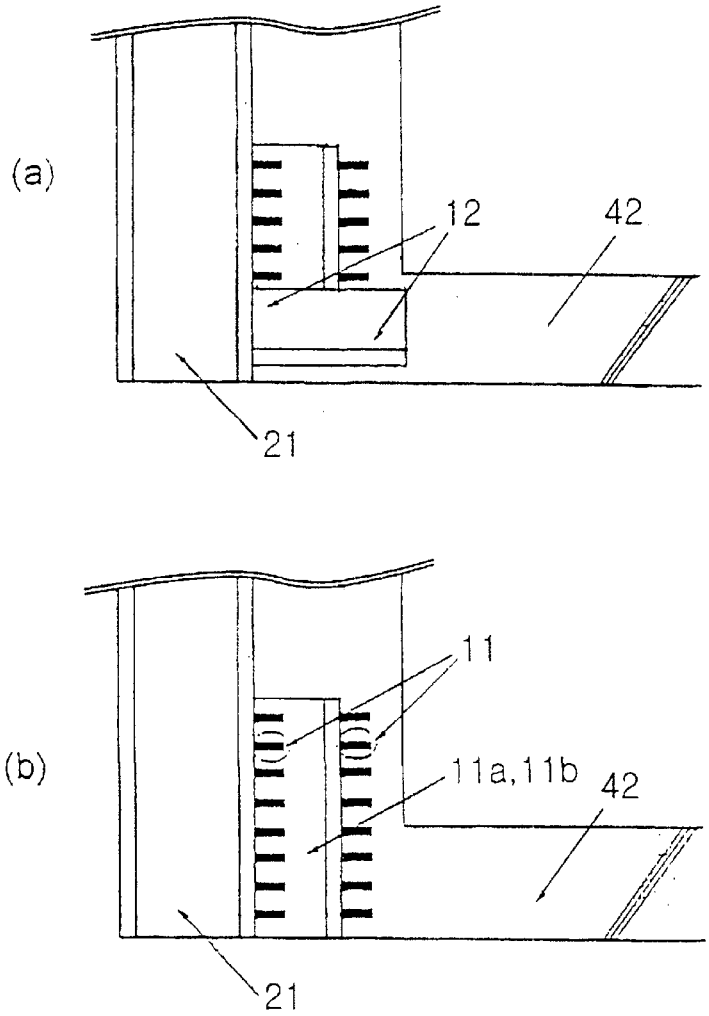
Figure 19:
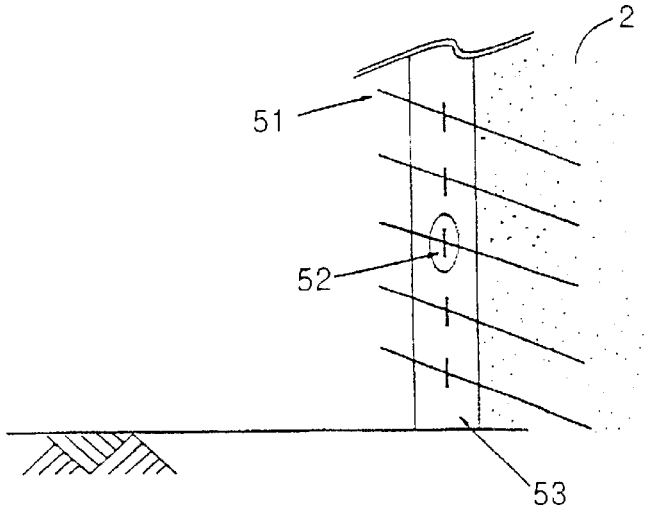
Figure 20:
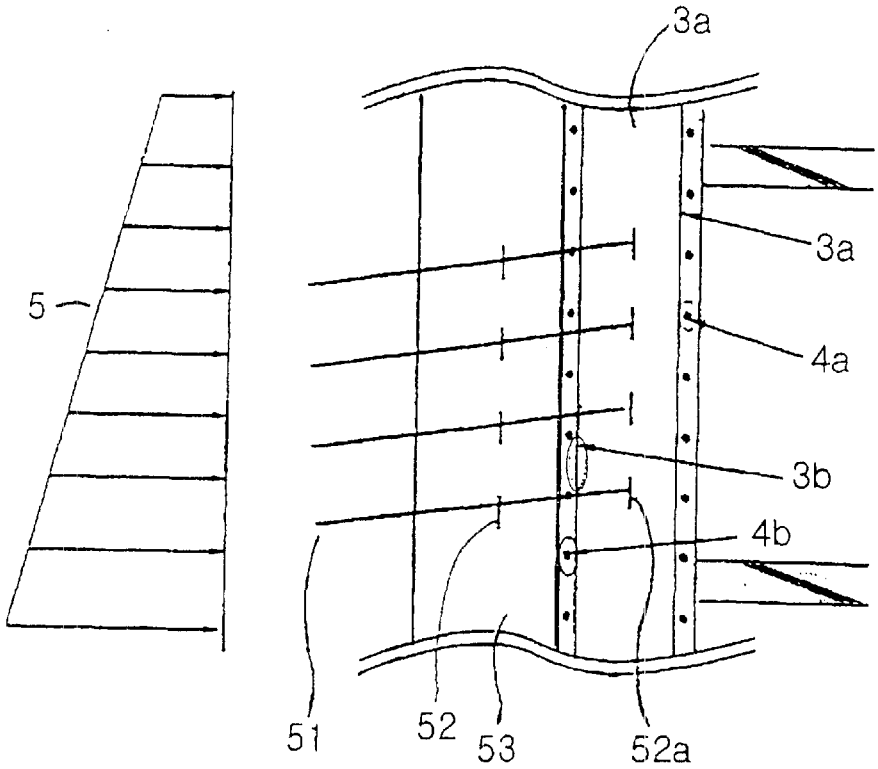
Figure 21:
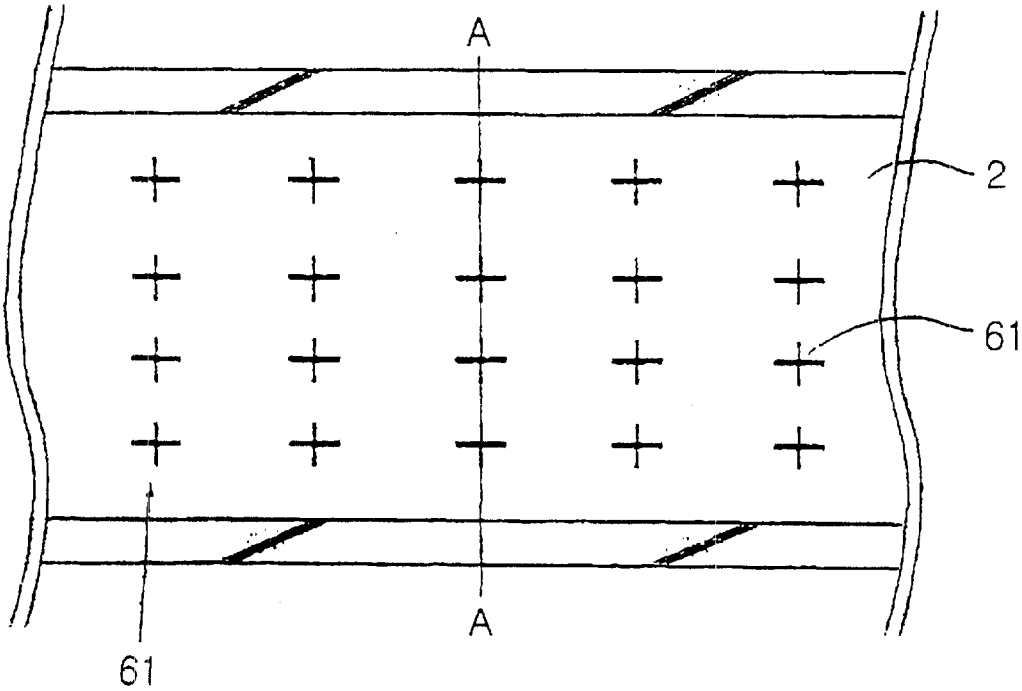
Figure 22:
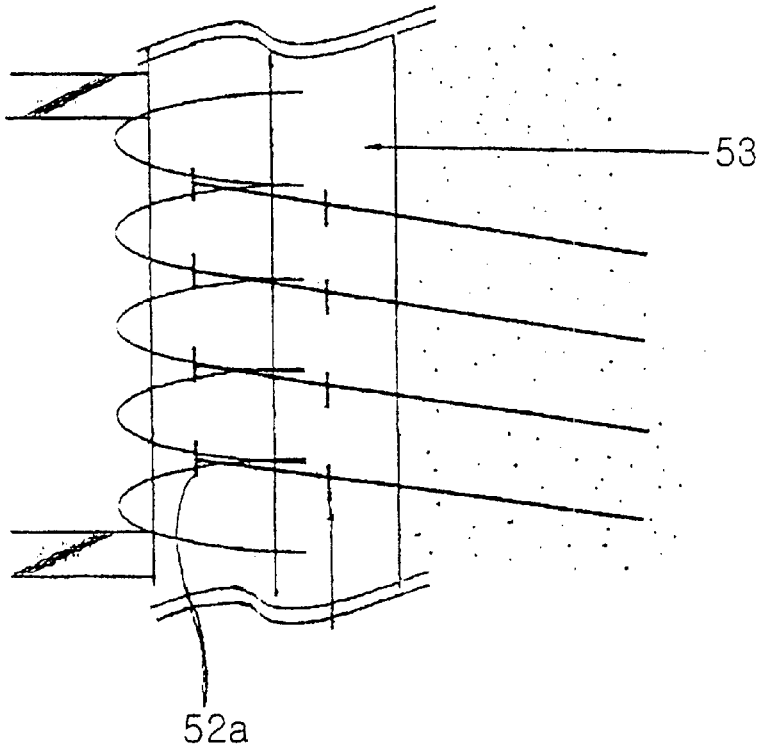
Figure 23:
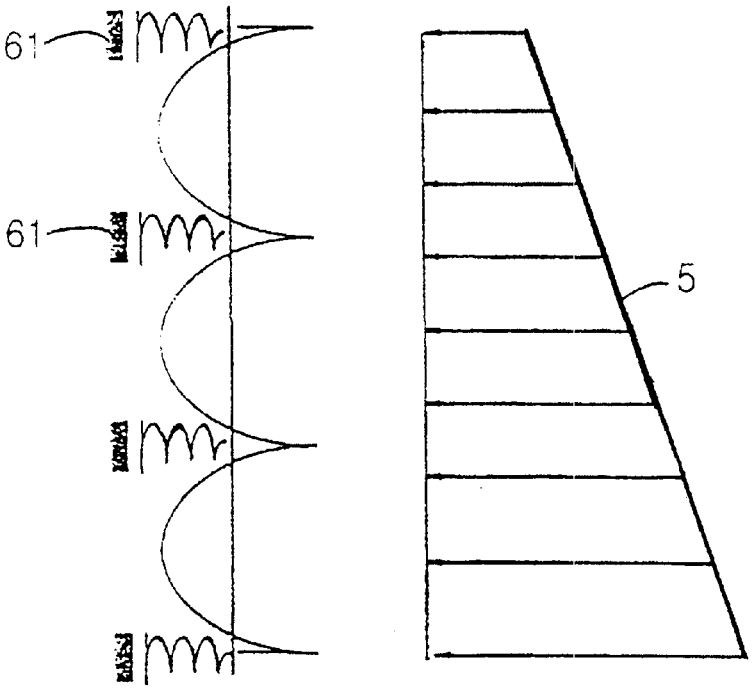
Figure 24:
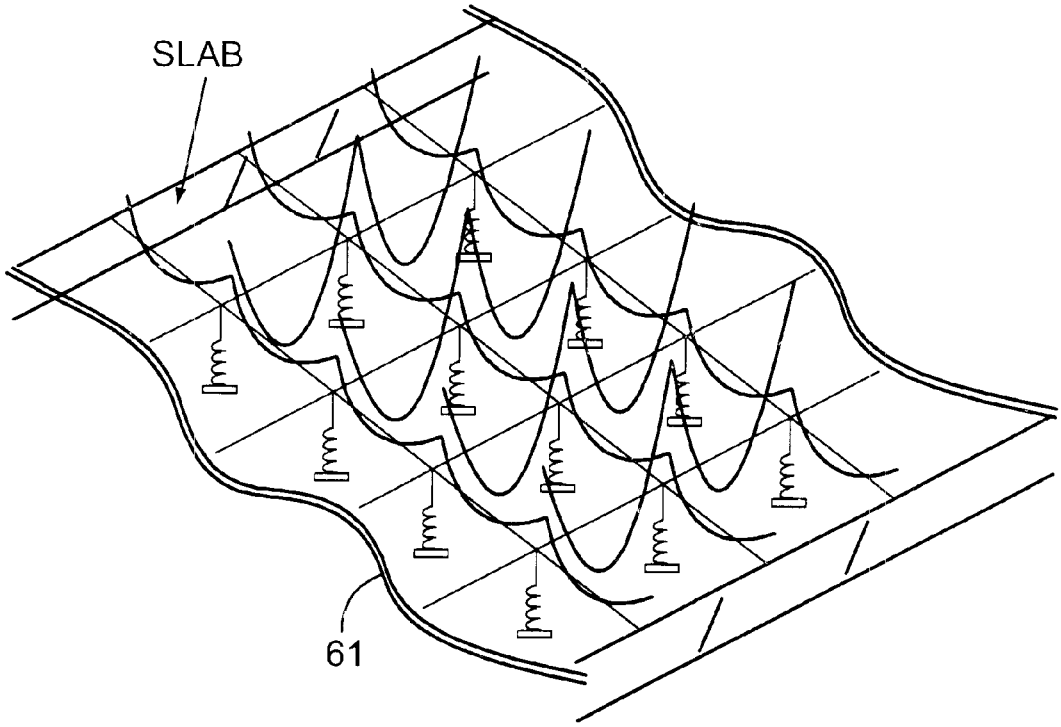
Figure 26:
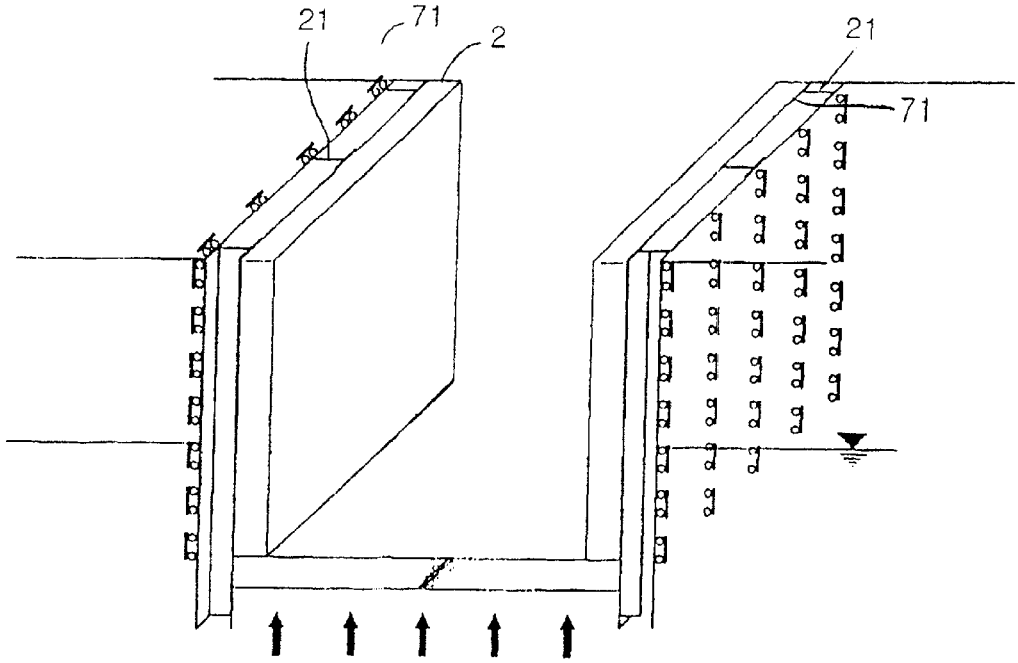
Figure 27:
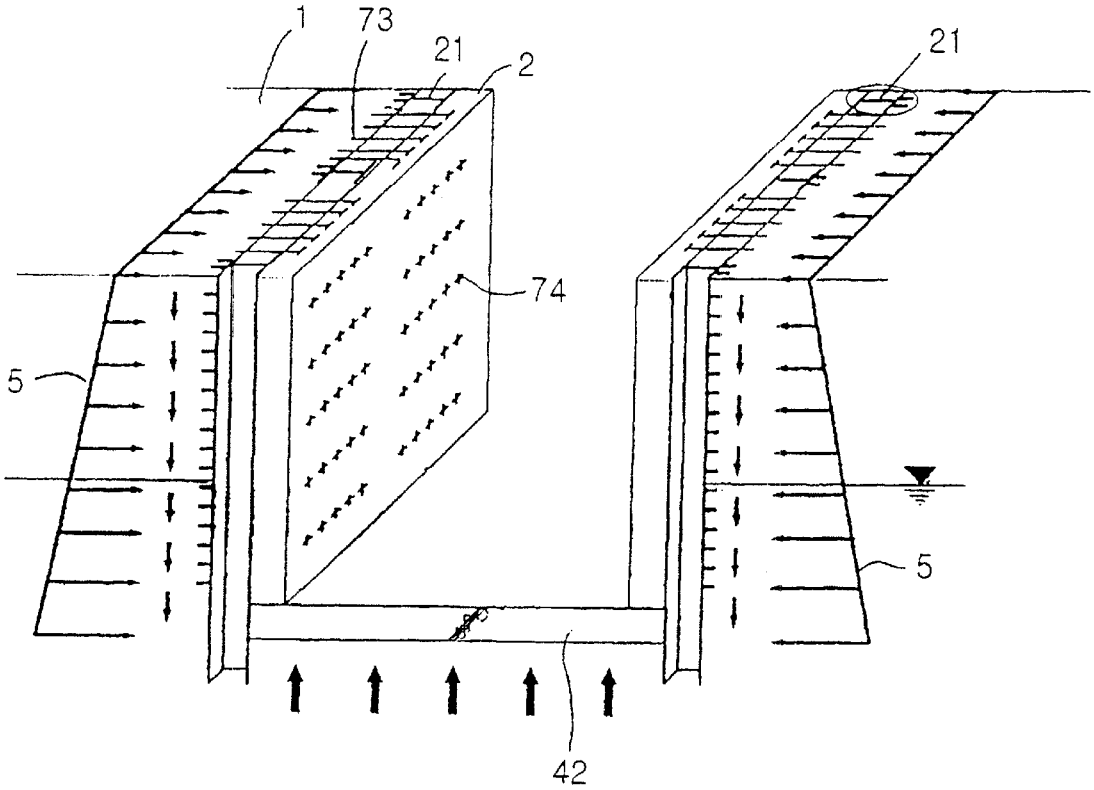
Figure 28:
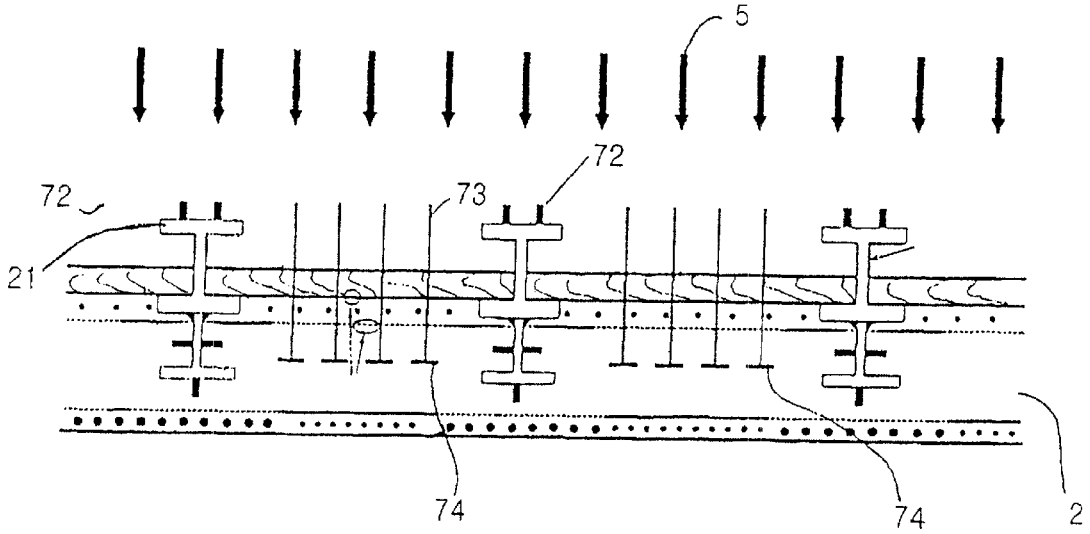
Figure 29:
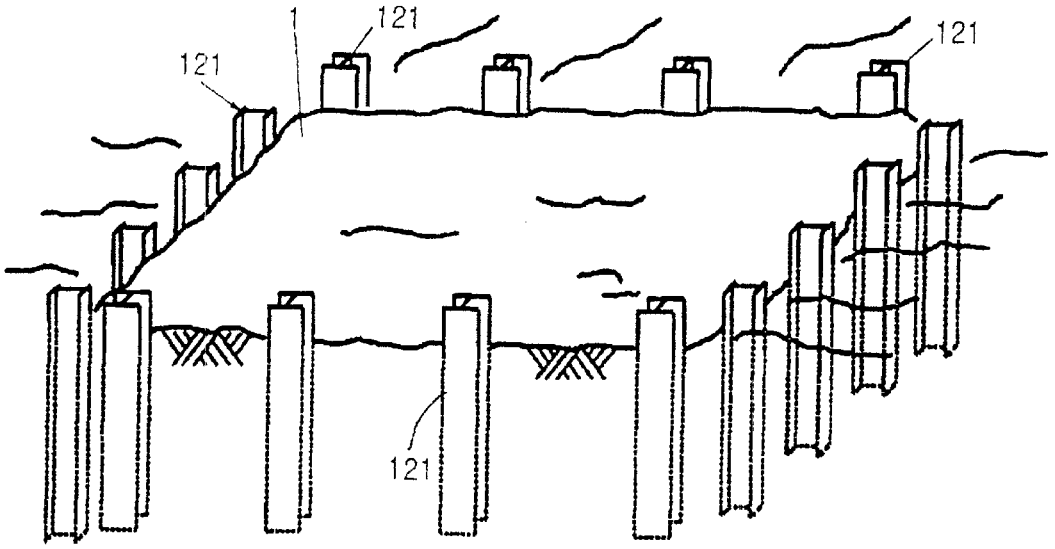
FIGS. 29 to 44 are detailed exemplary views illustrating a method for utilizing a steel structure used in a real construction as a strut for earth construction.

As shown in FIG. 29, the H-section steel is driven on the boundary line where the building is installed. Conventionally, the H-section steel is used as a thumb pile and an earth plate is inserted between the H-section steel piles, thereby installing the temporary retaining wall for preventing the falling of earth and receiving the appliance of the earth pressure. Next, the earth in the inside of the temporary retaining wall is excavated to thereby construct the building. At this time, the H-section steel is typically spaced apart from the underground outside wall of the building, for the purpose of occupying the working space. In the method as discussed in FIGS. 1*a* to 28, the rigidity of the temporary retaining wall possesses is utilized as the permanent structure. Therefore, there is no need to excavate a large area of the ground in order to ensure the working space and as a result, the amount of earth used for re-filling can be reduced. In the preferred embodiment of the present invention, it is desirable that the H-section steel is driven in to be placed on the boundary line of the building. In case of a weak ground, the H-section steel is directly inserted, but generally, it is inserted after the punching by means of drilling equipments such as an auger. Then, the H-section steel(121) is integrated with the concrete retaining wall (122), thereby forming the underground retaining wall(120).

In this case, the underground retaining wall(120) may be used that is constructed in another method such as a slurry wall.

Figure 30:
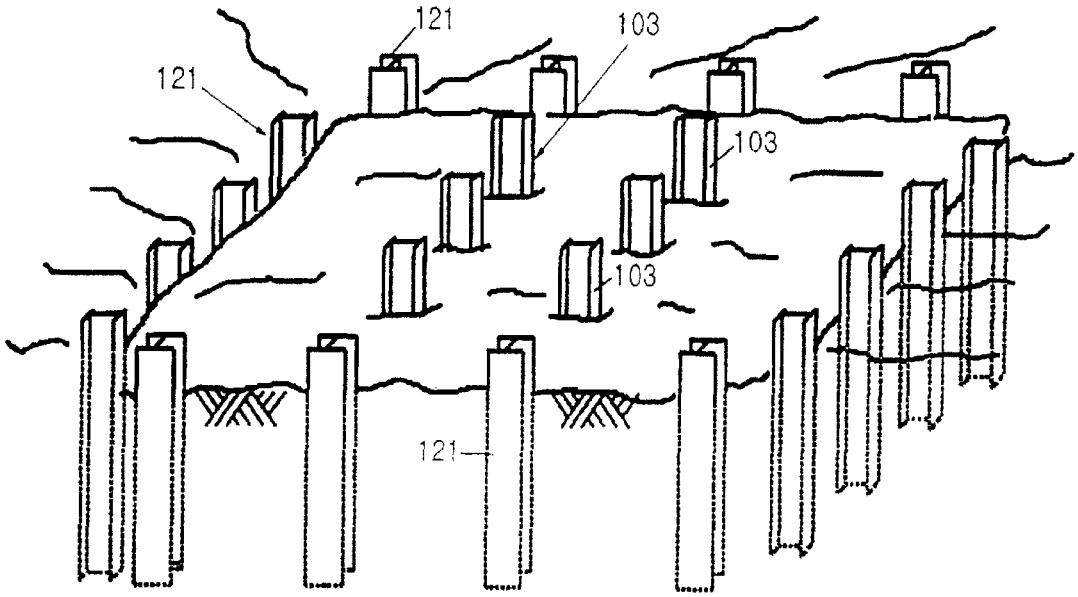

FIG. 30 shows the step of driving in the center pile(103) on the position where the pillar of the building is built. In the conventional temporary strut construction method, if the buckling length of the strut is long, since the resistance performance to the load is drastically deteriorated, a support point is formed on the intermediate portion of the strut, thereby reducing the buckling length thereof. Therefore, after the permanent structure is completely built, the center pile should be removed. However, in the preferred embodiment of the present invention, the center pile serves as a supporter to the earth pressure during the earth construction and at the same time a pillar of the structure. Therefore, since the center pile(103) is not removed, the present invention can reduce a larger amount of work required for the removal of the center piles, when compared with the conventional method.

Figure 31:
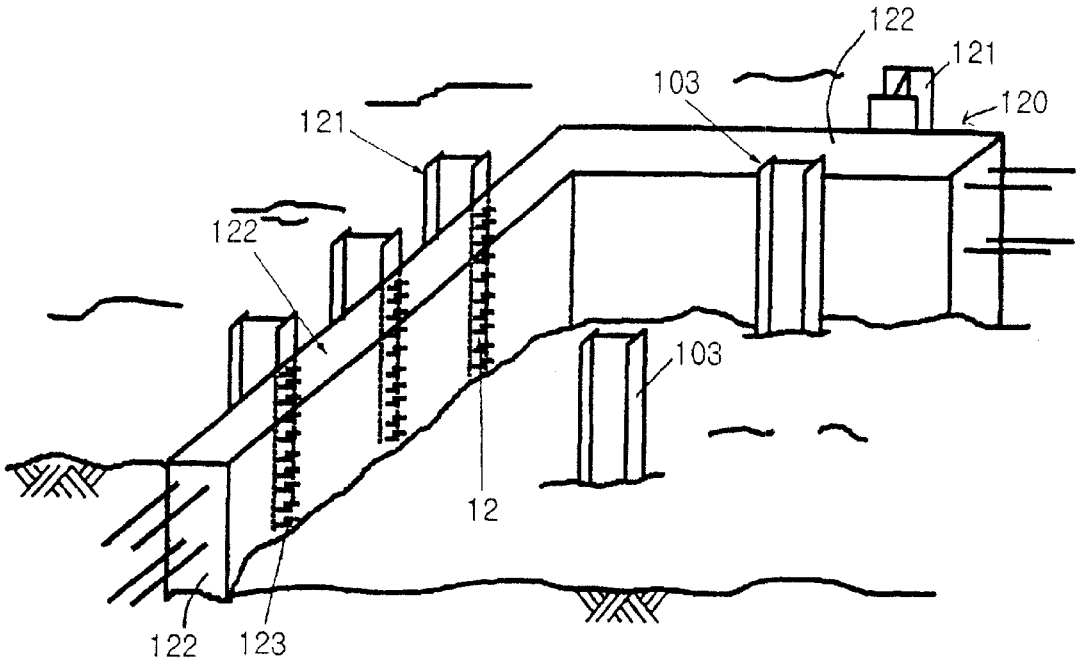

FIG. 31 shows the step of constructing the underground retaining wall(120) used as the permanent structure, after the primary excavating work. The underground retaining wall (120) is formed, by installing the anchored shear connecting means(123) on the H-section steel(121) and forming the concrete retaining wall(122), as integrated with the H-section steel.

Figure 32:
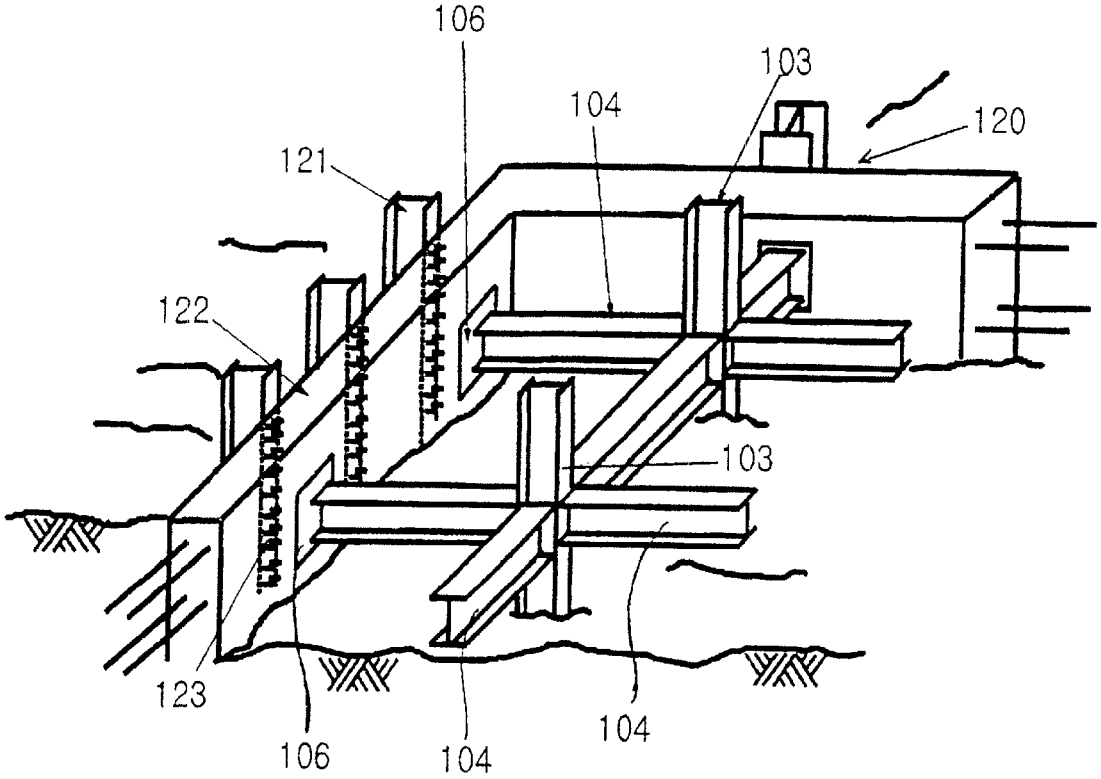

FIG. 32 shows the step of constructing a steel girder as the strut, after the completion of the work of FIG. 31. The steel girder(104) is assembled to the center pile(103) and installed on the underground retaining wall(120), thereby serving as the strut during the construction and a part of the permanent structure after the construction. The connection of the girder (104) with the underground retaining wall(120) is made by means of an embedded plate(106). A jack is used in order for the girder to act as the strut during the construction, an explanation of which will be discussed hereinafter.

The connection of the girder(104) with the center pile (103) is followed by a general steel construction method. In more detail, the connection method is determined in accordance with the kind of the steel used as the center pile, for example, an H-section steel, a circular steel, a box type pillar and the like and in accordance with the adjoining pattern of the girder to the center pile, for example, the flange or web of the H-section steel adjoining to the girder, in case of the center pile of the H-section steel.

Figure 33:
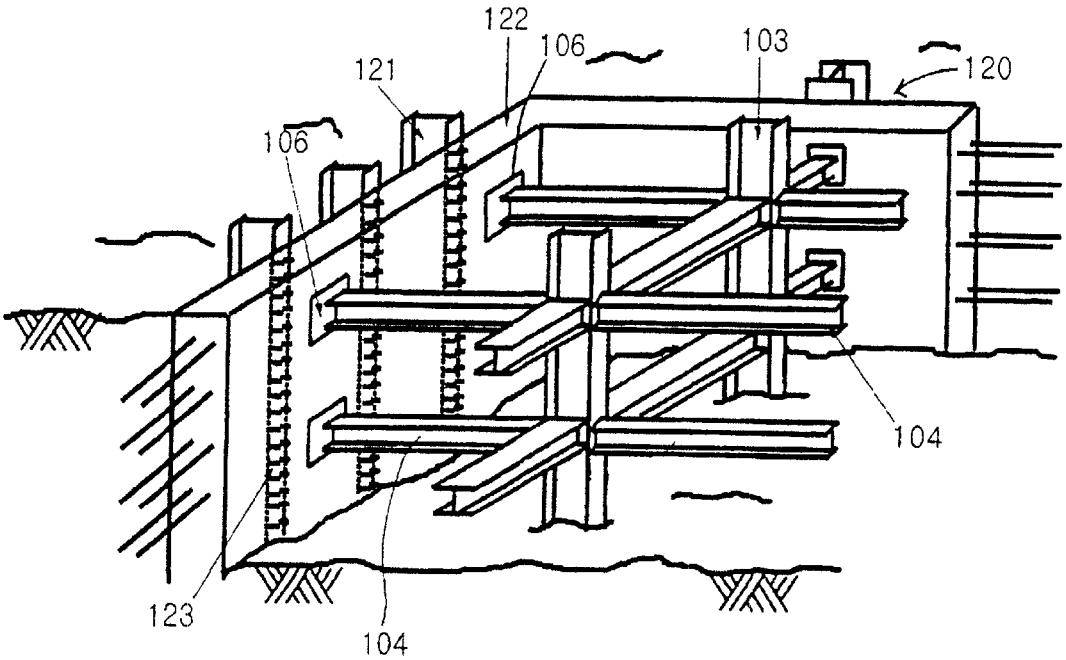

FIG. 33 shows the secondary excavating, secondary underground retaining wall installation, and secondary girder installation, after the primary excavating and underground retaining wall installation. Based upon that after the primary excavating, the underground retaining wall and the girder are all installed at the primary step to thereby endure the earth pressure and the load, the secondary work can be carried out.

Figure 34:
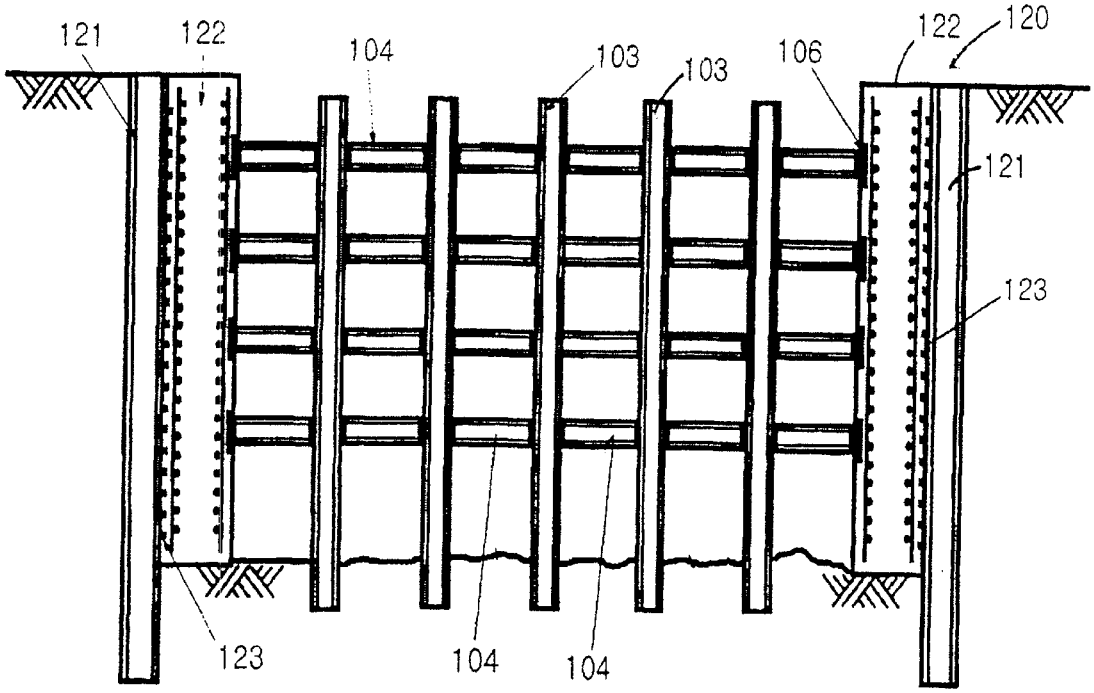

FIG. 34 shows the state where after the repetition of the steps of FIGS. 31 and 32 the excavating up to the lowermost portion of the ground is completed. While the girder(104) acting as the strut on the upper portion and the center pile(103) hold the load applied to the underground retaining wall(120), the excavating to the ground is carried out.

Figure 35:
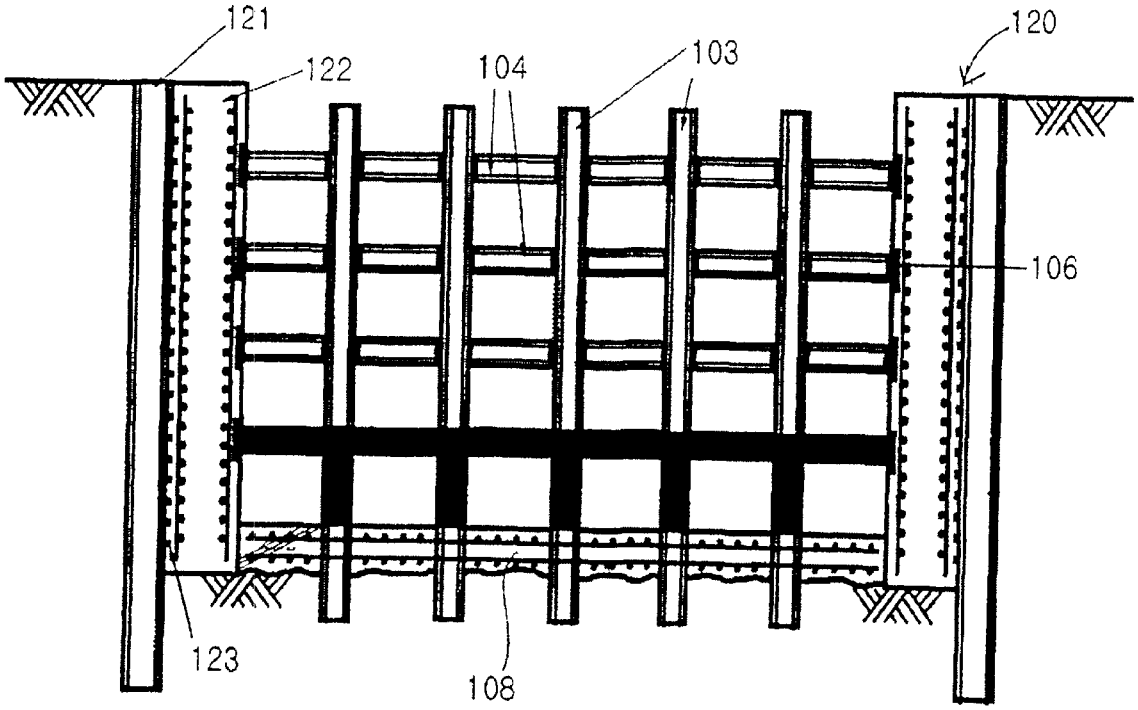

FIG. 35 shows the step of constructing the base(108) on the lowermost portion after the completion of excavating.

Figure 36:
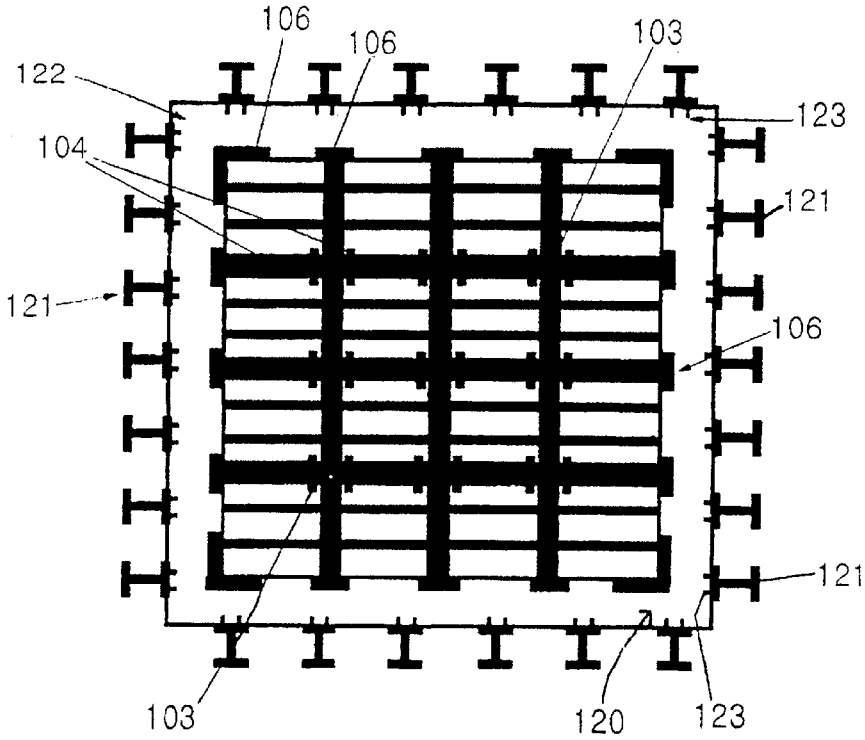
Figure 37:
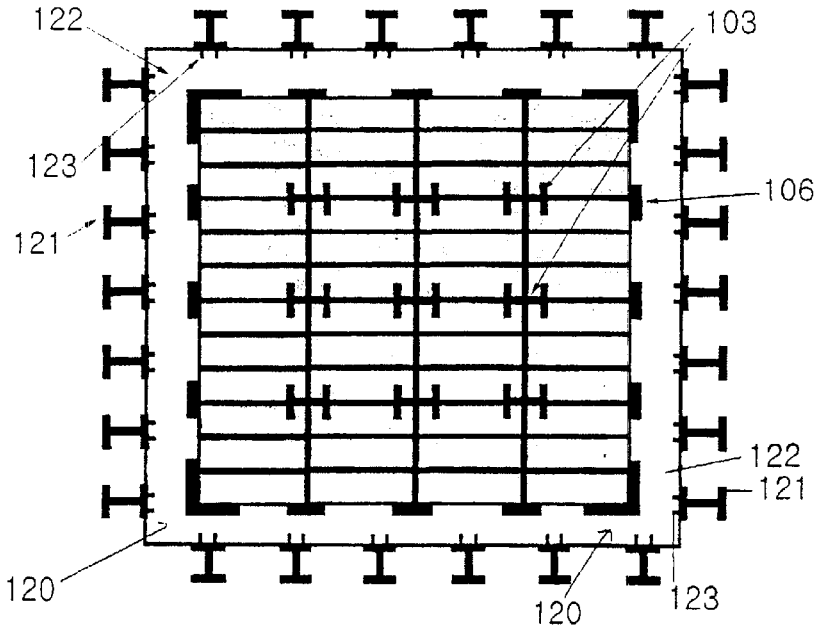

FIGS. 36 and 37 show the states where the construction is made up to the lowermost story girder and slab. The center pile(103), the girder(104) and the underground retaining wall(120) are assembled, thereby enduring the load applied thereto during the retaining. If the excavating work is completed, detail construction starts. Of course, the contents of the detail construction are varied in accordance with the kinds of the details. The detail structure is divided into a steel structure (S structure) and a steel reinforcing bar concrete structure (SRC structure). The detail structure is composed of the pillar, girder, beam, and slab. In case of the S structure, the pillar, girder and beam are coated with a fire-resisting material, and the slab is installed by a conventional construction method such as a cast-in-place concrete method, a PC plate concrete casting method, or concrete casting over a deck plate. In case of the SRC structure, a sheeting is installed around the pillar, girder and beam, on which the concrete is cast.

Figure 38:
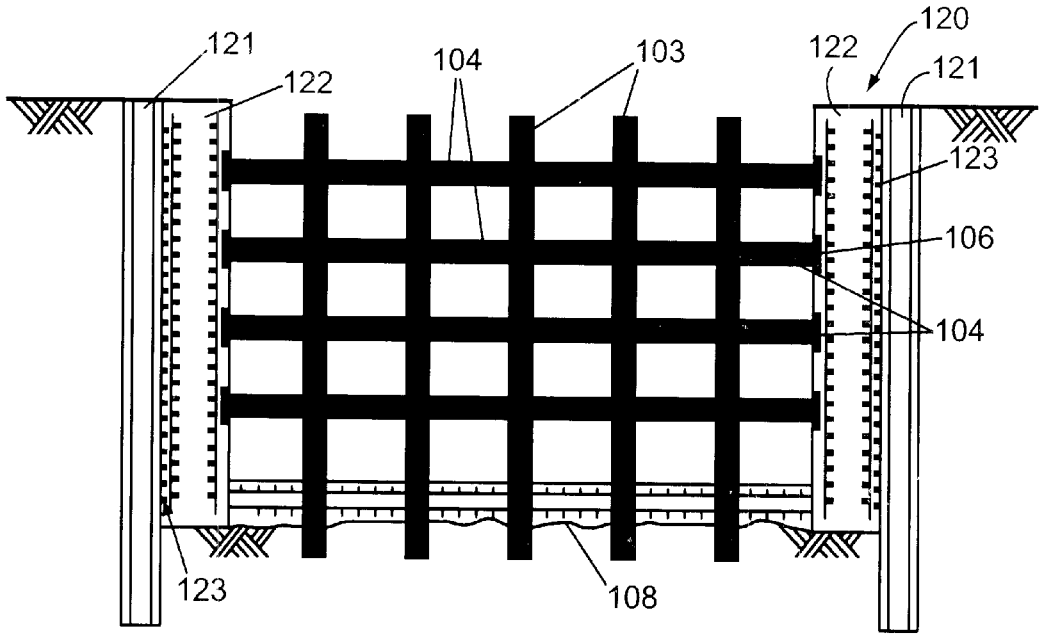

FIG. 38 shows the state where the detail construction over all stories of the underground is completed. Unlike the conventional temporary retaining construction method, because of the omission of the removal of the struts the detail construction can be directly continuous. In case where the slab of the first story is pre-constructed before the completion of the detail construction over all stories of the underground, a cover to be used as a working space is not installed, such that the slab of the permanent first story has the function of the working space, thereby achieving an economical construction. In addition thereto, the underground structure may adopt the construction method capable of building the girder and slab to the ground in parallel with the excavating work.

Figure 39:
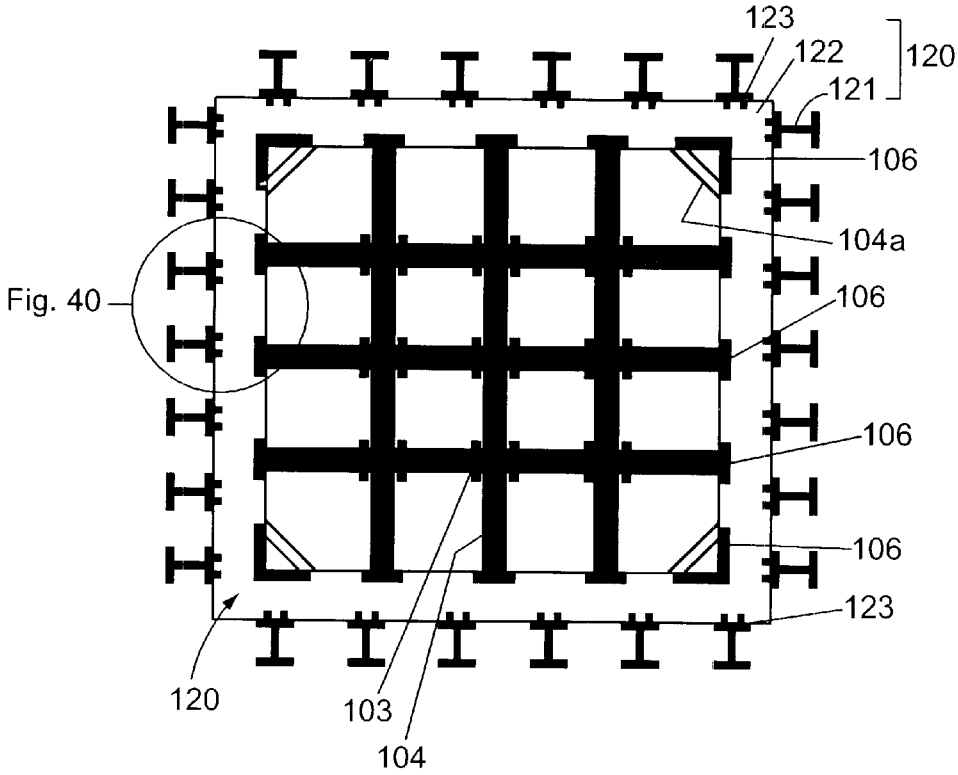

FIG. 39 is a plan view illustrating the state where a steel girder used in the real construction is utilized as a strut for a temporary construction. The steel girder(104) used in the real construction is assembled with the underground retaining wall(120) by means of the embedded plate(106), which is in place of the retaining wall. On the four corners where the external force such as the earth pressure does not endure by only the girders, a reinforcing strut(104*a*) is additionally provided.

Figure 40:
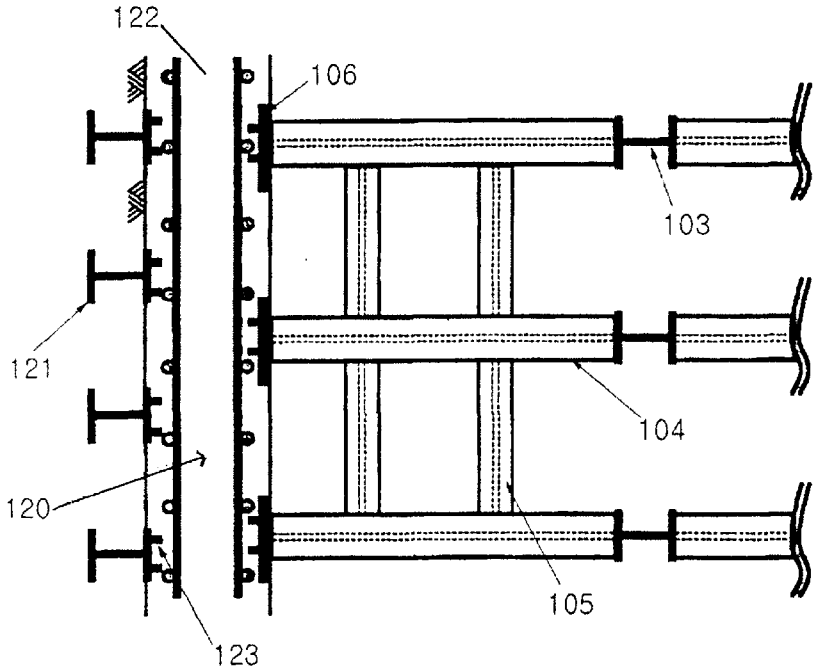

FIG. 40 is an detail drawing illustrating a part of FIG. 39. On the part where the steel girder(104) is adjoined with the concrete retaining wall(122) of the underground retaining wall(120), the embedded plate(106) is fixed. Between the girders(104), a beam(105) is provided at predetermined intervals in accordance with the material and structure of the slab. If the beam is installed, the prefabrication for the structure of the slab can be achieved by using a plant product member such as a PC plate (or a half PC plate and the cast-in-place concrete), a deck plate and the like.

Figure 41A:
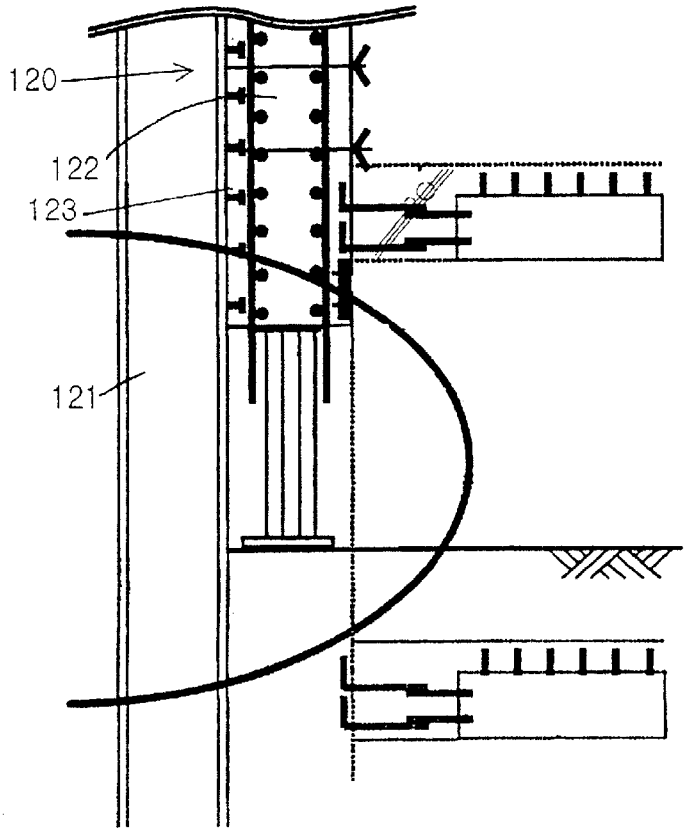
Figure 41B:
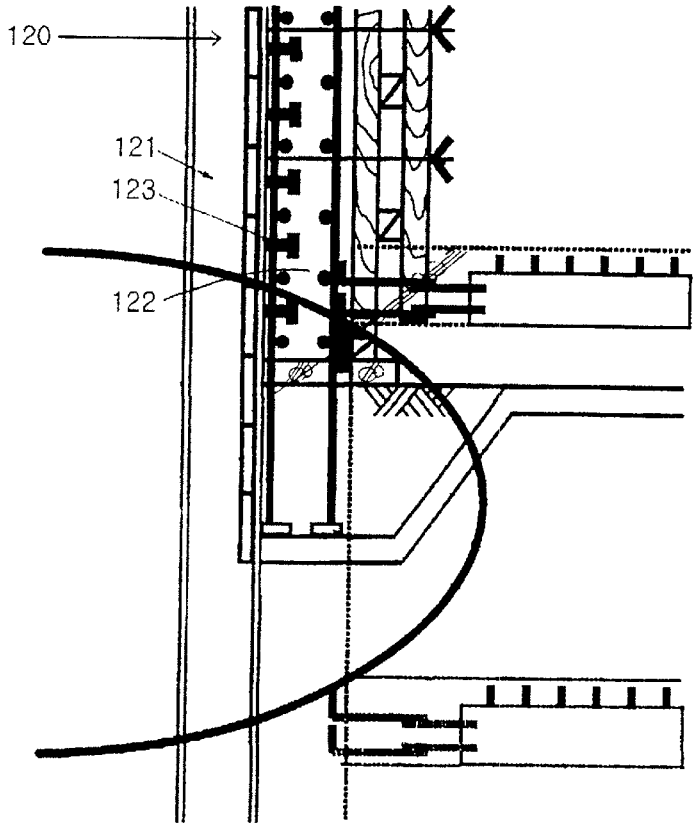

FIGS. 41*a* and 41*b* are detailed exemplary views illustrating a method for installing the underground retaining wall(120). Since the underground retaining wall(120) is constructed after the excavation, this has a reverse construction order from the upper part to the lower part thereof. For the construction of the lower part of the underground retaining wall(120), the form assembled in the construction site is supported by means of a support on the lower part thereof, as shown in FIG. 41*a*. Alternatively, sub-concrete is poured on the ground and the underground retaining wall is formed on the sub-concrete, as shown in FIG. 41*b*.

Figure 42:
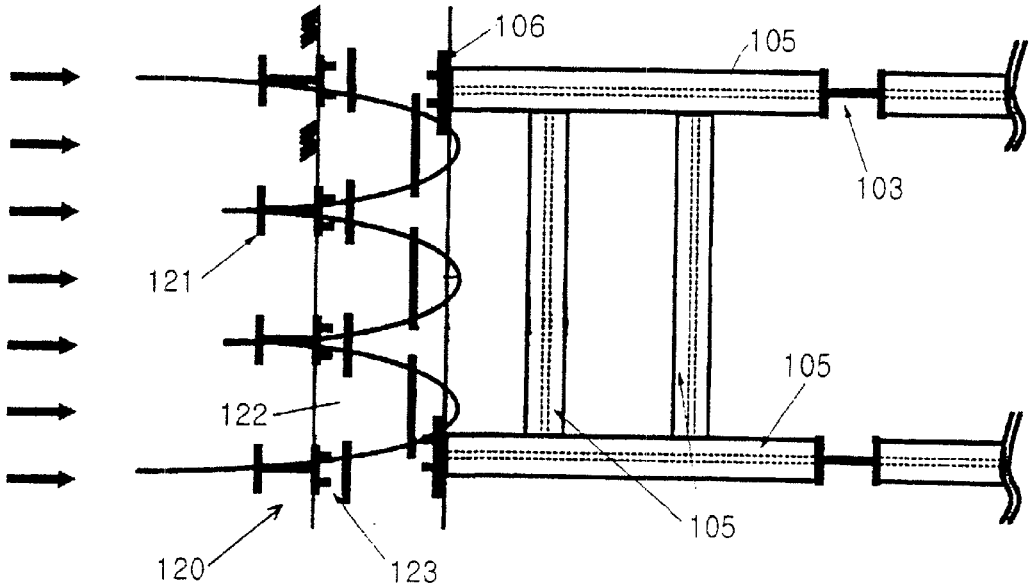

FIG. 42 is an exemplary view illustrating the load distribution applied to the underground retaining wall, where the retaining wall construction and excavation are carried out by installing the steel girder used in a main construction on the underground retaining wall instead of the temporary constructing strut. Since the underground retaining wall(120) has a high stiffness, there is no need to use any wale which is installed on the temporary retaining wall in the temporary retaining wall construction method using the H-section steel pile. Therefore, because of no wale, reinforcing bars(124) for supporting an earth pressure are arranged additionally on the part where the additional reinforcement is required for the viewpoint of the structural calculation. The building of the temporary retaining wall with no wale is one of main advantages of the present invention.

Figure 43:
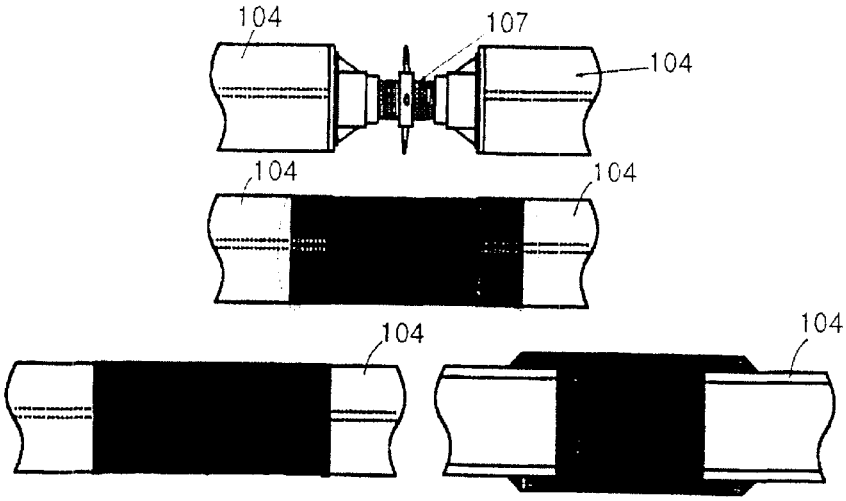

FIG. 43 is an exemplary view illustrating a treating method for a jack installed on the girder in the present invention. The jack in the conventional temporary retaining wall construction method is used to remove the clearance between the temporary retaining wall and the strut to accurately delivery the earth pressure. Of course, the jack in the preferred embodiment of the present invention is used to exhibit the same function as above, but since the girder(104) of the present invention should be used as a part of the main structure, an adequate step for guaranteeing the performance of the main structure is taken for the jack. The jack(107) is installed at the position where a bending moment due to the load (fixed load and movable load) is minimum, on the intermediate part of the girder(104). The reason is that the girder in the preferred embodiment of the present invention is used as the part of the main structure after the endurance of the earth pressure and even if the axial force is applied to the jack upon action of the earth pressure, the axial force is not further applied to the jack after the construction of the slab used in the main construction and the bending moment is exerted.

There are several methods for treating the jack after the earth construction. As shown in FIG. 43, in the state where the jack is installed, the flanges of the girder are reinforced with the steel plate and then, the jack is removed. Next, the web of the girder is welded to the steel plate. Since the axial force is not applied to the jack, the steel plate reinforced on the flange of the girder is resistant to the bending moment and after the removal of the jack, endures the load, together with the steel plate reinforced on the web thereof.

If necessary, a box (which is omitted in the drawing), which is made of the steel plate, is formed around the jack, into which the concrete is poured and filled.

Figure 44:
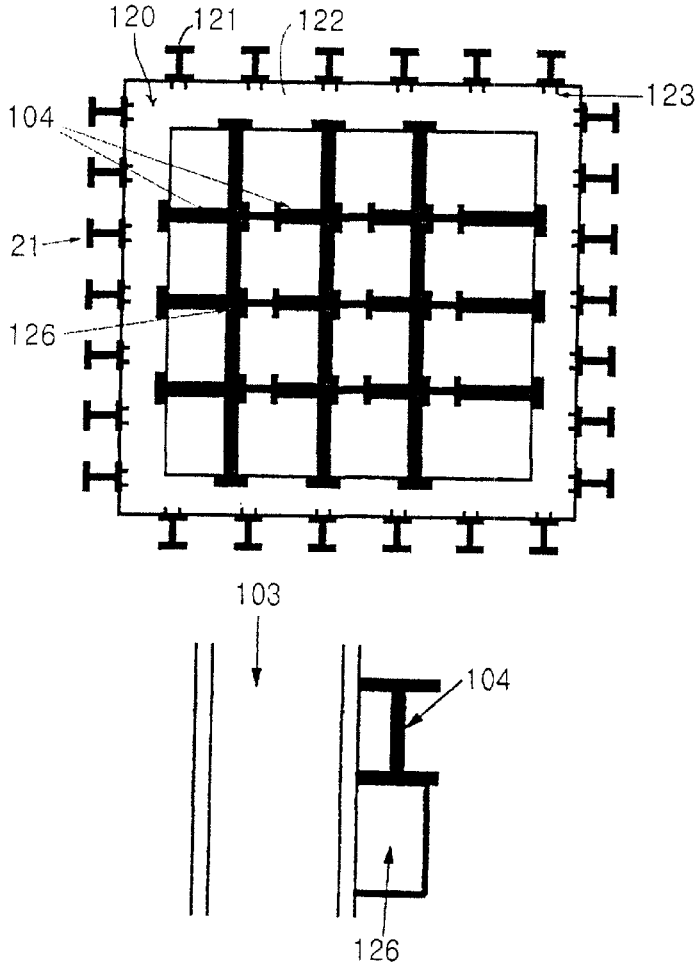

FIG. 44 is an exemplary view illustrating the variation of FIG. 39. If the steel girder is to be connected between the pillars, there arise problems that the connection work is substantially difficult and the steel member has to be cut in an appropriate length. In the variation of the present invention, a long standard steel girder is installed, while moving aside from the pillar, and a bracket(126) is installed on the pillar for delivering the load applied thereto to the pillar. Because the steel member is not cut, this provides a simple working procedure.

In the case where the preferred embodiments of the present invention, as shown in FIGS. 29 to 44, are embodied, the thickness of the underground retaining wall is relatively low and the stiffness thereof is more excellent, when compared with the conventional temporary retaining wall construction method, thereby reducing the construction cost for a frame structure. In addition, the underground retaining wall formed by the preferred embodiments of the present invention has a high stiffness and safety, such that it is possible to replace the underground outside wall built in the main construction with the underground retaining wall. Moreover, the steel material (for example, strut, center pile, etc.) used temporarily can be utilized for the main construction purpose, such that there occur the advantages that the unnecessary consumption of the steel material can be prevented, thereby reducing the construction cost, and the wale is not installed, thereby optimizing the saving of the resources and the reduction of the construction cost.

In addition, with the preferred embodiments of the present invention, the construction period can be reduced, the production of the material for the slab construction can be achieved in a factory to cause further reduction of the construction period, and the stability of the quality of the construction can be ensured. For example, the construction period of about 22 months is generally required for the underground structure of six stories, which can be reduced to about 17 months in the preferred embodiments of the present invention.

In case of the building construction in a downtown area, a top-down construction method is adopted because of the restriction of the working area. If the preferred embodiment of the present invention is applied, the slab of the first story is primarily constructed, such that it can be utilized as the working area.

It is obvious to the ordinary skilled person in the art that the preferred embodiments of the present invention as shown in FIGS. 29 to 44 are applied upon construction of an underground slurry wall generally embodied in the top-down construction method. As discussed above, if the supporting force of the center pile is substantially ensured, while constructing the underground structure towards the lower part thereof, the upper structure can be built by using the top-down construction method. In addition, the temporary retaining wall is installed and with the support of the retaining wall for the earth pressure, the excavation is carried out. Then, it is possible to construct the slab of each story in the order from the slab of a first story to the slab of a lowermost story.

FIGS. 45*a* to 51*b* are detailed exemplary views illustrating a method for utilizing a steel structure used in a main construction as a strut for the earth construction.

Figure 45A:
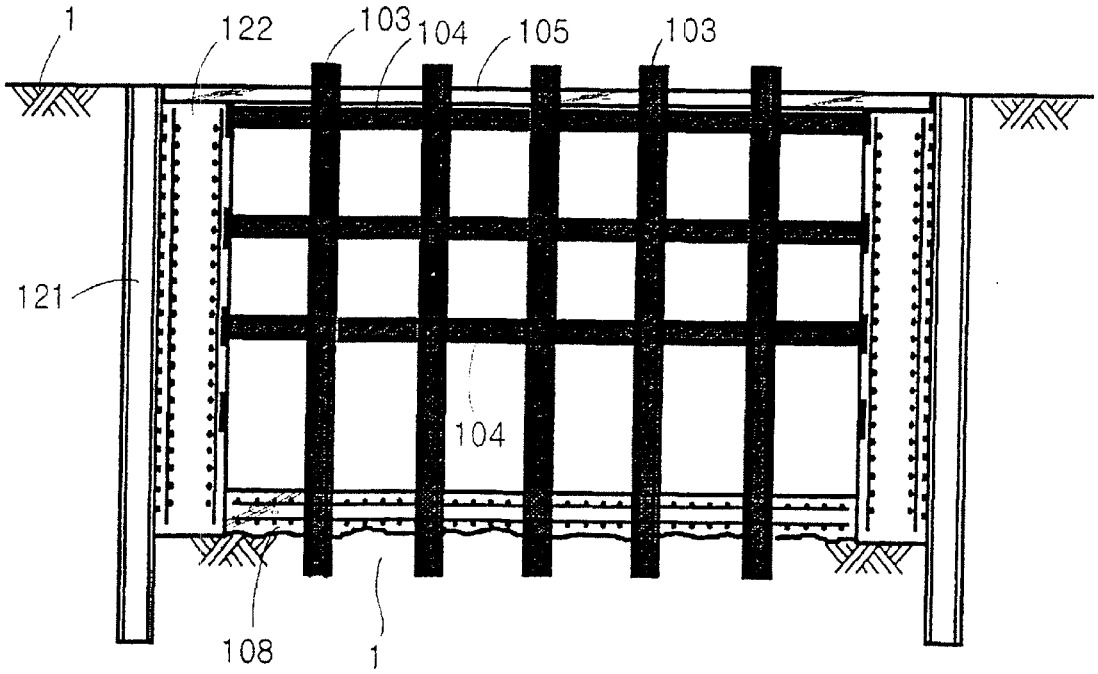
Figure 45B:
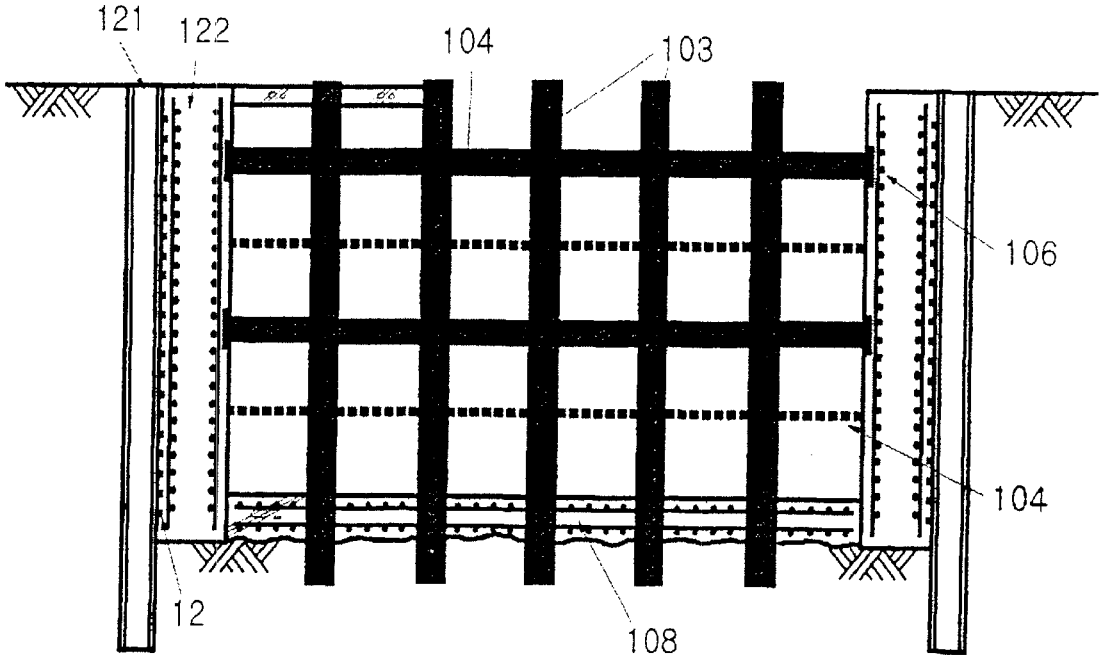

FIGS. 45*a* and 45*b* show another embodiment of the present invention, when the beam or girder used in the main construction is utilized as the strut for the temporary construction.

In construction, a center pile(103) is driven in on the position on which the pillar of a building is put and an underground concrete retaining wall(122) is installed on the boundary line on which the building is constructed. Then, a primary excavating work is carried out and a wale(131) is installed on the underground concrete retaining wall(122) used as a retaining wall. A girder(104) is installed, thereby serving as a part of a permanent structure connecting the wale(131) and the center pile(103). Next, a secondary excavating work is carried out and the steps after the primary excavating work are repeated until the lowermost story of the building is excavated. If the excavation is ended up to the lowermost story of the building, the slab of each story is constructed in order from the base to the top story.

In the preferred embodiment of the present invention the retaining wall is a composite retaining wall (CRS retaining wall) which is formed by the assembly of the H-section steel pile(121) and the concrete retaining wall(122), but may be of various shapes. For example, the retaining wall may be applied to internal retaining walls and all kinds of the temporary retaining walls, for example, a slurry wall, a column arrangement type retaining wall and the internal retaining wall, a thumb pile type earth plate temporary retaining wall and the internal retaining wall and so on.

FIG. 45*a* shows the method for installing the girder every story and FIG. 45*b* shows the method for installing the girder, while skipping one story or two stories. In case of the girder construction as shown in FIG. 45*b*, the girder(104) and the composite retaining wall have the excellent yield strength, such that there is an advantage that the construction of the underground structure can be achieved at a rapid speed.

Figure 46A:
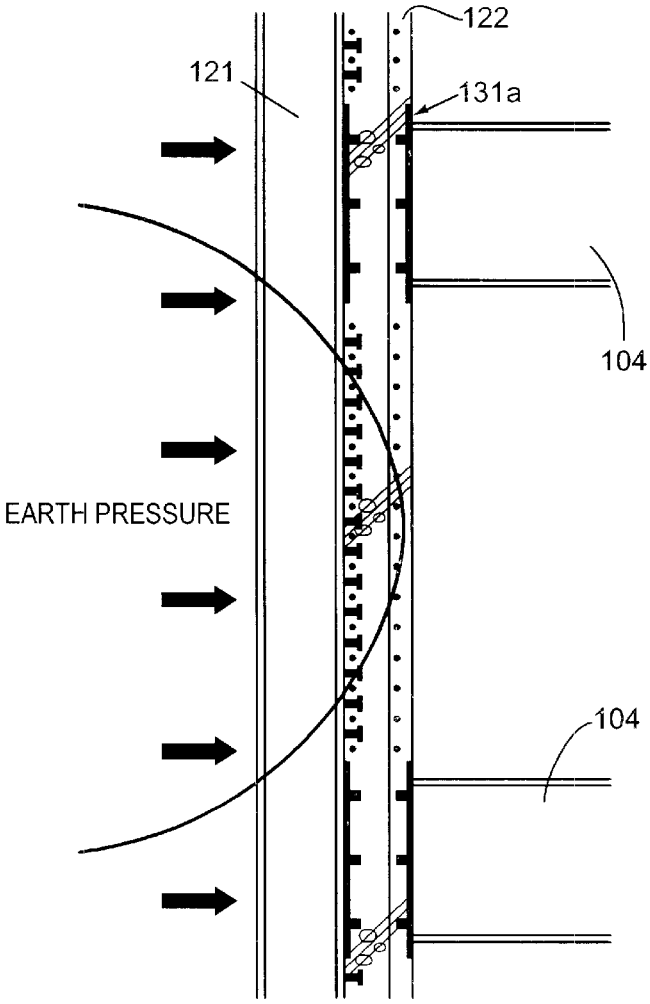
Figure 46B:
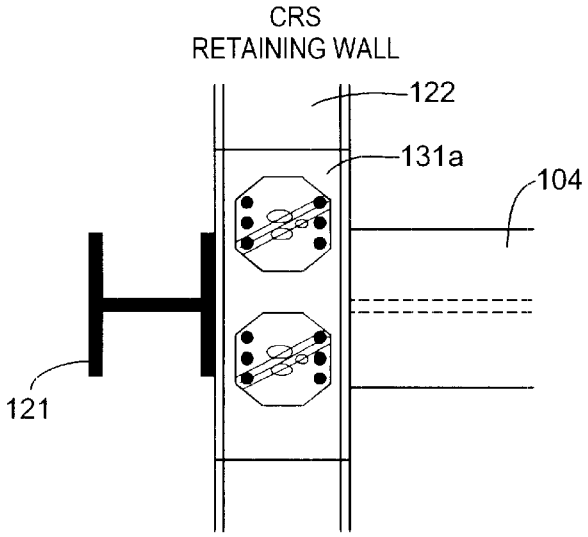

FIGS. 46*a* and 46*b* are vertical and horizontal sectional views illustrating the example of a wale for connecting the retaining wall and the girder.

In the preferred embodiment of the present invention, the thickness of the concrete retaining wail(122) is the same as the wale and a honeycomb H-section steel(131*a*) is used as the wale. The honeycomb H-section steel has a square hole on the web thereof, through which the reinforcing bar of the retaining wall is passed, such that the cutting work of the reinforcing bar can not be required.

Figure 47A:
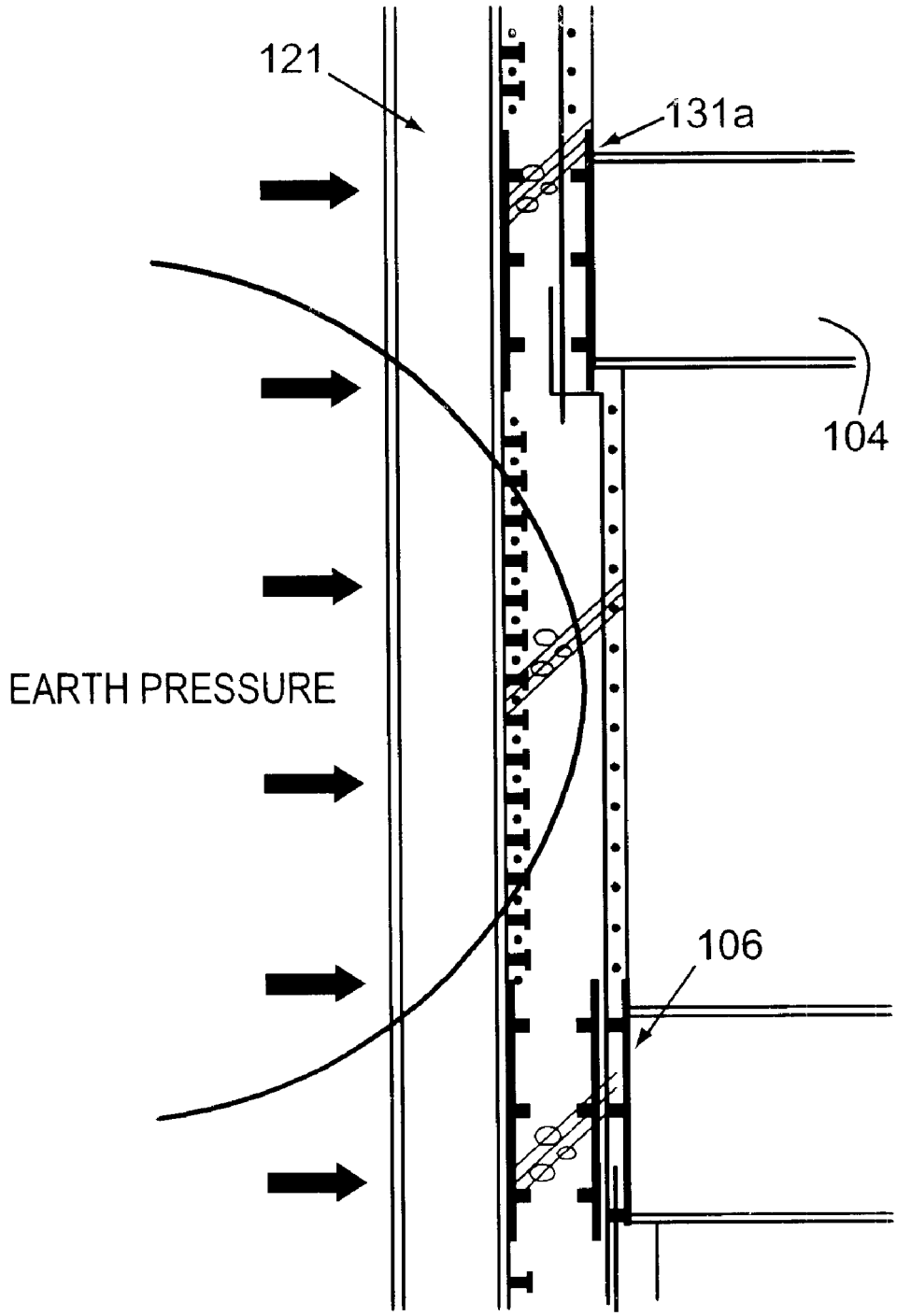
Figure 47B:
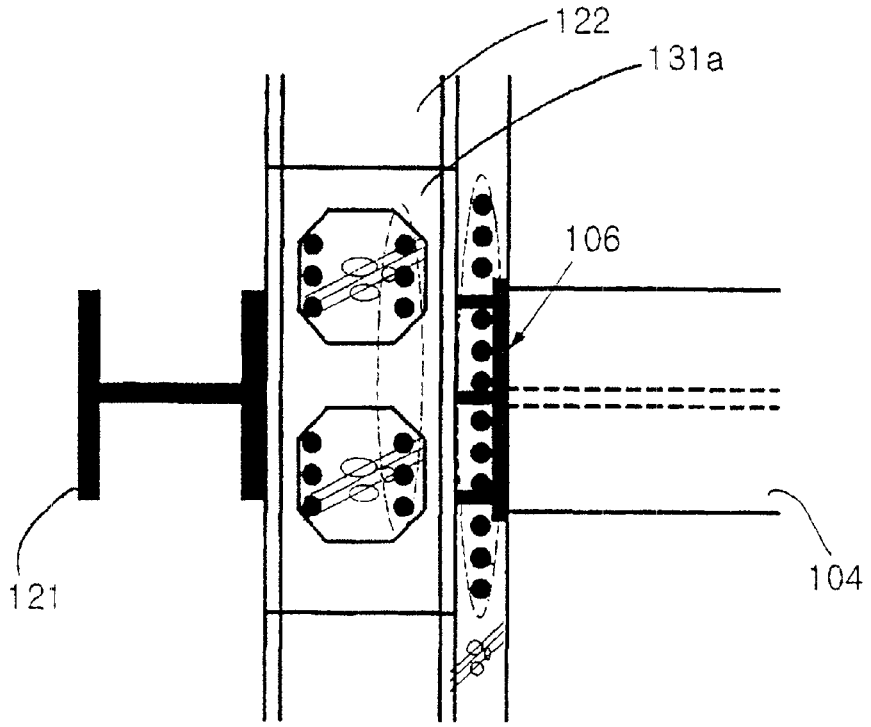

FIGS. 47*a* and 47*b* are vertical and horizontal sectional views illustrating another example of FIGS. 46*a* and 46*b*.

In the preferred embodiment of the present invention, the thickness of the concrete retaining wall(122) is different from that of the wale and a honeycomb H-section steel is used as the wale. If the thickness of the wale is smaller than that of the internal retaining wall, the wale is buried into the internal retaining wall and coupled to the girder(104) by means of an additional embedded plate(106). And, the vertical reinforcing bars are arranged in such a manner that parts thereof are passed through the honeycomb H-section steel pile and another parts thereof are passed between the wale and the embedded plate.

FIGS. 48*a* to 48*d* show another variations of FIGS. 46*a* and 46*b*.

Figure 48A:
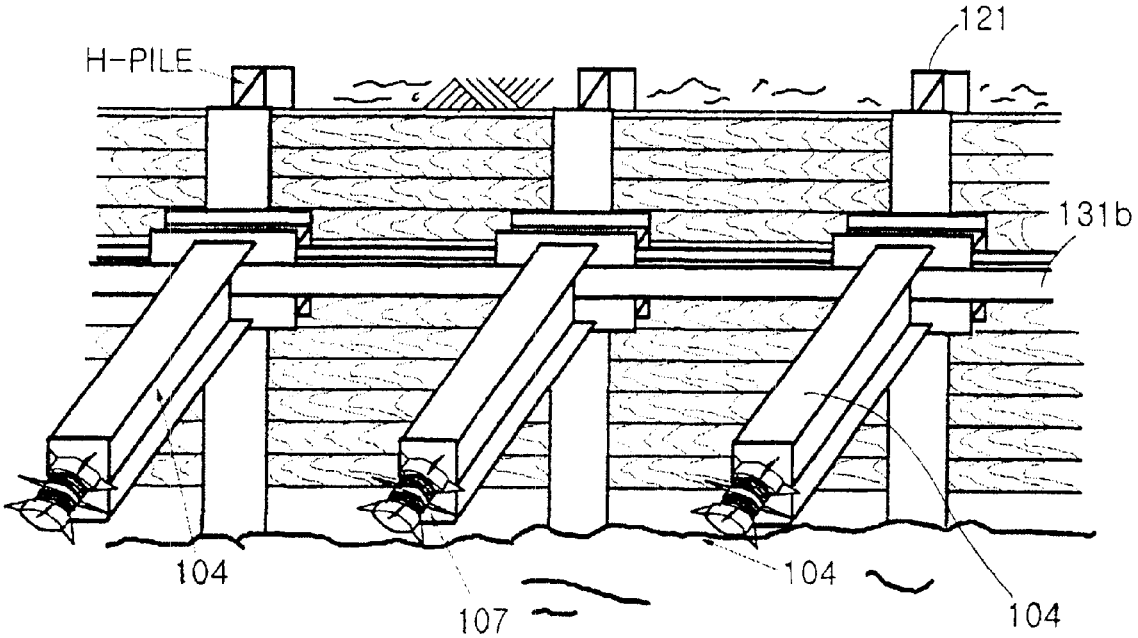
Figure 48B:
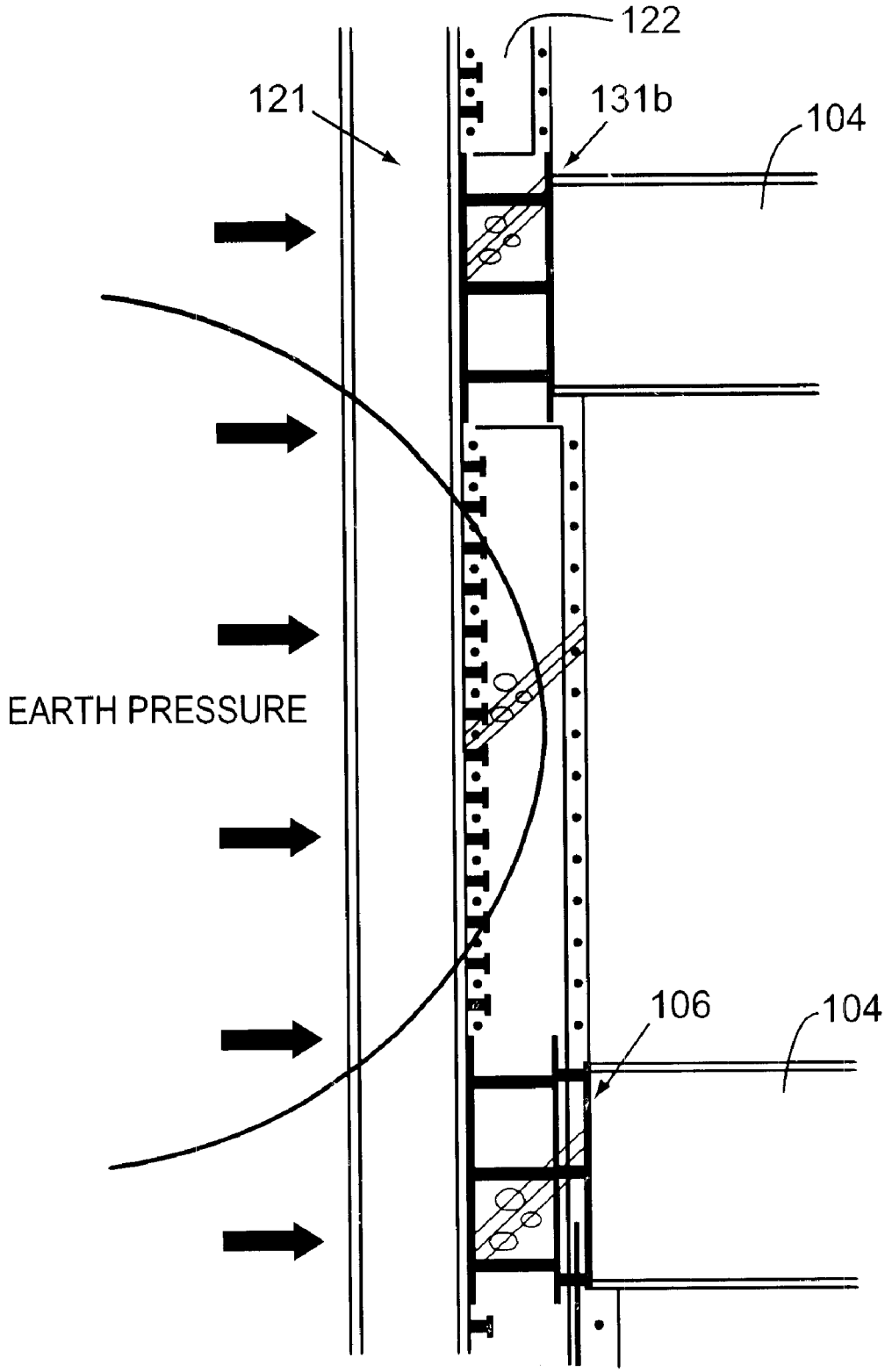
Figure 48C:
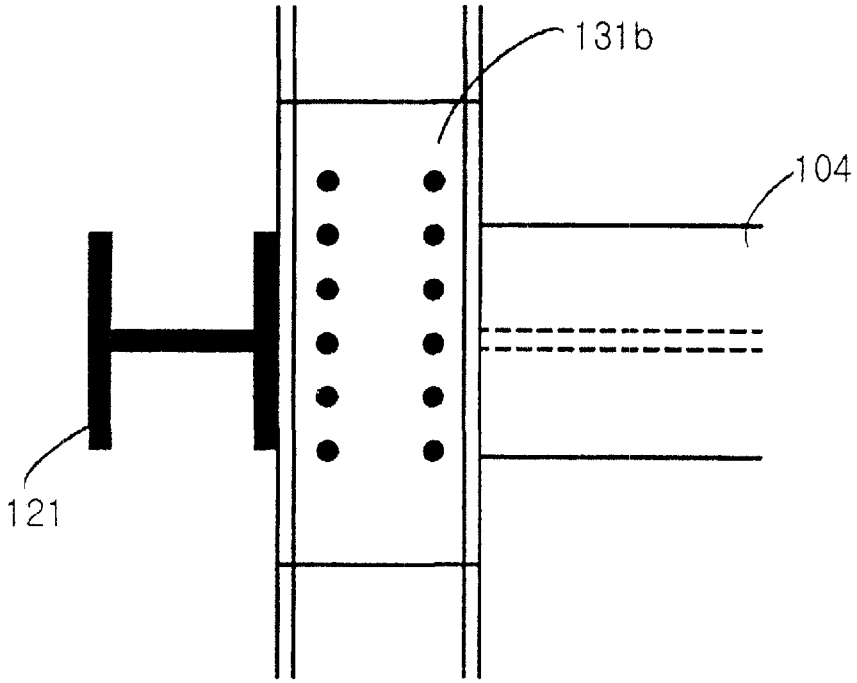
Figure 48D:
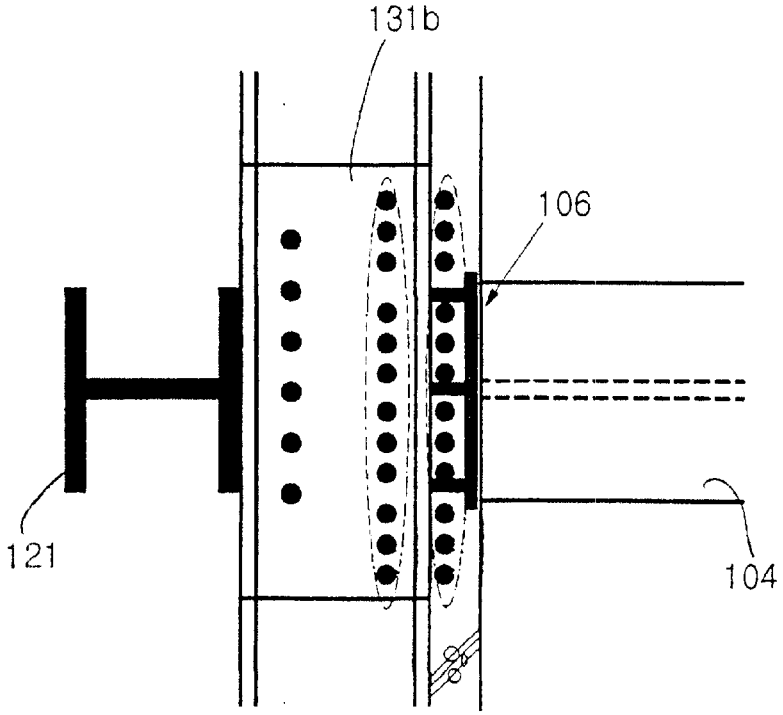

In the preferred embodiment of the present invention, a general H-section steel pile wale(131*b*) is used as the wale. FIG. 48*a* shows a three-dimensional view thereof, FIG. 48*b* shows a vertically sectional view thereof, FIG. 48*c* shows a sectional view in the case where the thickness of the internal retaining wall is the same as the wale, and FIG. 48*d* shows a sectional view in the case where the thickness of the internal retaining wall is different from that of the wale.

Since the general H-section steel pile is used as the wale, the vertical reinforcing bars are discontinuously arranged and thus, welded to the wale, thereby being integrated with the wale.

Figure 49A:
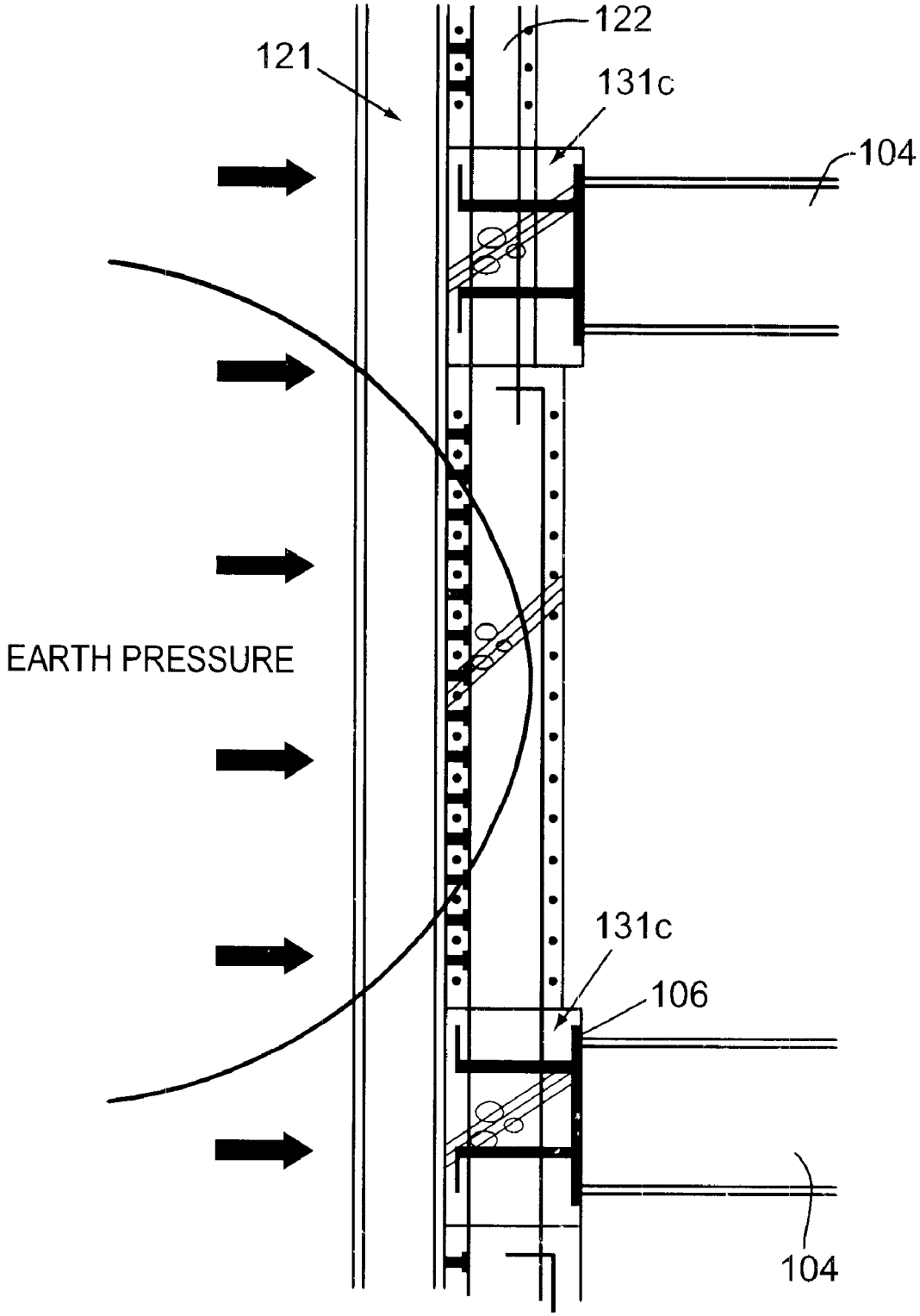
Figure 49B:
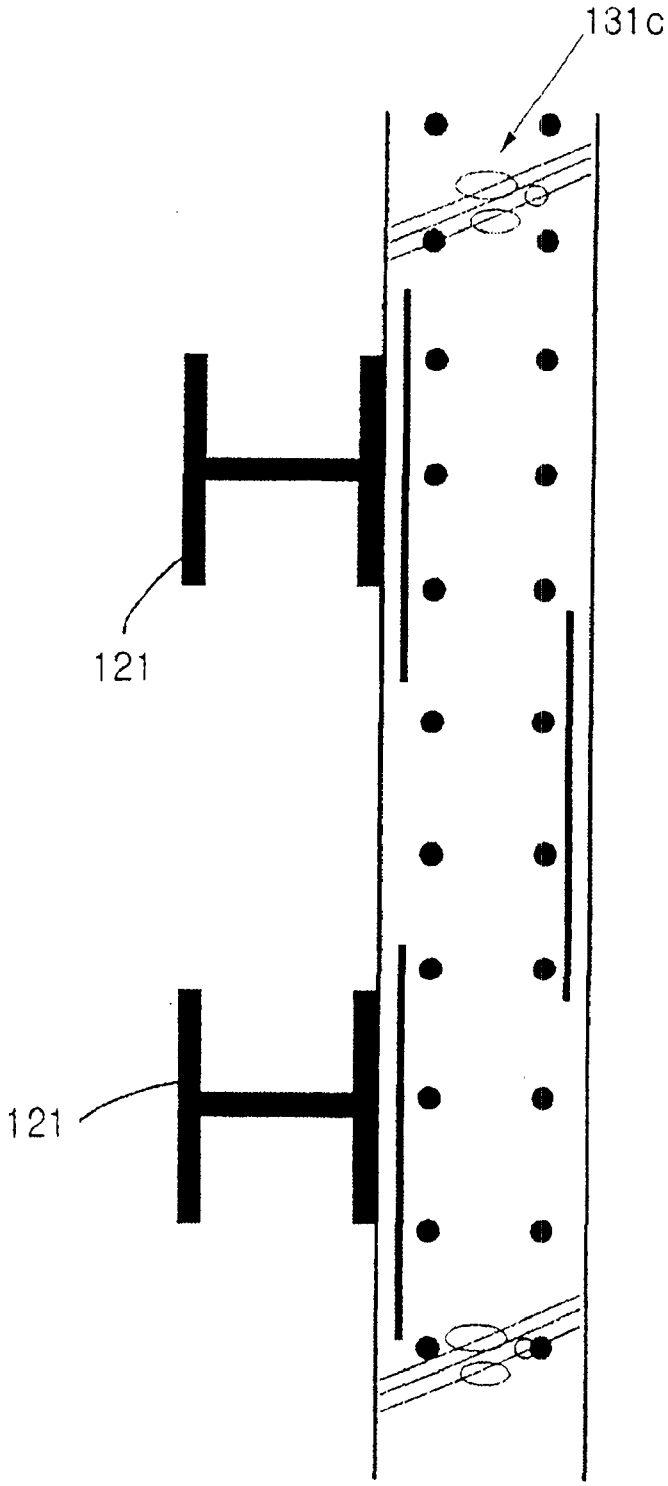
Figure 49C:
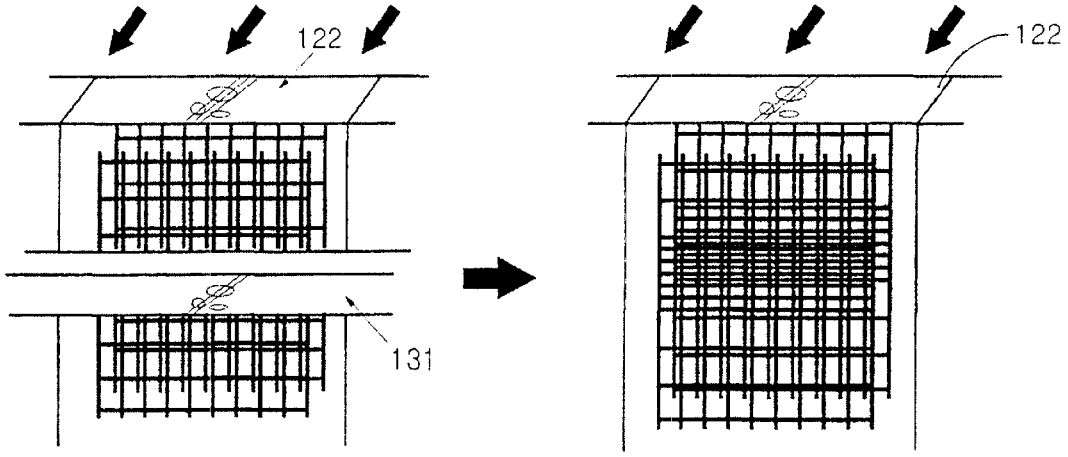

FIGS. 49*a* to 49*c* show another variations of FIGS. 46*a* and 46*b*.

In the preferred embodiment of the present invention, a cast-in-place concrete wale(131*c*) is used as the wale. In the same manner as a general concrete construction, the wale is connected to the girder(104) by the installation of the embedded plate(106). In the variation of FIG. 49*c*, the shear connecting means(11) is installed on the H-section steel pile(121) and hence, the wale can be effectively utilized by using the stiffness of the H-section steel pile.

Figure 50A:
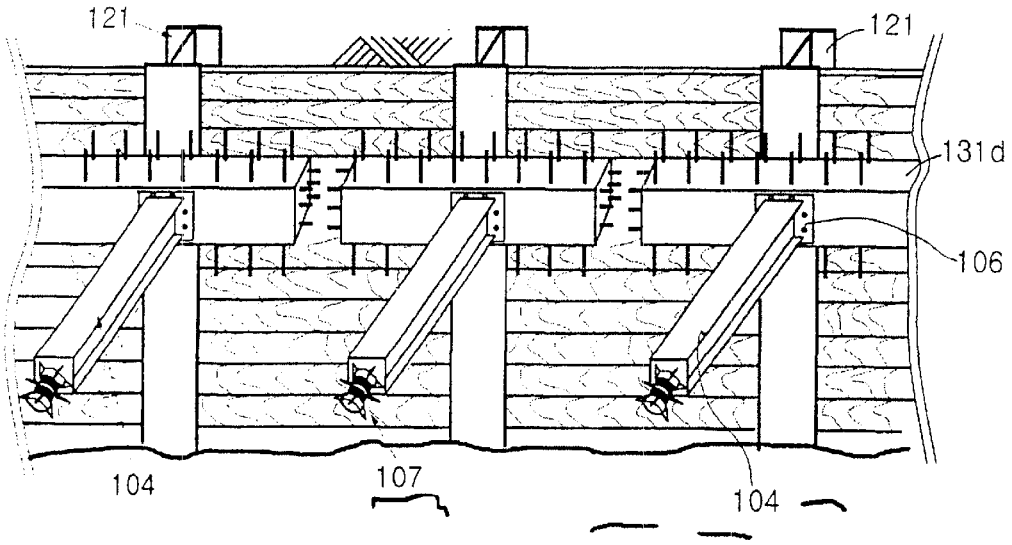
Figure 50B:
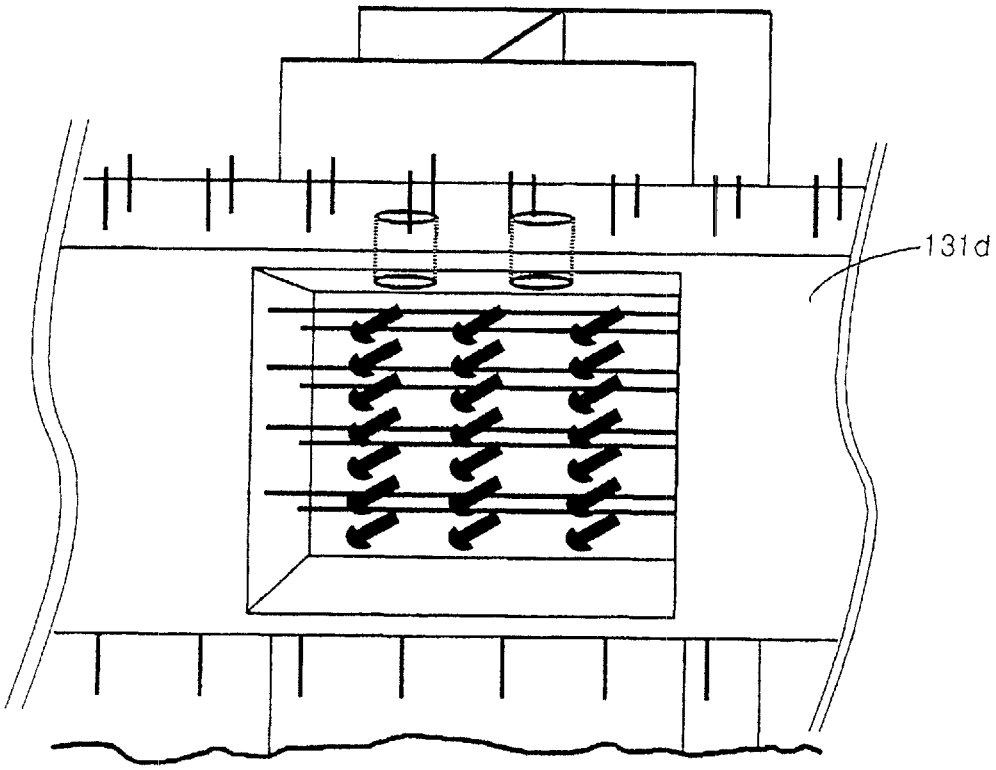
Figure 50C:
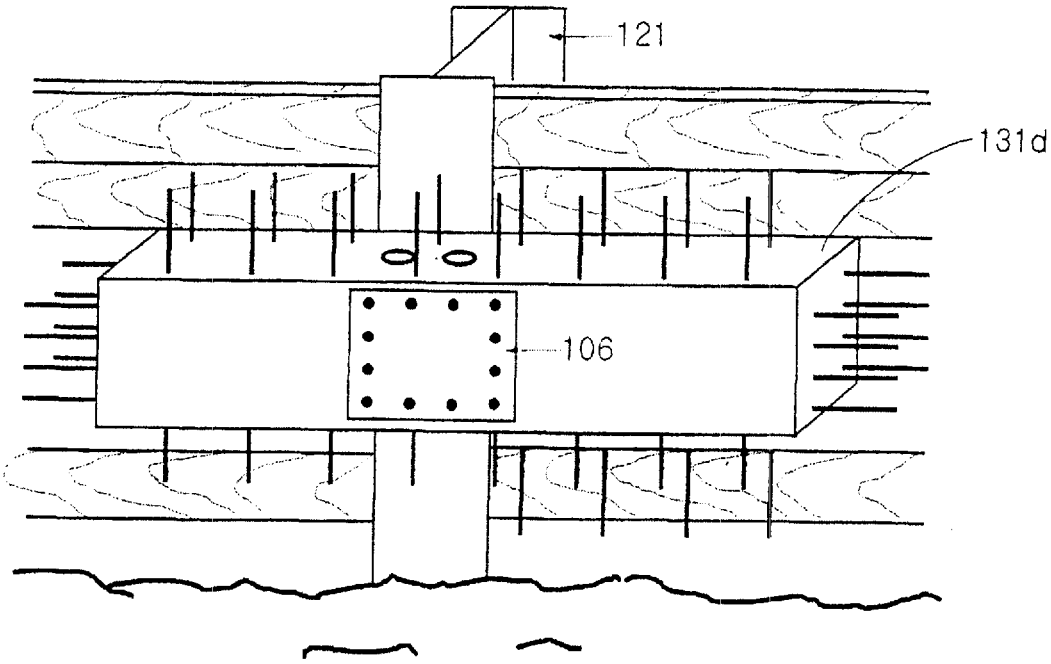
Figure 50D:
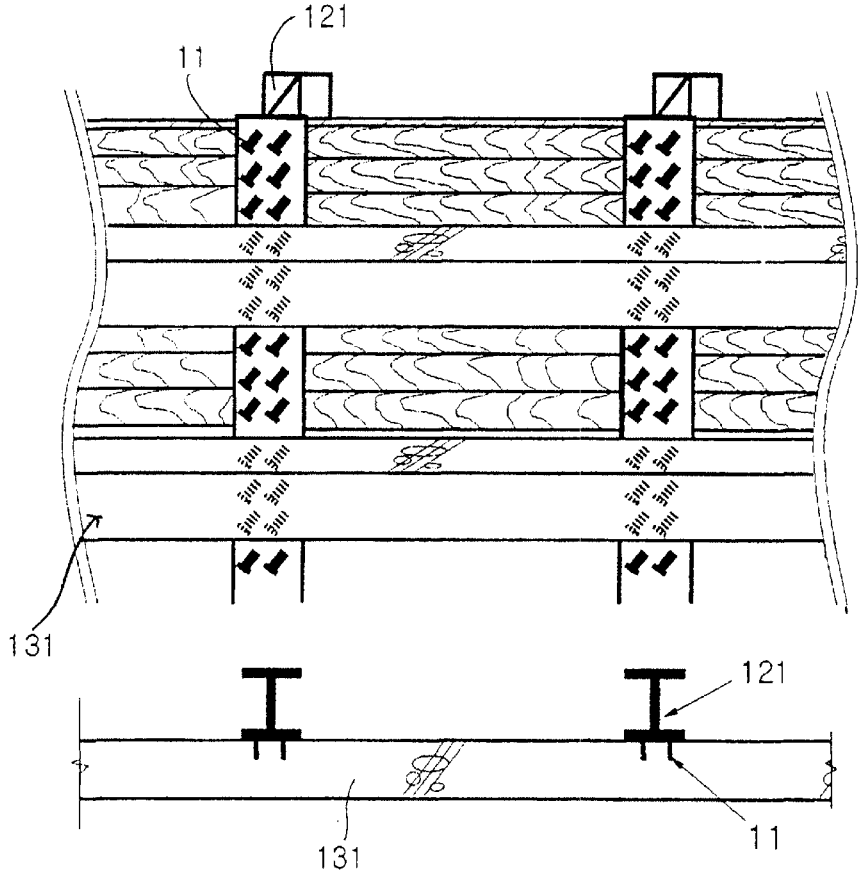

FIGS. 50*a* to 50*c* show another variation of FIGS. 46*a* and 46*b*.

In the preferred embodiment of the present invention, a PC wale(131*d*) as the concrete fabricated by a factory is used as the wale. FIG. 50*a* shows a three-dimensional view thereof, FIG. 50*b* shows the step of covering the PC wale on the H-section steel pile, and FIG. 50*c* shows the step of installing the embedded plate 106. In this case, the cast-in-place concrete wale as shown in FIGS. 49*a* to 49*c* is replaced with the PC wale fabricated by a factory. In case of using the PC wale, a method that the PC wale is bonded to the H-section steel pile(121) on the construction site is emerged as a main problem. In the preferred embodiment of the present invention, stud bolts, which are passed through the PC wale(131*d*) on which holes are formed and then installed on the H-section steel pile, are buried into the holes. Thereafter, the holes are blocked by means of the embedded plate(106) and the concrete is poured through small holes formed on the top end of the PC wale.

Figure 51A:
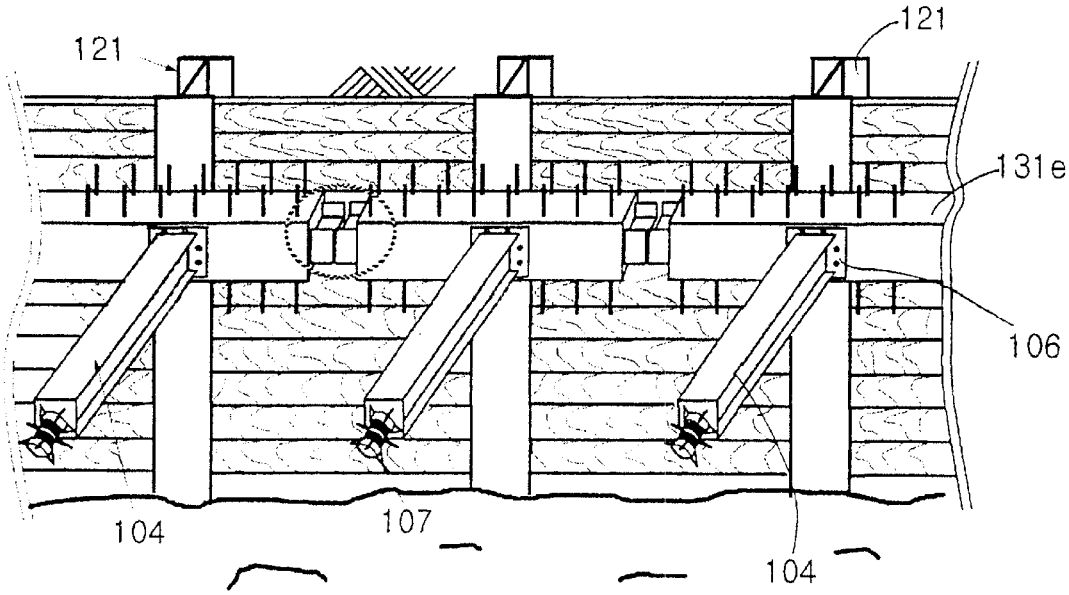
Figure 51B:
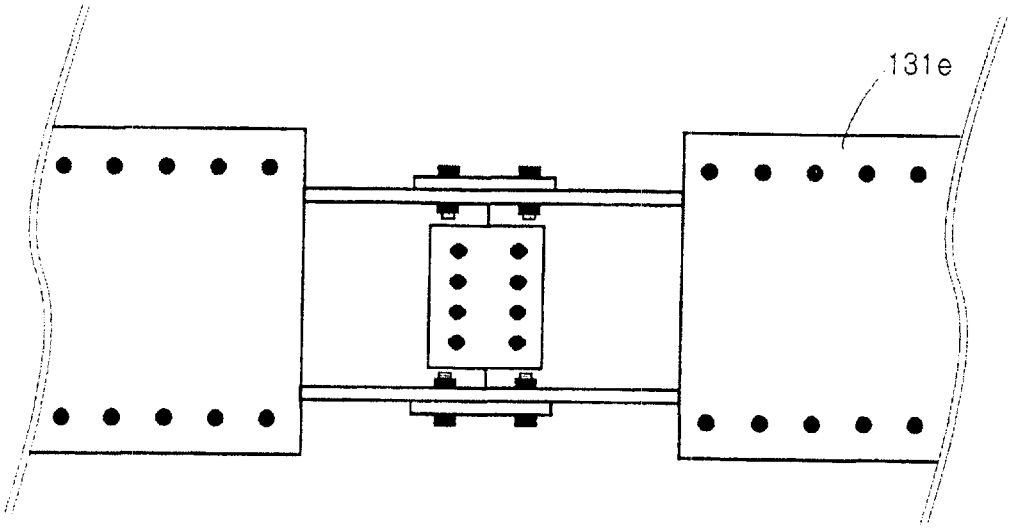

FIGS. 51*a* and 51*b* show another variations of FIGS. 46*a* and 46*b*.

In the preferred embodiment of the present invention, an SRC wale(131*e*) as the steel reinforced concrete is used as the wale. FIG. 51*a* shows a three-dimensional view thereof, and FIG. 51*b* shows the enlarged wale connection part. Since the SRC wale has the reinforcing bar buried on the center thereof, the connection of the SRC wales is made in a bolt jointing manner or in a welding manner, in the same manner as the connection to the H-section steel pile. Preferably, in the preferred embodiment of the present invention the connection of the SRC wales is made in the bolt jointing manner.

FIGS. 52*a* to 52*f* are exemplary views illustrating the processes for installing the center pile.

In order to use the center pile as a permanent structure, a perpendicular precision of the center pile should be maintained. Typically, earth is punched by means of an auger, and a steel casing is inserted into the punched earth, thereby preventing a supportless wall from being collapsing. After the earth punching, the casing is inserted into the punched earth and then, the center pile is inserted into the punched earth. Next, the casing is removed. In the conventional center pile installing method, however, it is difficult to maintain the perpendicularity of the center pile within a predetermined error range. In the case where the perpendicularity thereof fails to be kept within the predetermined error range, therefore, the work for the installation of the center pile should be resumed or the correction work during the construction should be required, which causes an unnecessary time consumption and a large economical loss. In the preferred embodiment of the present invention, a method for maintaining the precision of the perpendicularity of the center pile is developed.

The method for maintaining the precision of the perpendicularity of the center pile is as follows:

First, the earth on the position where the pillar is disposed is taken away and a steel pipe of a length of 1–1.2 m is installed as a primary guide casing(241) on the corresponding earth. The concrete(243) is cast on the exterior of the primary guide casing(241), for preventing the primary guide casing from moving.

The earth is punched by inserted auger in the interior of the primary guide casing and the punching is continuous until the auger meets a base rock. Then, a secondary guide casing(242) is inserted into the interior of the primary guide casing. However, if there is the danger of the collapse of the supportless wall, the punching may be continuous until the auger meets the base rock, while inserting the guide casing. The precision of punching the earth is maintained by the primary guide casing(241).

Figure 52A:
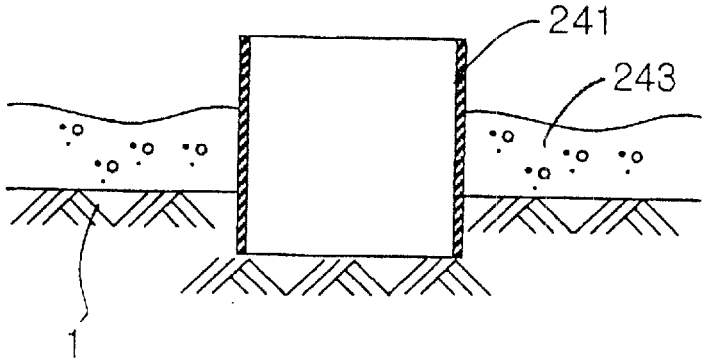
Figure 52B:
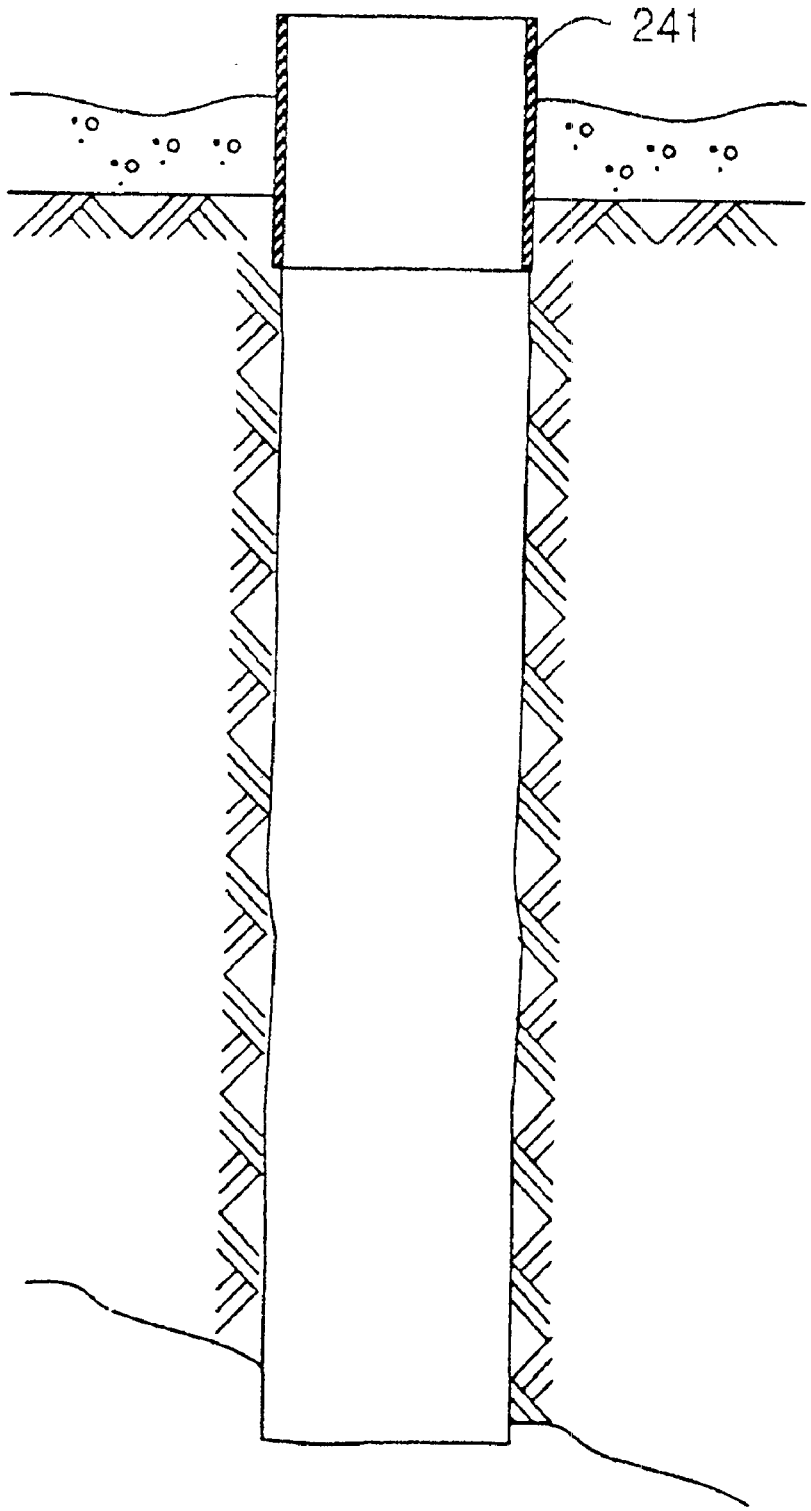
Figure 52C:
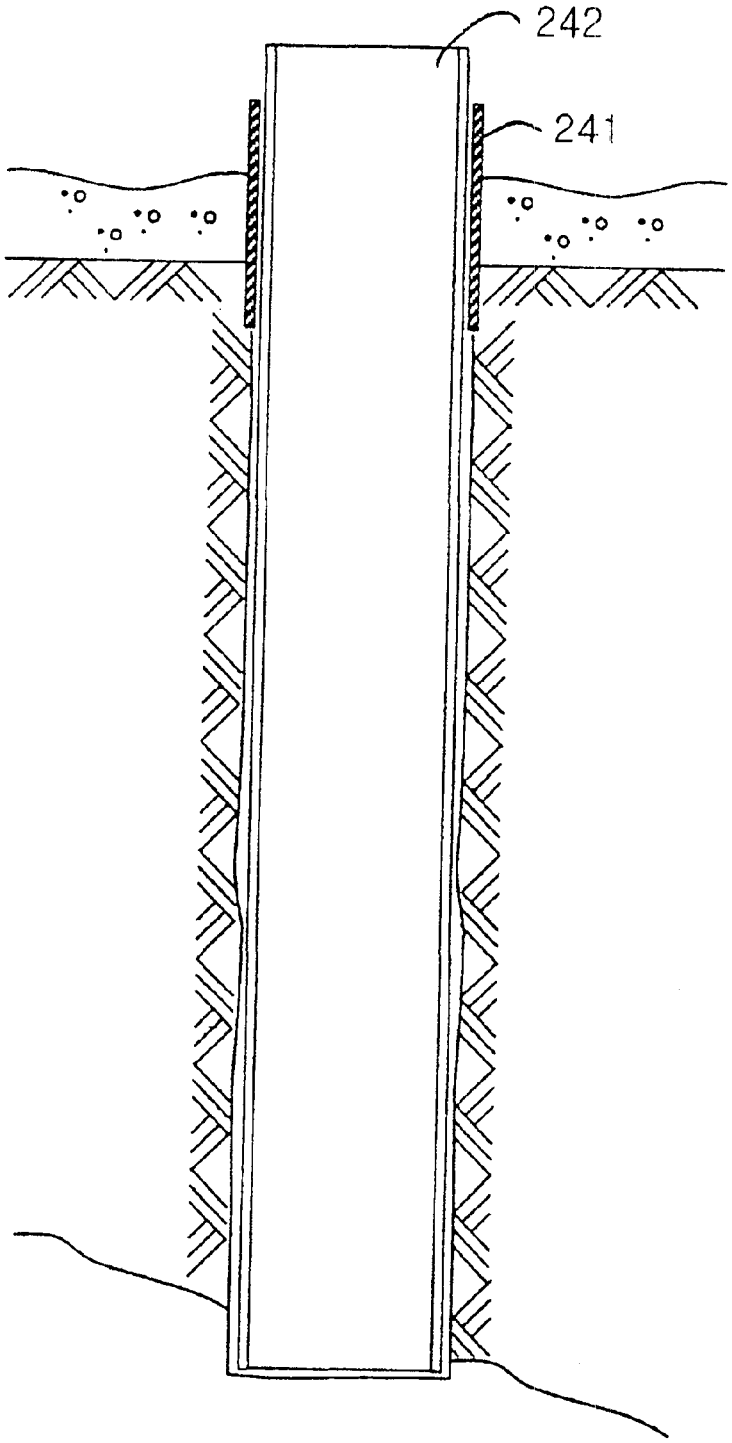
Figure 52D:
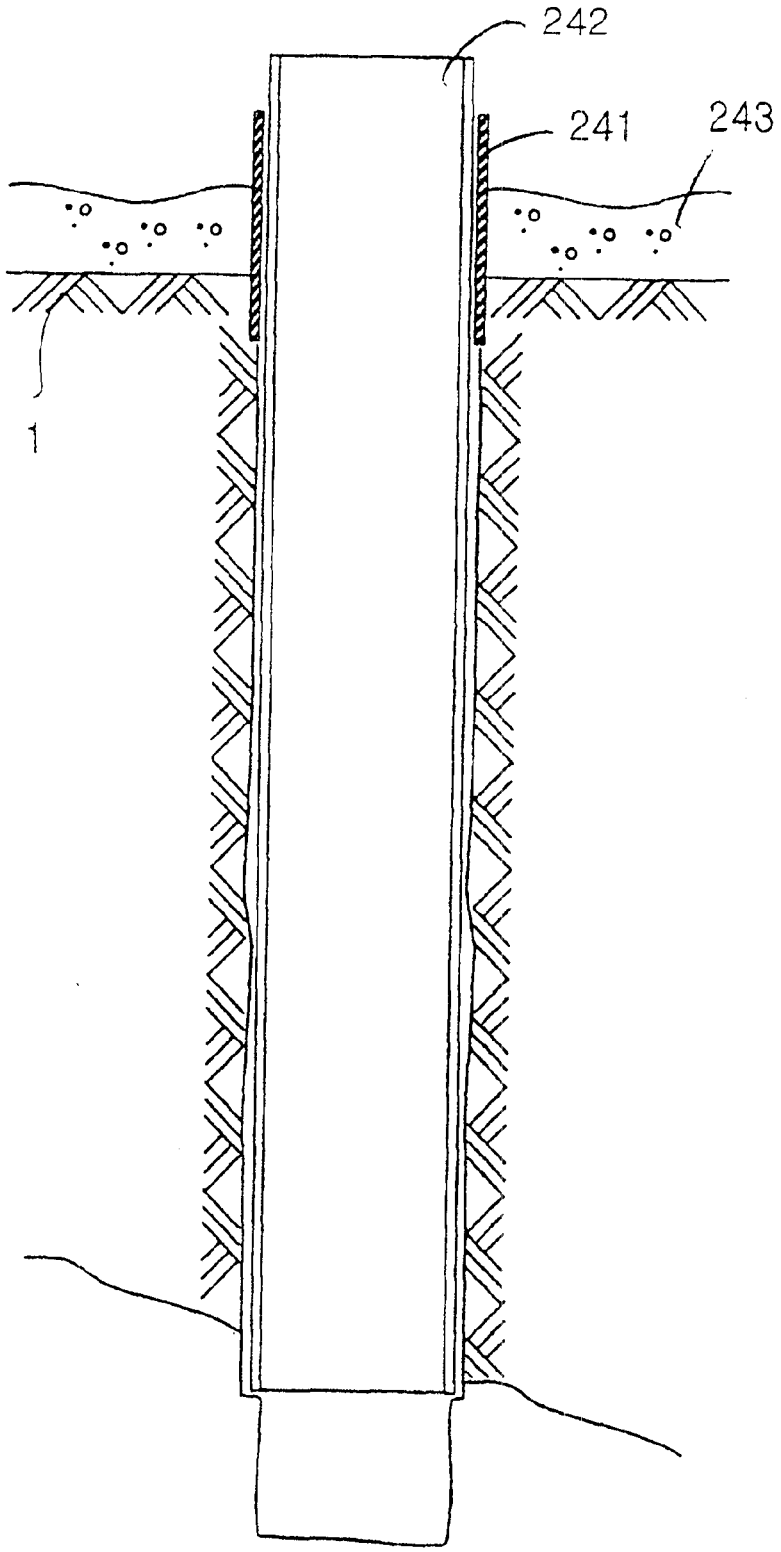
Figure 52E:
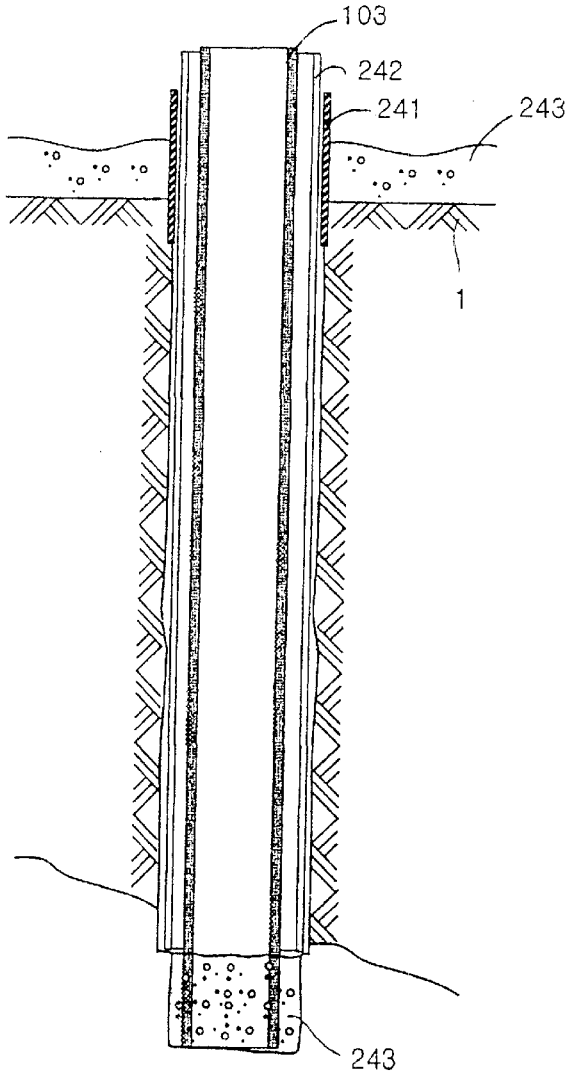
Figure 52F:
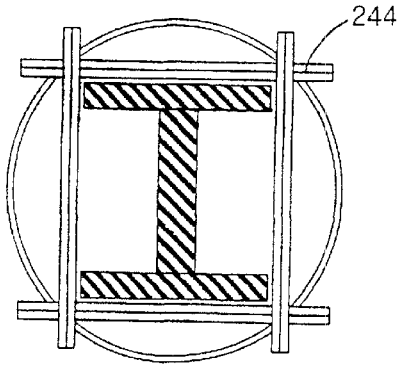

If the earth punching ends, the base rock is punched by means of an air hammer or bit which is mounted into the secondary guide casing. The base rock is continuously punched up to the lower part of a position, where the base of the structure is built, and until a predetermined reinforcing bar insertion distance can be maintained. When the base rock punching is carried out in the combination action of the primary guide casing(241) and the secondary guide casing (242), the precision of the perpendicularity thereof can be maintained (FIG. 52*c*). The perpendicularity is checked by using a perpendicularity checking equipment (e.g., KODEN).

If the base rock punching ends, the center pile(103) is inserted into the interior of the secondary guide casing, and the concrete(243) is filled in the exterior of the center pile(103) and the interior of the secondary guide casing (242), thereby securing the center pile(103). If the center pile(103) has been secured, the primary and secondary guide casings are removed, thereby completing the installation of the center pile.

To maintain the perpendicularity of the center pile at a more precise state, a steel guide(244) is installed on the top end of the secondary guide casing(242). The steel guide (244) is used with a L-section steel, a reinforcing bar, etc., but the L-section steel is preferred.

FIGS. 53 to 57 are detailed exemplary views illustrating a method for utilizing a reinforced concrete beam or reinforced concrete girder of a permanent building as a strut for a temporary construction. The construction order thereof is as follows:

A center pile(103) is driven in on the position where the pillar of a building is disposed and an underground concrete retaining wall(122) is installed on the boundary line on which the building is constructed. A concrete beam(114) of the first story on the ground is cast, thereby integrating the underground concrete retaining wall(122) and the top end of the center pile(103). A primary excavating work is carried out and the reinforced concrete beam(114) on the bottom of next story is installed to be bonded with the underground retaining wall(122) and the center pile(103). Next, a secondary excavating work is carried out and the steps after the primary excavating work are repeated. Then, if the excavation to a lowermost story ends, a base is formed and the concrete on the bottom of the lowermost story is cast. Thereafter, the building is constructed in order from the lowermost story to the uppermost story.

Figure 53:
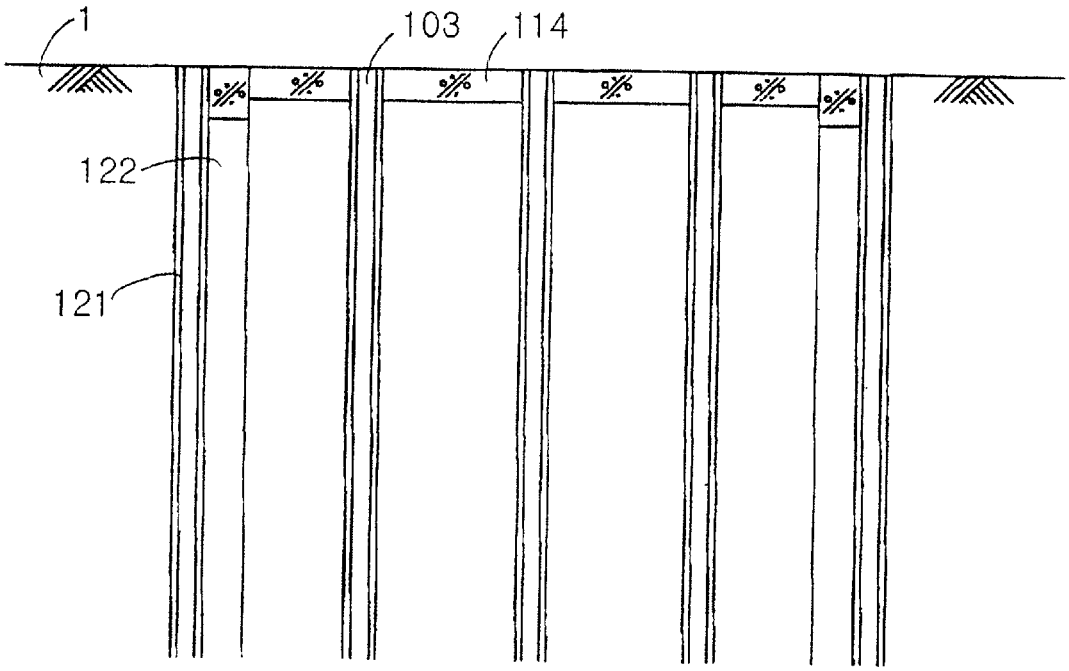
Figure 54:
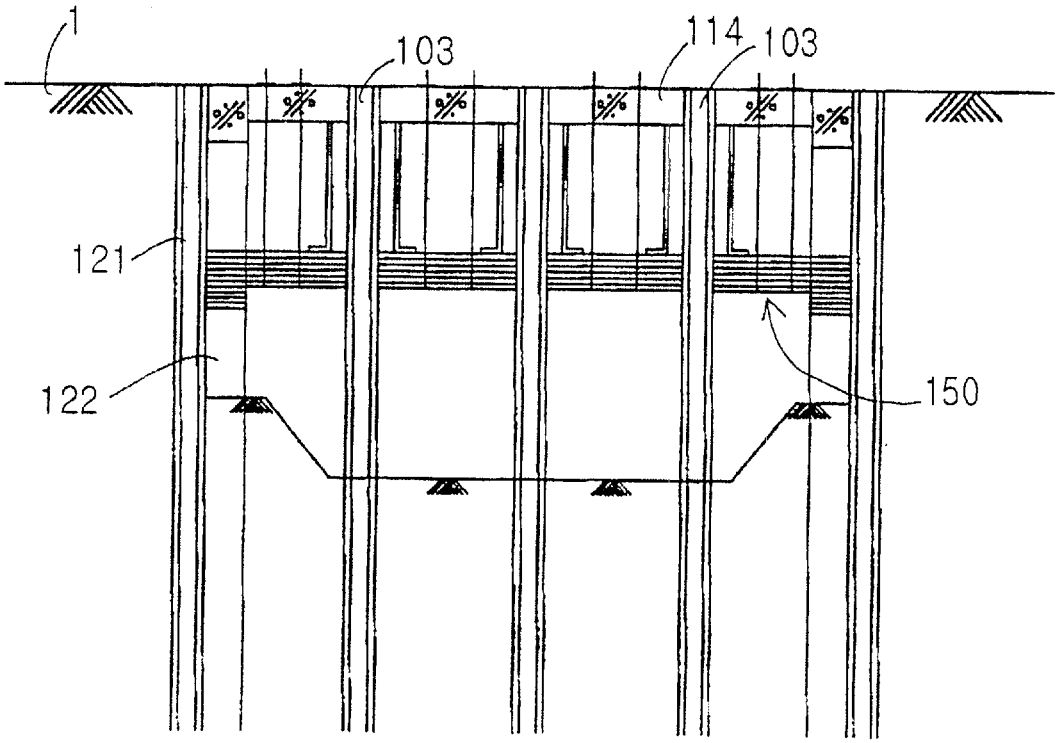
Figure 55:
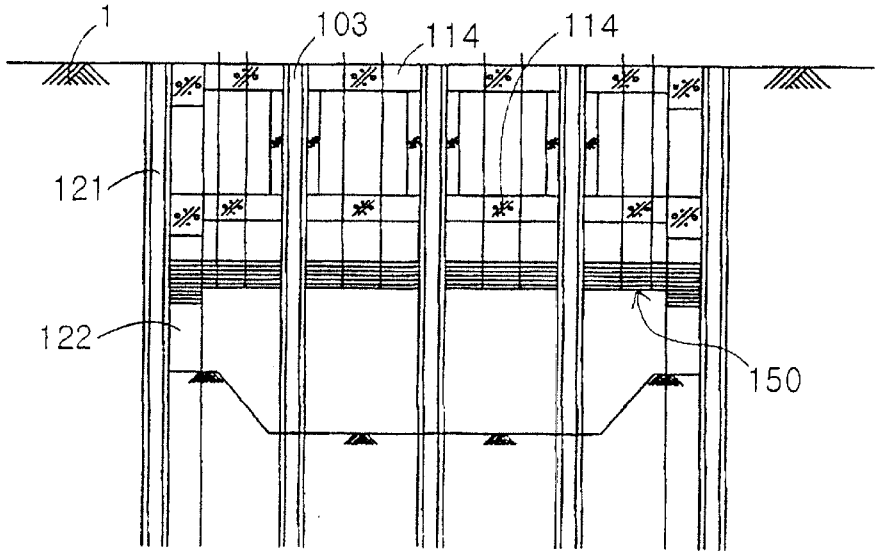

FIGS. 53 to 55 show the construction order for utilizing the reinforced concrete beam as the strut for the temporary construction.

As shown in FIG. 53, the center pile(103) is driven on the position where the pillar of the building is disposed and the H-section steel pile(121) and the underground concrete retaining wall(122) are installed on the boundary line where the building is constructed. The H-section steel pile(121) and the underground concrete retaining wall(122) works as a retaining wall and simultaneously become a part of a permanent structure.

In the preferred embodiment of the present invention, the retaining wall is defined as the composite retaining wall (C R S retaining wall) which is formed by the assembly of the H-section steel pile(121) and the underground concrete retaining wall(122), but may be of various shapes. For example, the retaining wall may be applied to all kinds of the temporary retaining walls and the internal retaining walls thereof, for example, a slurry wall, a column arrangement type retaining wall and the internal retaining wall thereof, a thumb pile type earth plate temporary retaining wall and the internal retaining wall thereof, etc.

In the conventional temporary strut construction method, if the buckling length of the strut is long, since the resistance performance to the load is drastically deteriorated, a support point is formed on the intermediate part of the strut, thereby reducing the buckling length thereof. Therefore, after the permanent structure is completely built, the center pile should be removed. However, in the preferred embodiment of the present invention, a reinforced concrete beam is pre-installed in the structure designed with the reinforced concrete beam(115) and utilized as the strut during the earth construction. After the earth construction, the reinforced concrete beam functions as a part of the permanent structure. Therefore, since there is no need to install or remove the temporary strut for the earth construction, it is very advantageous to reduce the amount of work required. In addition, more convenient work environment can be provided.

FIG. 53 shows the state where the reinforced concrete beam is cast on the bottom of the first story.

In the preferred embodiment of the present invention, the reinforced concrete beam(114) is firstly formed on the bottom of the first story on the ground and serves as a strut for the retaining wall. Of course, the reinforced concrete beam(114) is fabricated by using a general form, but to provide an easy work environment, a system sheeting is proposed in the preferred embodiment (see FIG. 56*a*). The system sheeting is configured as can descend for a repetitive use.

FIG. 54 shows the step of descending the form installed to cast the concrete beam on the bottom of the first story on the ground to thereby cast the reinforced concrete beam on the bottom of the first story in the ground. Of course, before the form descends, the site for the bottom of the first story in the ground should be completely excavated. An explanation of the structure of the form for descending will be in detail discussed in FIG. 56, hereinafter.

FIG. 55 shows the step of descending the beam form to the lower story, if the concrete casting to the reinforced concrete beam on the bottom of the first story in the ground is completed. At this time, the reinforced concrete beam (114) which is formed during excavation of the site for the underground structure supports the underground concrete retaining wall(122), thereby serving as a strut.

Figure 56A:
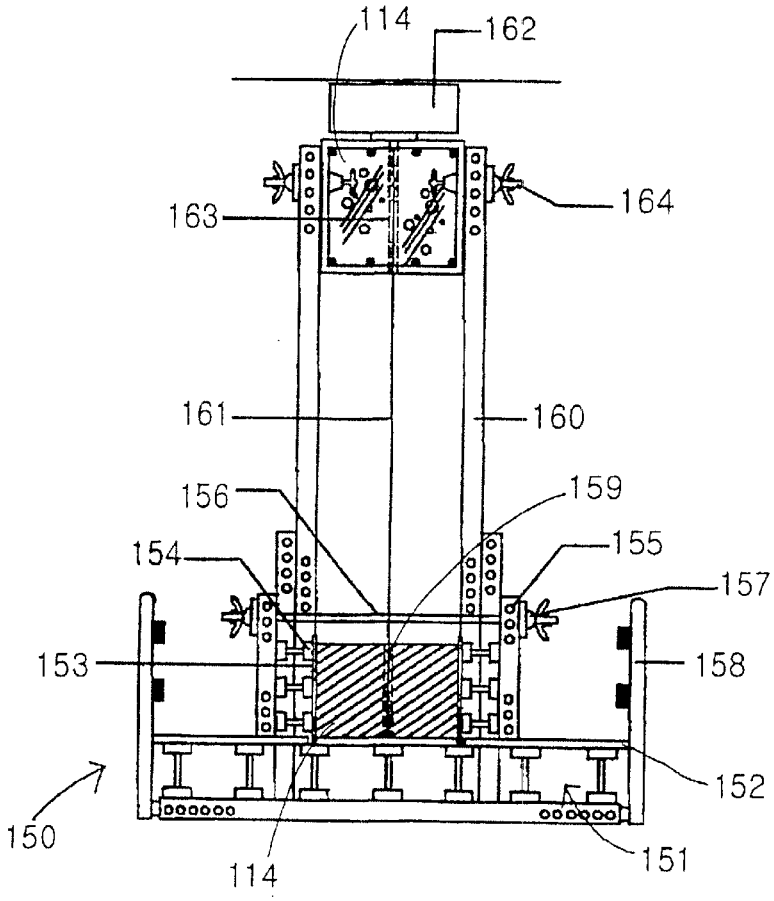
Figure 56B:
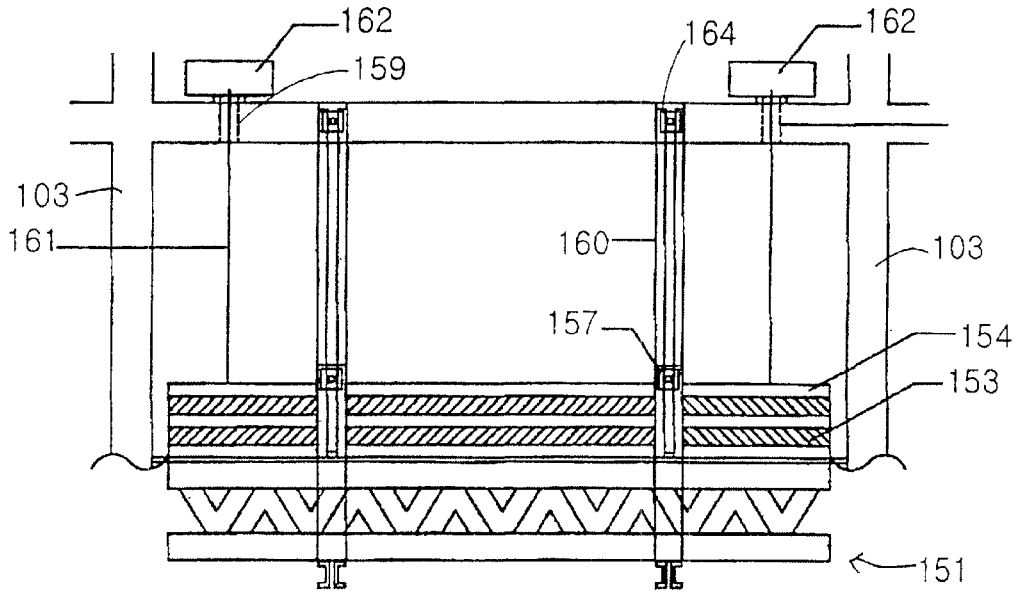

FIGS. 56*a* and 56*b* show the structure of a cast-in-place concrete beam form, in which FIG. 56*a* is a sectional view thereof and FIG. 56*b* is a side view thereof. The reinforced concrete beam form should be configured to have a predetermined structure, in order to descend the form which has installed the reinforced concrete beam(114) and also reuse the form for the installation of the reinforced concrete beam on next story. The reinforced concrete beam form according to the present invention comprises a support frame(151) for supporting the form, a horizontal form(152) disposed on the support frame(151), a vertical form(153) disposed perpendicularly to the horizontal form(152), a wale(154) for supporting the vertical form(153), a vertical member(155) for supporting the wale(154), a form tie bolt(157) supported by the vertical member(155) for maintaining the interval between the vertical forms(153), a hanging bar(160) for hanging the support frame(151) on an upper structure, and a metal wire(161) passing a sleeve(163) which passes through the center of the concrete beam(114) to be connected to a descending apparatus(162), for descending the support frame(151). On the top portion of the hanging bar(160) a hanging bar fixing means(164) is provided to fix the hanging bar(160) on the structure on the upper story of the corresponding work position. In the preferred embodiment of the present invention, a variation of the form tie bolt(157) is embodied. A hand rail bar(158) is vertically installed on the both sides of the support frame(151), to ensure the working space and the safety of an operator.

If the work for the corresponding story ends, the form tie bolt(157) is disassembled and then, the vertical member (155) and the wale(154) are disassembled. Thereafter, the descending apparatus(162) is driven to descend the metal wire(161) and thus, the support frame(151) moves to the lower story. Next, the hanging bar(160) is disassembled and re-used for hanging the sheeting at next story.

The preferred embodiment of the present invention has described the cast-in-place concrete beam as temporary facilities, but the reinforced concrete beam may be of course replaced with the PC beam manufactured in a factory.

Figure 57:
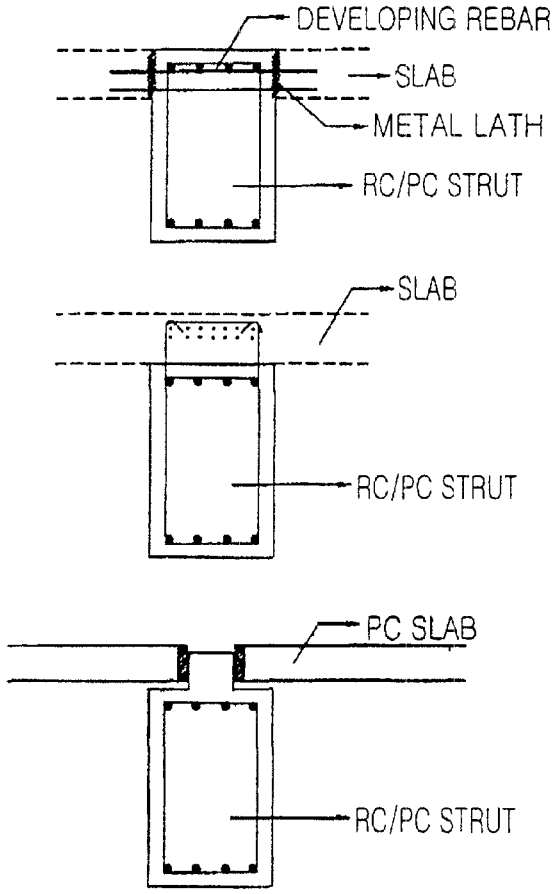

FIG. 57 shows the treating type of the reinforced concrete beam used in the present invention. There are several methods for coupling the reinforced concrete beam(114) with the bottom slab. Since the beam and the slab operate as a unitary body, various coupling methods are suggested in accordance with the section of the beam. In the preferred embodiment of the present invention, the coupling of the beam and the slab are tried, using conventionally various coupling methods. The reinforced concrete beam can select any of the cast-in-place concrete (RC), the factory manufactured concrete (PC), or their combined type.

FIGS. 59*a* to 62*c* are detailed exemplary views illustrating a zoning construction method for constructing a large building utilizing the detailed examples of the present invention.

The preferred embodiment of the present invention is applied when the excavation for a large area is needed, using the method for utilizing the part of the permanent structure as the strut for earth construction.

Figure 59A:
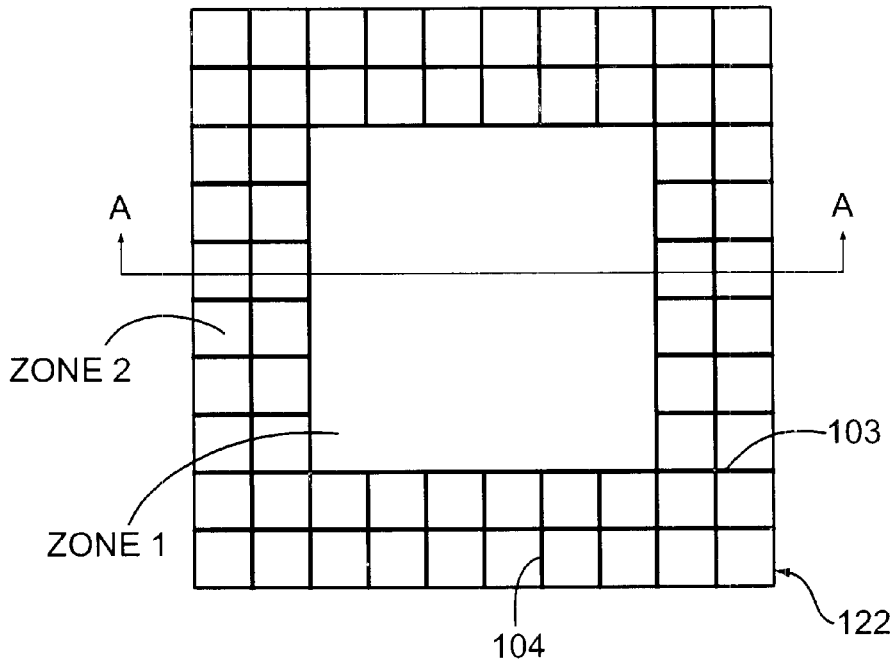
Figure 59B:
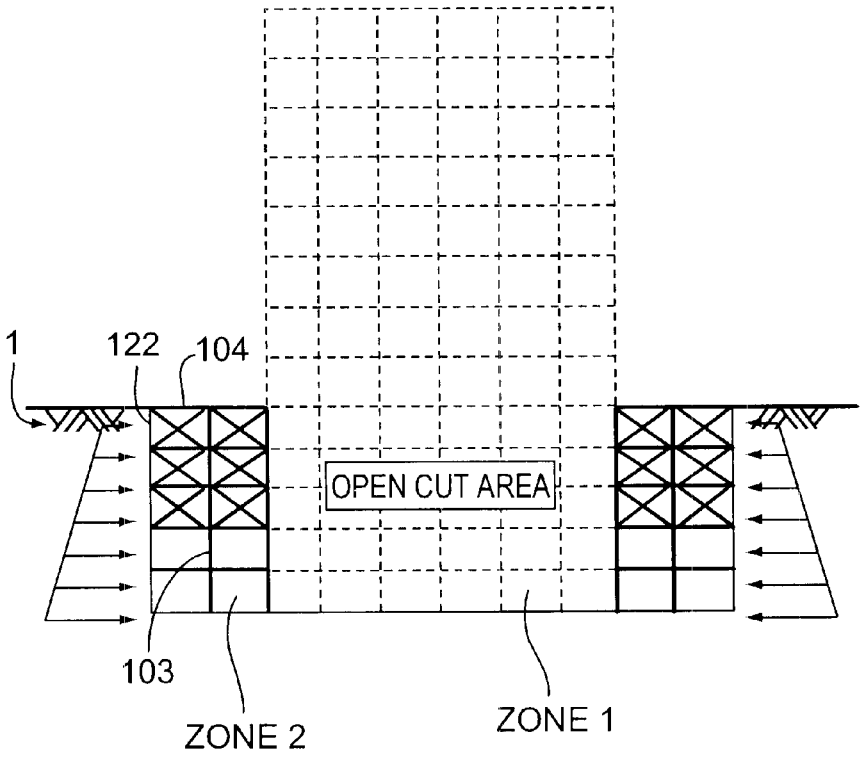
Figure 59C:
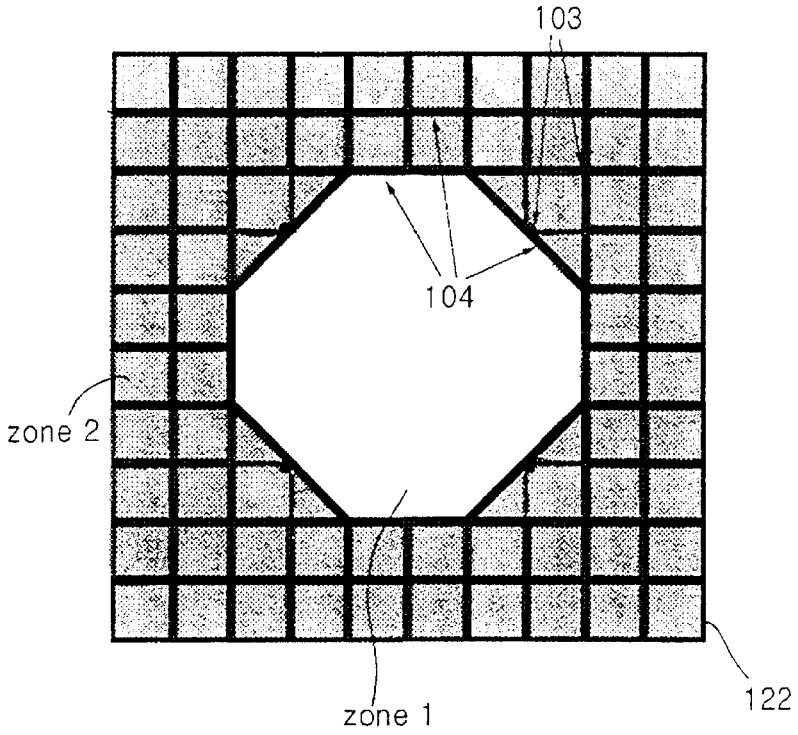

FIGS. 59*a* and 59*b* are plan and sectional views of the detailed example of the zoning construction method, and FIGS. 59*c* shows the variation of FIG. 59*a*.

In case of constructing a large building, as the area for excavating the site increases, it is difficult to excavate the area at a time. Therefore, the area is divided into several zones. Central zones are primarily constructed and the outside zones are excavated, while being supported by the central zones, which is called 'Island method'.

In the preferred embodiment of the present invention, the area where the large building is constructed is divided into a central zone (zone 1) and an outside zone (zone 2) and on the outside zone the permanent structure is utilized as the temporary facilities. That is, while the structure built on the outside zone works as the retaining wall, the earth construction for the central zone can be carried out without any installation of temporary facilities.

FIG. 59*c* shows the example where the edges of the central zone are reinforced by a bracing beam, in case where the permanent structure on the outside zone installed for the earth construction exhibits a poor yield strength because the central zone is large or the earth pressure is high. Of course, the concrete on the bottom of the first story on the ground can be pre-cast in order to reinforce the central zone or utilize the bottom of the first story on the ground as the working space.

Figure 60A:
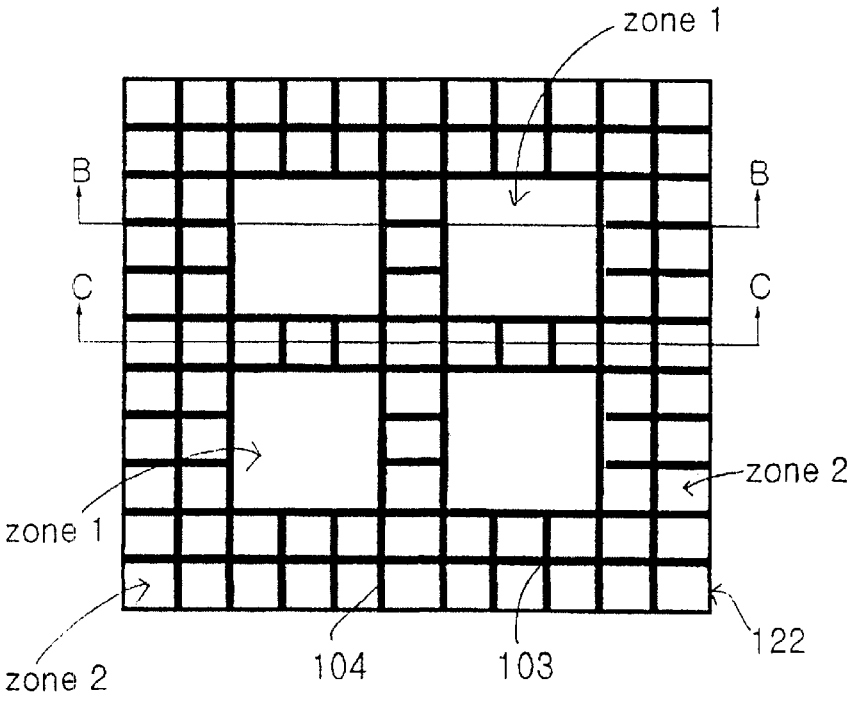
Figure 60B:
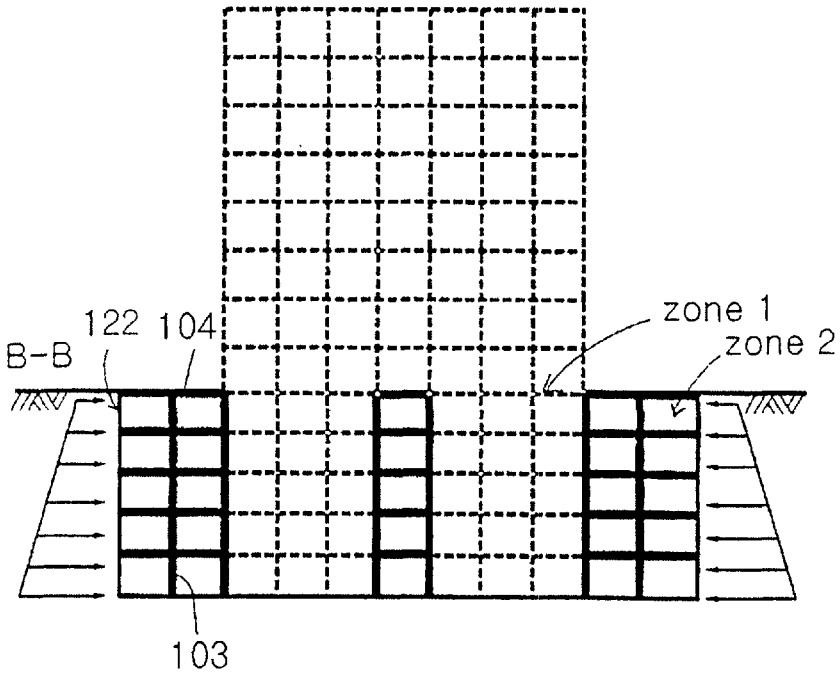
Figure 60C:
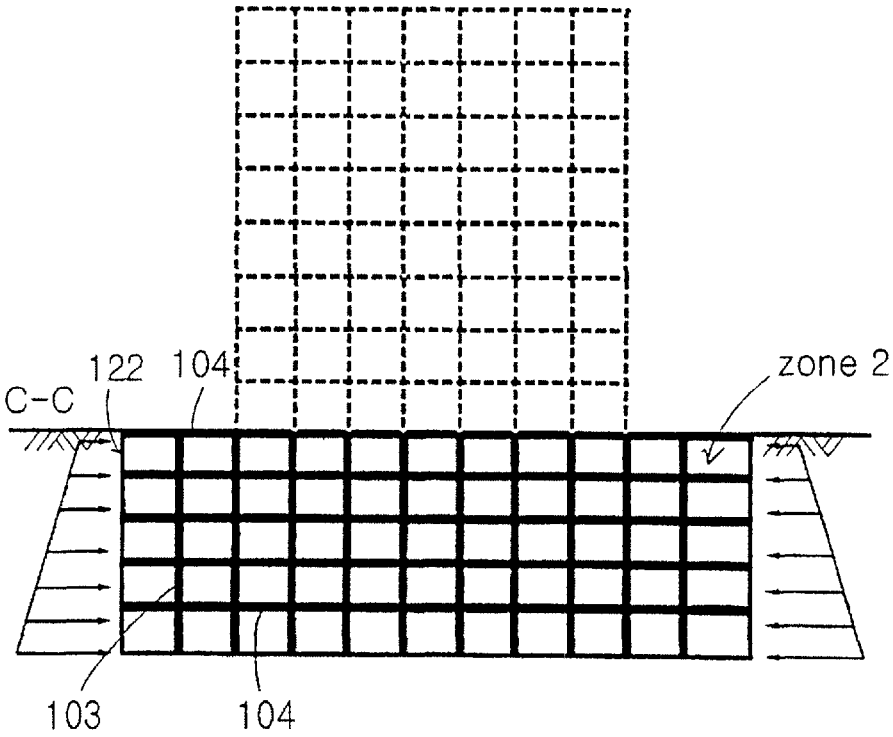

FIGS. 60*a* to 60*c* show the variation of FIGS. 59*a* to 59*c*.

If the area of the central zone becomes larger, the structure on the central zone can not endure the earth pressure by only the support of the structure on the outside zone. In this case, the central zone is reinforced in the form of cross, which ensures the safe construction.

Figure 61A:
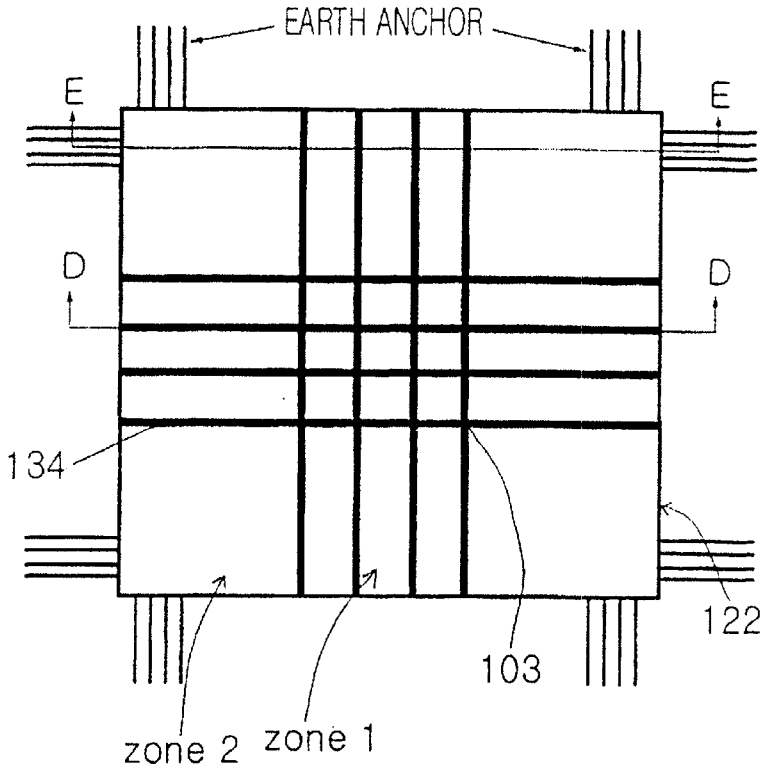
Figure 61B:
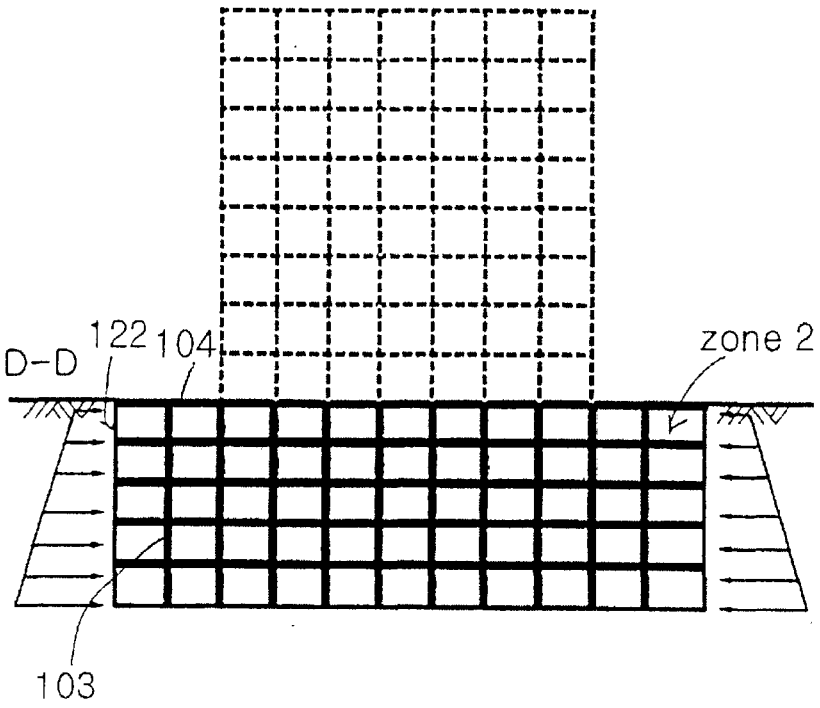
Figure 61C:
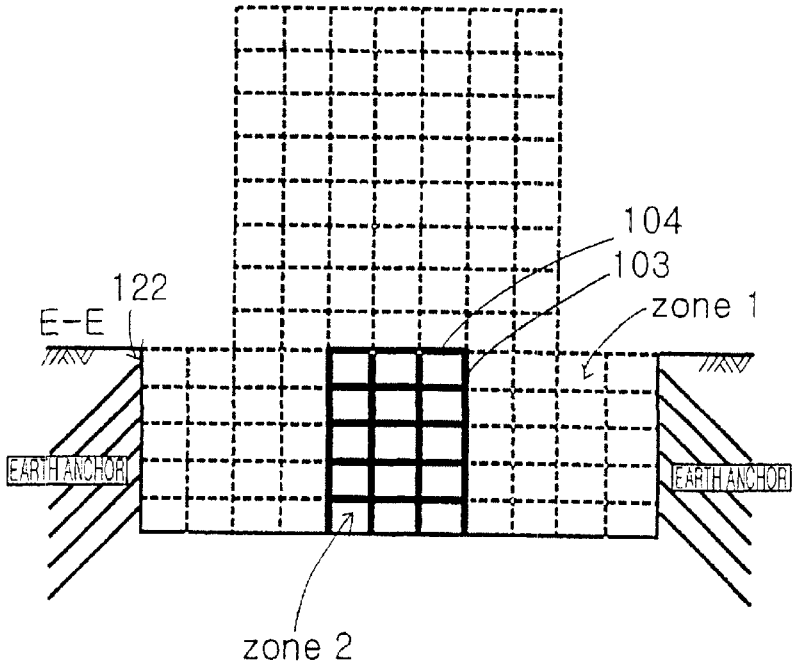

FIGS. 61*a* to 61*c* show another variation of FIGS. 59*a* to 59*c*.

Even if the ground is relatively small and another retaining wall construction method is applied (in the drawing, an earth anchor construction method is applied), the main structure can be utilized as the temporary support facilities. In this case, the main structure on the central zone surrounded with the retaining wall is pre-built in a vertical or crossing manner.

Figure 62A:
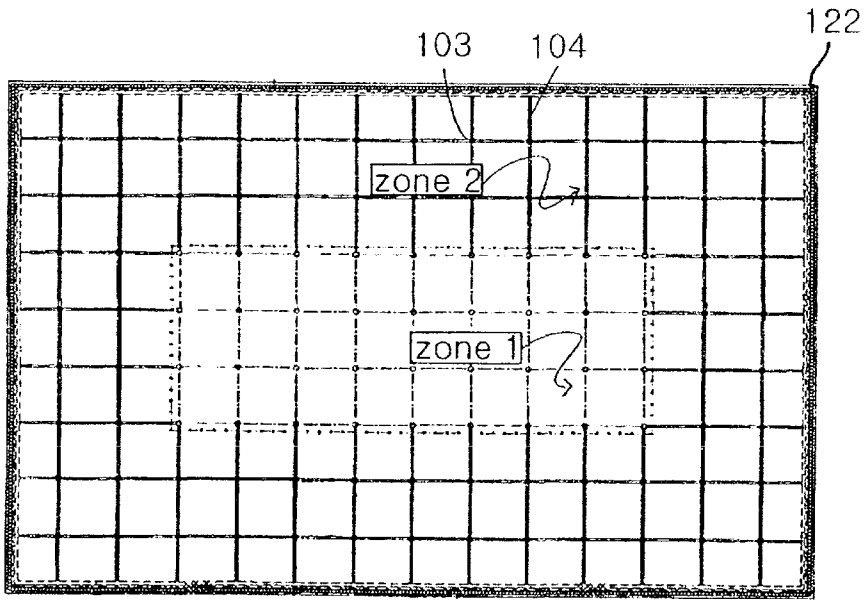
Figure 62B:
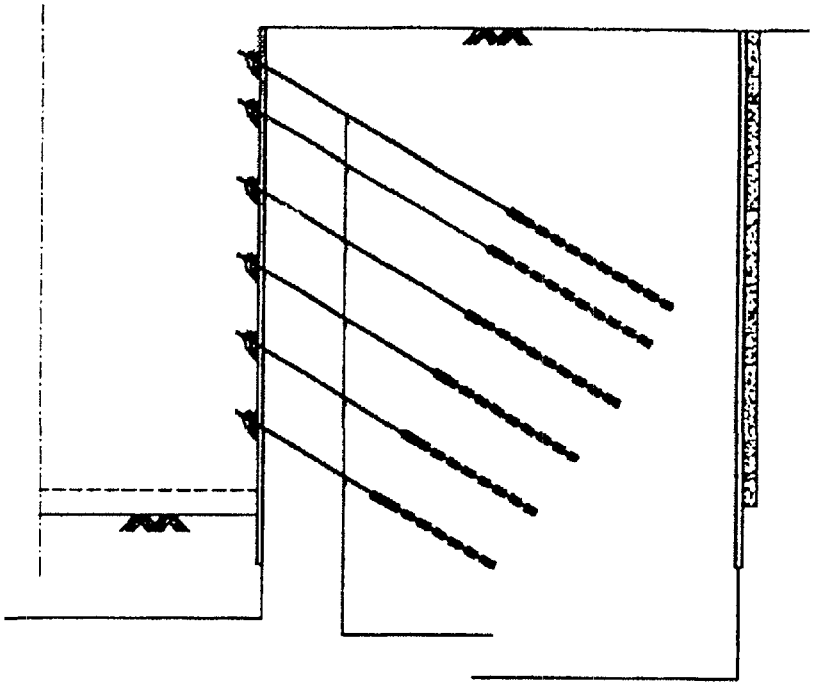
Figure 62C:
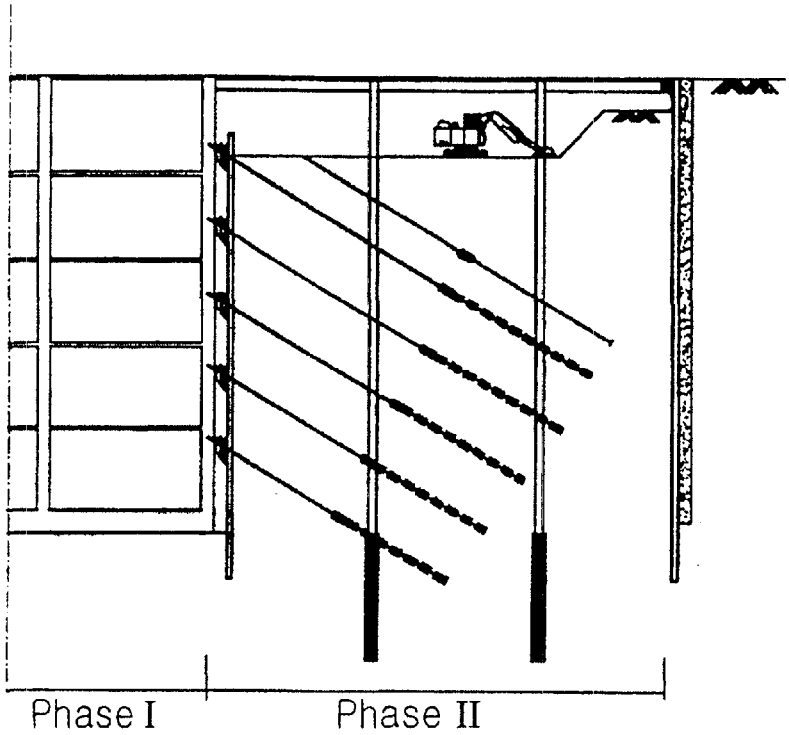

FIGS. 62*a* to 62*c* show another variation of FIGS. 59*a* to 59, in which FIG. 62*a* is a plan view and FIGS. 62*b* and 62*c* are sectional views illustrating the construction processes.

In the preferred embodiment of the present invention, to pre-build the central zone (zone 1), the retaining wall and the earth anchor surrounding the central zone are primarily installed and the central zone is excavated. Then, the structure on the central zone is built.

After the construction of the structure on the central zone, the structure on the outside zone (zone 2) is built by using a construction method for utilizing the permanent structure as the temporary facilities. At this time, one end of the structural member (e.g., beam) of the permanent structure is bonded on the underground retaining wall(122) and the other end thereof is assembled to the structure of the central zone, thereby serving as a strut.

What is claimed is:

1. A method for building an underground structure capable of utilizing a part of a permanent structure as a strut for earth construction at a location where a building, having a pillar and a lowermost part, is installed, comprising the steps of:

driving in an H-section steel pile on a boundary line at which the building is installed;

driving in a center pile on a position where the pillar of the building is installed;

carrying out a primary excavating work;

coupling the H-section steel pile with a concrete retaining wall by means of a fixing shear connecting means, thereby constructing an underground composite retaining wall;

installing a girder to be used as a part of a permanent structure on the composite retaining wall by means of an embedded plate and assembling and disposing the girder to the center pile; and carrying out a secondary excavating work and repeating the steps after the primary excavating work until the earth is excavated up to the lower most part of the building.

2. The method as defined in claim 1, wherein the step of installing a girder further comprises the step of installing a jack.

3. The method as defined in claim 1, further comprising the step of arranging reinforcing bars for supporting earth pressure for the purpose of reinforcing a lacking yield strength caused due to the non-installation of a wale on the composite retaining wall between the girder fixed by the embedded plate and another girder.

4. The method as defined in claim 1, further comprising the step of additionally installing, in case where the girder exhibits a weak yield strength against load such as earth pressure when the girder which is utilized as a part of a permanent structure is installed on the composite retaining wall by means of the embedded plate and assembled on the center pile, a temporary strut on the composite retaining wall, thereby reinforcing the yield strength of the girder.

5. The method as defined in claim 1, said driving in a center pile on a position where the pillar of the building is installed comprising the steps of:

taking away the earth on a position where a pillar is disposed and installing a steel pipe of a length of 1–1.2 m as a primary guide casing on a corresponding earth;

casting concrete on the exterior of the primary guide casing, for preventing the primary guide casing from moving;

punching the earth by inserting an auger into the interior of the primary guide casing;

inserting a secondary guide casing into the interior of the primary guide casing;

mounting an air hammer or bit in the interior of the secondary guide casing to punch a base rock;

inserting a center pile into the interior of the secondary guide casing; and filing concrete in the exterior of the center pile and the interior of the secondary guide casing and fixing the center pile.

6. The method as defined in claim 5, further comprising the step of installing a steel guide on a top end of the secondary guide casing.

* * * * *